US005641929A

United States Patent [19]

Okamoto et al.

[11] Patent Number: 5,641,929

[45] Date of Patent: Jun. 24, 1997

[54] APPARATUS FOR AND METHOD OF GENERATING MUSICAL TONES

[75] Inventors: Seiji Okamoto, Hamamatsu; Katsushi Ishii, Iwata; Yutaka Washiyama; Sayoko Hirano, both of Hamamatsu, all of Japan

[73] Assignee: Kawai Musical Inst. Mfg. Co., Ltd., Shizuoka-ken, Japan

[21] Appl. No.: 493,324

[22] Filed: Jun. 21, 1995

Related U.S. Application Data

[63] Continuation-in-part of Ser. No. 394,279, Feb. 24, 1995, which is a continuation-in-part of Ser. No. 312,612, Sep. 27, 1994.

[30] Foreign Application Priority Data

| | | | |
|---|---|---|---|
| Jun. 21, 1994 | [JP] | Japan | 6-139184 |
| Jun. 29, 1994 | [JP] | Japan | 6-148363 |
| Sep. 14, 1994 | [JP] | Japan | 6-219324 |
| Sep. 27, 1994 | [JP] | Japan | 6-231817 |

[51] Int. Cl.[6] ..... G10H 1/12; G10H 1/46

[52] U.S. Cl. ..... 84/623; 84/627; 84/633; 84/DIG. 9

[58] Field of Search ..... 84/602, 603, 604, 84/623, 607, 625, 627, DIG. 22, 613, 637, 650, 669, 633, DIG. 9

[56] References Cited

U.S. PATENT DOCUMENTS

| | | | |
|---|---|---|---|
| 3,668,294 | 6/1972 | Kameoka et al. | 84/1.01 |
| 4,236,434 | 12/1980 | Nishibe | 84/1.19 |
| 5,095,800 | 3/1992 | Matsuda | 84/618 |
| 5,107,747 | 4/1992 | Saito | 84/655 |
| 5,315,059 | 5/1994 | Saito | 84/656 |
| 5,410,099 | 4/1995 | Kosugi | 84/618 |

*Primary Examiner*—William M. Shoop, Jr.
*Assistant Examiner*—Marlon Fletcher

[57] ABSTRACT

Ratios of frequencies of frequency components of formant waveform signals are changed, and consonance of frequency components of a musical tone is controlled. Moreover, amplitudes, frequencies or numbers of formants are controlled depending upon the musical factors, making rich the contents for changing the musical tones.

37 Claims, 49 Drawing Sheets

FRM. FORM SIG. Ffj
(LEVEL)
(ADD.)

(LEVEL)
(ADD.)

(LEVEL)
(ADD.)

FRM. FORM
(dB)
1 2 3 4 5 6 7 8 9 10 11
(DEGREE)

(dB)
1 2 3 4 5 6 7 8 9 10 11
(DEGREE)

(dB)
1 2 3 4 5 6 7 8 9 10 11
(DEGREE)

FRM. : FORMANT
SIG. : SIGNAL
ADD. (ES) : ADDRESS (ES)

FRM. FORM
FRM. CARRIER SYNTHESIS
FRM. CARRIER SYNTHESIS
ωc
ωc

LINEAR OPE.

$Val_j += Val_j \pm SP_j$

EXPONENTIAL OPE.

$Val_j += (O_j - Val_j) \times SP_j + Val_j$

ADD.(ES) OF MEM. 523

OUTPUT OF LA. 525

SELECT SIG. S1
Σωfj-1+, U/Dj-1+(W)
Σωfj, U/Dj (R)
Ea, Ta (R)
CPU(R/W) (Ta, Ea(W))
Σωfj+, U/Dj+(W)
Σωfj+1, U/Dj+1(R)
Σωfj-1, U/Dj-1
Σωfj, U/Dj
Eaj-1, Taj-1
Eaj, Taj

| U/D | ΔSB | OPE. FORMULA Σωf | GATE OUTPUT cont.(515) |
|---|---|---|---|
| 0 | 1 | Ea+Δ | 0 |
| 0 | 0 | Ea−Δ | 1 |
| 1 | 0 | Ta+Δ | 0 |
| 1 | 1 | Ta−Δ | 1 |

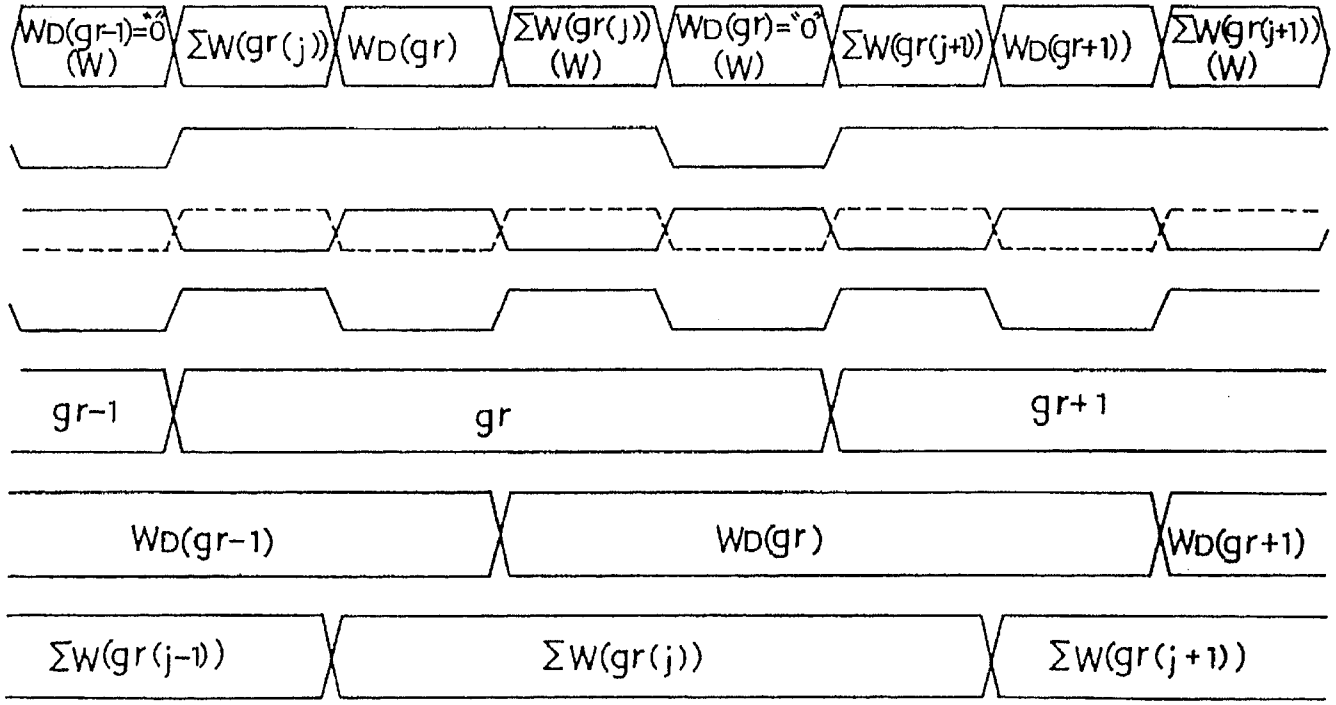
FIG.17A ADD. OF MEM.74
FIG.17B Zero
FIG.17C Div
FIG.17D S3
FIG.17E OUTPUT GROUP CHANNEL
FIG.17F WD OUTPUT OF LA.79
FIG.17G OUTPUT OF LA.75
WD(gr-1)="0" (W)
ΣW(gr(j))
WD(gr)
ΣW(gr(j)) (W)
WD(gr)="0" (W)
ΣW(gr(j+1))
WD(gr+1)
ΣW(gr(j+1)) (W)
gr-1
gr
gr+1
WD(gr-1)
WD(gr)
WD(gr+1)
ΣW(gr(j-1))
ΣW(gr(j))
ΣW(gr(j+1))

FIG. 18

211

HARMONICS WAVE MEM.

ELAPSED TIME OF SOUNDING (ENVELOPE LEVEL/PHASE) →

MUSICAL FACTORS ↓

| | | | | |
|---|---|---|---|---|
| ωcjk(t)… ajk(t)… cj(t) | ωcjk(t)… ajk(t)… cj(t) | ωcjk(t)… ajk(t)… cj(t) | …… | ωcjk(t)… ajk(t)… cj(t) |
| ωcjk(t)… ajk(t)… cj(t) | ωcjk(t)… ajk(t)… cj(t) | ωcjk(t)… ajk(t)… cj(t) | …… | ωcjk(t)… ajk(t)… cj(t) |
| ωcjk(t)… ajk(t)… cj(t) | ωcjk(t)… ajk(t)… cj(t) | ωcjk(t)… ajk(t)… cj(t) | …… | ωcjk(t)… ajk(t)… cj(t) |
| ωcjk(t)… ajk(t)… cj(t) | ωcjk(t)… ajk(t)… cj(t) | ωcj1(t) ωcj2(t) | aj1(t) aj2(t) | cj(t) k(t)… (t)… cj(t) |
| ωcjk(t)… ajk(t)… cj(t) | ωcjk(t)… ajk(t)… cj(t) | ωcj3(t) ⋮ | aj3(t) ⋮ | ωcjk(t)… ajk(t)… cj(t) |
| ⋮ | ⋮ | ωcjk(t) ⋮ | ajk(t) ⋮ | ⋮ |
| ωcjk(t)… ajk(t)… cj(t) | ωcjk(t)… ajk(t)… cj(t) | ωcjn(t) cj(t) | ajn(t) …… | ωcjk(t)… ajk(t)… cj(t) |

FIG. 22A SYN. WAVEFORM MEM. 802a

FIG. 22B SYN. WAVEFORM MEM. 802b

FIG. 22C SYN. WAVEFORM MEM. 802c

FIG. 22D SYN. WAVEFORM MEM. 802d

FIG. 22E AND GATE 801a OPEN

FIG. 22F AND GATE 801b OPEN

FIG. 22G AND GATE 801c OPEN

FIG. 22H AND GATE 801d OPEN

FIG. 22I OUTPUT OF SEL. 803a

FIG. 22J OUTPUT OF SEL. 803b

FIG. 25

212

| TABLE OF FRT. FORMS | | | | | |
|---|---|---|---|---|---|
| | ELAPSED TIME OF SOUNDING (ENVELOPE LEVEL/PHASE) → | | | | |
| MUSICAL FACTORS ↓ | ωfj (t)<br>Ta, Ea<br>SP, O, Min | ωfj (t)<br>Ta, Ea<br>SP, O, Min | ωfj (t)<br>Ta, Ea<br>SP, O, Min | ……<br>……<br>…… | ωfj (t)<br>Ta, Ea<br>SP, O, Min |
| | ωfj (t)<br>Ta, Ea<br>SP, O, Min | ωfj (t)<br>Ta, Ea<br>SP, O, Min | ωfj (t)<br>Ta, Ea<br>SP, O, Min | ……<br>……<br>…… | ωfj (t)<br>Ta, Ea<br>SP, O, Min |
| | ωfj (t)<br>Ta, Ea<br>SP, O, Min | ωfj (t)<br>Ta, Ea<br>SP, O, Min | ωfj (t)<br>Ta, Ea<br>SP, O, Min | ……<br>……<br>…… | ωfj (t)<br>Ta, Ea<br>SP, O, Min |
| | ωfj (t)<br>Ta, Ea<br>SP, O, Min | ωfj (t)<br>Ta, Ea<br>SP, O, Min | ωfj (t)<br>Ta, Ea<br>SP, O, Min | ……<br>……<br>…… | ωfj (t)<br>Ta, Ea<br>SP, O, Min |
| | ωfj (t)<br>Ta, Ea<br>SP, O, Min | ωfj (t)<br>Ta, Ea<br>SP, O, Min | ωfj (t)<br>Ta, Ea<br>SP, O, Min | ……<br>……<br>…… | ωfj (t)<br>Ta, Ea<br>SP, O, Min |
| | ⋮<br>⋮<br>⋮ | ⋮<br>⋮<br>⋮ | ⋮<br>⋮<br>⋮ | ⋮<br>⋮<br>⋮ | ⋮<br>⋮<br>⋮ |
| | ωfj (t)<br>Ta, Ea<br>SP, O, Min | ωfj (t)<br>Ta, Ea<br>SP, O, Min | ωfj (t)<br>Ta, Ea<br>SP, O, Min | ……<br>……<br>…… | ωfj (t)<br>Ta, Ea<br>SP, O, Min |

Fj(t)-1
Fj(t)-2

Σ Fj(t)
Gj(t)-1

Gj(t)-1
Σ Fj(t)
Gj(t)-2

Gj(t)-1
Gj(t)-2
Gj(t)-1
Σ Fj(t)
Σ Fj(t)
Gj(t)-3

Gj(t)-1
Gj(t)-2
Gj(t)-1
Gj(t)-3
Gj(t)-1
Gj(t)-2
Gj(t)-1
Σ Fj(t)
Σ Fj(t)
Σ Fj(t)
Σ Fj(t)
Σ Fj(t)

CONSONANT

NON-CONSONANT

FIG. 38

214

| TABLE OF FRM. CENTERS | | | | | |
|---|---|---|---|---|---|
| | *1 → | | | | |
| *2 ↓ | ωcj (t)<br>ωfj (t)<br>Ta, Ea<br>SP, O, Min | ωcj (t)<br>ωfj (t)<br>Ta, Ea<br>SP, O, Min | ωcj (t)<br>ωfj (t)<br>Ta, Ea<br>SP, O, Min | ……<br>……<br>……<br>…… | ωcj (t)<br>ωfj (t)<br>Ta, Ea<br>SP, O, Min |
| | ωcj (t)<br>ωfj (t)<br>Ta, Ea<br>SP, O, Min | ωcj (t)<br>ωfj (t)<br>Ta, Ea<br>SP, O, Min | ωcj (t)<br>ωfj (t)<br>Ta, Ea<br>SP, O, Min | ……<br>……<br>……<br>…… | ωcj (t)<br>ωfj (t)<br>Ta, Ea<br>SP, O, Min |
| | ωcj (t)<br>ωfj (t)<br>Ta, Ea<br>SP, O, Min | ωcj (t)<br>ωfj (t)<br>Ta, Ea<br>SP, O, Min | ωcj (t)<br>ωfj (t)<br>Ta, Ea<br>SP, O, Min | ……<br>……<br>……<br>…… | ωcj (t)<br>ωfj (t)<br>Ta, Ea<br>SP, O, Min |
| | ωcj (t)<br>ωfj (t)<br>Ta, Ea<br>SP, O, Min | ωcj (t)<br>ωfj (t)<br>Ta, Ea<br>SP, O, Min | ωcj (t)<br>ωfj (t)<br>Ta, Ea<br>SP, O, Min | ……<br>……<br>……<br>…… | ωcj (t)<br>ωfj (t)<br>Ta, Ea<br>SP, O, Min |
| | ωcj (t)<br>ωfj (t)<br>Ta, Ea<br>SP, O, Min | ωcj (t)<br>ωfj (t)<br>Ta, Ea<br>SP, O, Min | ωcj (t)<br>ωfj (t)<br>Ta, Ea<br>SP, O, Min | ……<br>……<br>……<br>…… | ωcj (t)<br>ωfj (t)<br>Ta, Ea<br>SP, O, Min |
| | ⋮ | ⋮ | ⋮ | ⋮ | ⋮ |
| | ωcj (t)<br>ωfj (t)<br>Ta, Ea<br>SP, O, Min | ωcj (t)<br>ωfj (t)<br>Ta, Ea<br>SP, O, Min | ωcj (t)<br>ωfj (t)<br>Ta, Ea<br>SP, O, Min | ……<br>……<br>……<br>…… | ωcj (t)<br>ωfj (t)<br>Ta, Ea<br>SP, O, Min |

*1: LAPSES OF SOUNDING TIME (ENVELOPE LEVELS/PHASES)

*2: MUSICAL FACTORS

FIG. 39

215

| TABLE OF FRM. CONSONANCE | | | | | |
|---|---|---|---|---|---|
| | *1 → | | | | |
| *2 ↓ | Hwj (t) | Hwj (t) | Hwj (t) | ..... | Hwj (t) |
| | Hwj (t) | Hwj (t) | Hwj (t) | ..... | Hwj (t) |
| | Hwj (t) | Hwj (t) | Hwj (t) | ..... | Hwj (t) |
| | Hwj (t) | Hwj (t) | Hwj (t) | ..... | Hwj (t) |
| | Hwj (t) | Hwj (t) | Hwj (t) | ..... | Hwj (t) |
| | ⋮ | ⋮ | ⋮ | ⋮ | ⋮ |
| | Hwj (t) | Hwj (t) | Hwj (t) | ..... | Hwj (t) |
| *1: LAPSES OF SOUNDING TIME (ENVELOPE LEVELS/PHASES) | | | | | |
| *2: MUSICAL FACTORS | | | | | |

FIG. 40

216

| TABLE OF SAMPLING MODIFICATION | | | | | |
|---|---|---|---|---|---|
| | *1 → | | | | |
| *2 ↓ | Sfj (t) | Sfj (t) | Sfj (t) | ..... | Sfj (t) |
| | Sfj (t) | Sfj (t) | Sfj (t) | ..... | Sfj (t) |
| | Sfj (t) | Sfj (t) | Sfj (t) | ..... | Sfj (t) |
| | Sfj (t) | Sfj (t) | Sfj (t) | ..... | Sfj (t) |
| | Sfj (t) | Sfj (t) | Sfj (t) | ..... | Sfj (t) |
| | ⋮ | ⋮ | ⋮ | ⋮ | ⋮ |
| | Sfj (t) | Sfj (t) | Sfj (t) | ..... | Sfj (t) |
| *1 : LAPSES OF SOUNDING TIME (ENVELOPE LEVELS/PHASES) | | | | | |
| *2 : MUSICAL FACTORS | | | | | |

WEIGHTING
WG
654

LAPSES OF SOUNDING
TIME Tj(t)

MUSICAL
FACTORS
Tj(t)

MUSICAL
FACTORS
Tj(t)

MUSICAL
FACTORS
Tj(t)

MUSICAL
FACTORS
Tj(t)

MUSICAL
FACTORS
Tj(t)

FRM. CARRIER
CHANGE
PARAMETERS ωcj(t)
657

LAPSES OF SOUNDING
TIME Tj(t)

MUSICAL
FACTORS
Tj(t)

MUSICAL
FACTORS
Tj(t)

MUSICAL
FACTORS
Tj(t)

MUSICAL
FACTORS
Tj(t)

MUSICAL
FACTORS
Tj(t)

APPARATUS FOR AND METHOD OF GENERATING MUSICAL TONES

This application is a continuation-in-part of application Ser. No. 08/394,279 filed on Feb. 24, 1995, the entire contents of which are hereby incorporated by reference, which is a continuation-in-part application of Ser. No. 08/312,612 filed on Sep. 27, 1994, the entire contents of which are hereby incorporated by reference.

BACKGROUND OF TEE INVENTION

1. Field of the Invention

This invention relates to an apparatus for and a method of generating musical tones, and more particularly, to the generation of formant waveform signals having waveforms obtained by synthesizing frequency components corresponding to specific formants of musical tones.

2. Description of the Related Art

In the field of musical tone generation apparatus and method, there has seldom been apparatus for performing control concerning formant. However, there has been apparatus, in which formant waveform signals obtained by synthesizing frequency components in a specific frequency band corresponding to specific formants are stored in a memory and read out by supplying read address data thereto.

Such apparatus, however, permits the only formant waveform signals to be merely read out and cannot change contents of the musical tones. For example when a designated tone pith is changed, the increment rate of the read address data is changed. In this way, it is possible to generate a formant waveform signal corresponding to the tone pitch. However, the width and the density of frequency components of the formant of the formant waveform signal are changed in proportion to the change in the tone pitch. While there is no problem where such proportional changes are permissible, there are many cases where such changes are not permissible or changes other than the proportional ones are required. Therefore, it has been impossible to generate formant waveform signals, in which the density of the formant frequency components has no bearing on the tone pitch changes.

SUMMARY OF THE INVENTION

The present invention was accomplished in order to solve the above-mentioned problems, and its object is to arbitrarily change the contents of formant waveform signals irrespective of changes in the tone pitch or the like.

According to a first invention, formant consonance data are determined for a musical tone based upon frequency data of formant center signals concerning the formant consonance data for determining ratios of frequencies of frequency components of formants of formant waveform signals and, hence, changes in the formant consonance data are made different relative to changes in the formant center frequency data. Accordingly, the control operation is carried out maintaining a special correlation in which the frequency of the formant center signal does not change in proportion to the frequencies of frequency components of formants. For instance, when the values of frequencies of formant center signals are 1:2.6:4.35 in three formants of a musical tone, differences (gaps) among the frequencies of harmonics of formant waveform signals can be set to be 1:1.1:1.2, and the ratios of frequencies of harmonics of formant waveform signals can be either an integer number of times or a non-integer number of times.

According to a second invention, formant consonance data for determining ratios of frequencies of frequency components of formants of formant waveform signals are synthesized into formant density data that represent densities of frequency components of the formants, and the densities of frequency components of formants of the formant waveform signals are controlled based upon the synthesized formant density data. Therefore, the densities of frequency components of formants are controlled relying upon the ratios of frequencies of frequency components, and the ratio of frequencies of frequency components can be set to be either an integer number of times or a non-integer number of times.

According to a third invention, the formant density data are synthesized to modification data that represent ratio or difference between a frequency that is based on the formant density data and serves as a reference and a practical storing sampling frequency of the stored formant waveform signals. The formant density data represent densities of frequency components of formants of the formant waveform signals or that determine the speed of reading the formant waveform signals. It is therefore made possible to generate formant waveform signals having any formant density without limited by the practical storing sampling frequency that is stored of the formant waveform signals.

According to a fourth invention, the formant density data representing densities of frequency components of formants of the formant waveform signals or determining the speed of reading the formant waveform signals, are generated based upon the pitch data of a musical tone. Accordingly, densities of frequency components of formants are determined depending upon the pitch of the musical tone, and the formants are controlled depending upon the pitch.

According to a fifth invention, a plurality of formant center signals of a musical tone are controlled for their frequency, amplitude or number depending upon musical factors. According to the fifth invention, furthermore, a plurality of formant waveform signals of a musical tone are controlled for their amplitude depending upon musical factors. Therefore, the content for changing the musical tone becomes rich.

According to a sixth invention, a plurality of formant synthesized signals are controlled for their frequency, amplitude or number depending upon musical factors. According to the sixth invention, furthermore, signals obtained by synthesizing a plurality of formant synthesized signals are further controlled for their frequency, amplitude or number depending upon musical factors, enabling the content for changing the musical tone to become more rich.

BRIEF DESCRIPTION OF THE DRAWINGS

FIGS. 17A–17G are time charts concerning the accumulator 70.

FIG. 18 is a diagram showing a harmonic wave memory 211 in a program/data storage unit 21;

FIG. 25 is a diagram showing a formant form table 212 in the program/data storage unit 21;

FIG. 38 is a diagram illustrating a table 214 of formant centers;

FIG. 39 is a diagram illustrating the whole formant consonance data Hwj(t) of a table 215 of formant consonance;

FIG. 40 is a diagram illustrating sampling modification data Sfj(t) of a table 216 of sampling modification;

Figure 1:
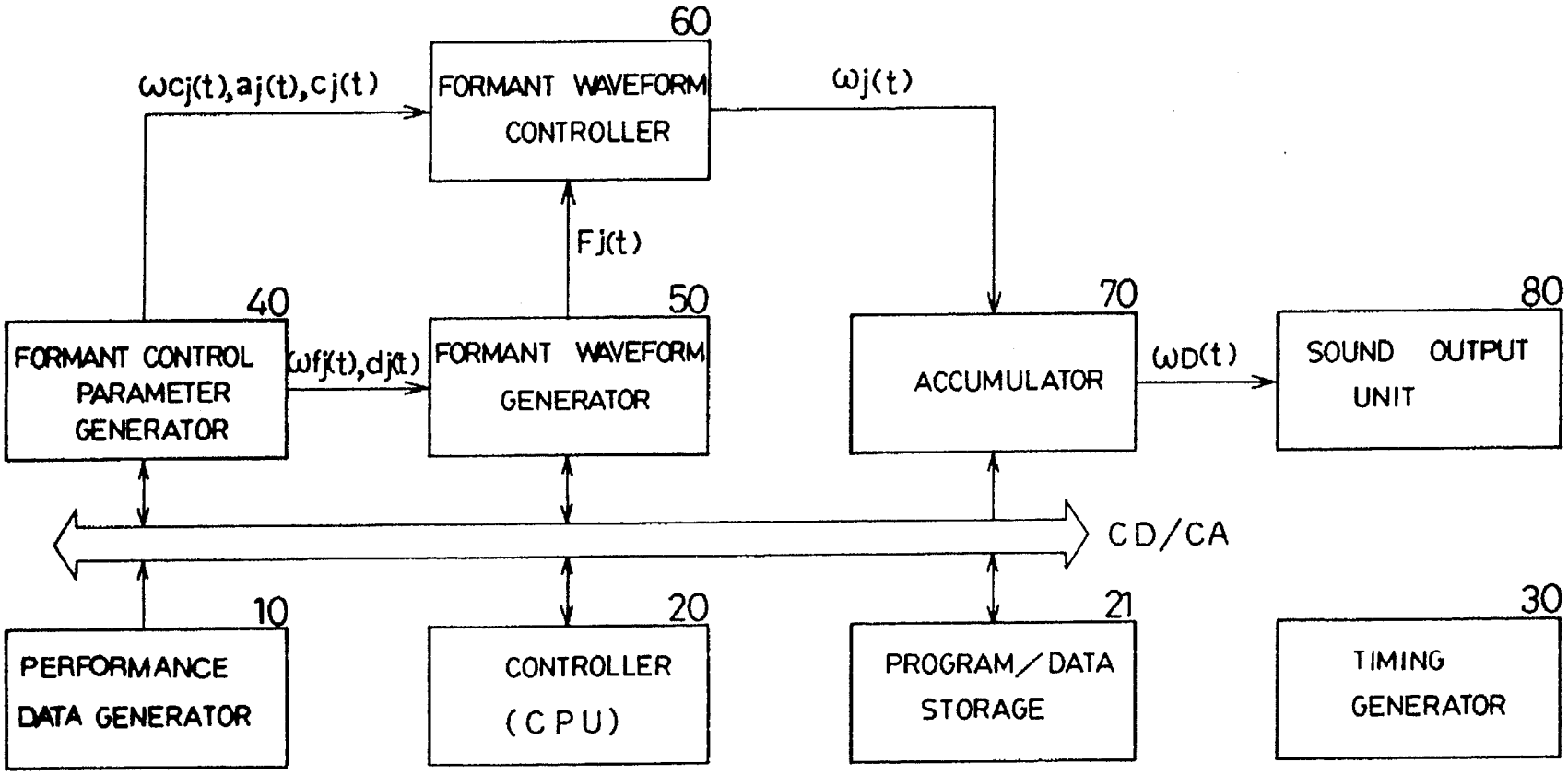
FIG. 1 is a block diagram showing a musical tone generation apparatus.

FRM.:FORMANT, SIG.:SIGNAL, ADD.(ES):ADDRESS(ES), OPE.:OPERATION, CONT.:CONTROLLER, LA.:LATCH, MEM.:MEMORY, FRT.:FORMANT, SGL.:SIGNAL, SYN.:SYNTHESIZED, REG.:REGISTER, SEL.:SELECTOR, CKT.:CIRCUIT, PAR.:PARAMETE, GEN.:GENERATOR, FREQ.:FREQUENCY-DETAILED

DESCRIPTION OF THE PREFERRED EMBODIMENTS

Summary of the Embodiment

As for the frequency formant consonance data Hfj(t) in a table 93 of frequency non-consonance, the values corresponding to formant carrier parameters cj(t) are read out, weighted by the whole formant consonance data Hwj(t) through a multiplier 94, added and synthesized to frequency number data FN through an adder 92, and are output as formant density parameters fj(t). Thus, ratios of frequencies of frequency components of formants determined by the formant density parameters fj(t) are controlled, i.e., consonance (density) is controlled. This control is effected for a plurality of formant carrier parameters cj(t) for each of the formants. The frequency number data FN are multiplied and modified by a sampling modification data Sfj(t) through a multiplier 91 and are modified depending upon a change in the stored sampling frequency of formant waveform signals Ffj(t).

Formant control parameter aj(t) are weighted by weighting data WG through a multiplier 653, multiplied and synthesized by the formant waveform signals Fj(t) or by formant carrier signals Gj(t) and are controlled for their amplitude. The formant control parameters aj(t) and the weighting data WG vary depending upon musical factors, and the content of the above amplitude control changes corresponding thereto, so that the frequency or number of the formant carrier signals Gj(t) is determined. The values or numbers of formant carrier parameters cj(t) and formant density parameters fj(t) of the table 214 of formant centers, change depending upon musical factors, and the control content of frequency or number of the formant carrier signals Gj(t) changes corresponding thereto.

The formant control parameters aj(t) are weighted by the weighting data WG through a multiplier 661, multiplied, divided and synthesized by formant synthesized signals Wj(t) and are controlled for their amplitude. Likewise, formant synthetic signals Wj(t) accumulated for each of the groups of musical tones are controlled for their amplitude through a multiplier 660. The formant control parameters aj(t) and weighting data WG change depending upon musical factors, content of amplitude control changes correspondingly, and the frequency or the number of the formant carrier signals Gj (t) or formant synthesized signals Wj(t) is determined. The values or numbers of formant carrier parameters cj(t) and formant density parameters fj(t) of the table 214 of formant centers change depending upon musical factors, and the control content of frequency or number of the formant synthetic signals Wj(t) changes corresponding thereto.

1. Overall Circuitry

FIG. 1 shows the overall circuitry of the musical tone generation apparatus. A performance data generator 10 generates tone pitch data and other performance data. The performance data generator 10 is a sounding designation unit for playing music by manual operation, an auto play unit or an interface. Among the performance data that are generated by the performance data generator 10 are musical factor data, for example tone pitch data (tone pitch range data (upper keyboard, lower keyboard and pedal keyboard)), data of time elapsed from the start of sounding, performance part data, musical tone part data, musical instrument part data and other data. As the sounding designation unit is used keyboard instruments, string instruments, wind instruments, percussion instruments, computer keyboards, etc. The auto play unit automatically reproduces stored performance data. The interface is a MIDI (musical instrument digital interface) or the like which receives performance data from a unit connected to the interface or send performance data to the connected unit.

The performance data generator 10 has various switches, such as timbre tablets, effect switches, rhythm switches, pedals, wheels, levers, dials, handles, touch switches, etc, which are for musical instruments. From these various switches musical factor data are input. Among the musical factor data are timbre data, touch data (indicative of the speed/strength of sound designation operation), effect data, rhythm data, stereo data, quantization data, modulation data, tempo data, volume data, envelope data, data of time elapsed from the start of sounding, etc.

These musical factor data are included in the performance data and are input from the various switches noted above. Further, these musical factor data are contained in the auto performance data or in performance data that are transmitted or received via the interface. The touch switches are provided in one-to-one correspondence to sounding designation units, and the touch switches generate initial touch data and after-touch data indicative of the speed and strength of touch. The timbre data correspond to tones of musical instruments such as keyboard instruments (e.g., piano), wind instruments (e.g., flute), string instruments (e.g., violin), percussion instruments (e.g., drums), etc. The envelope data are envelope level data, envelope phase data, etc. The performance part data, musical tone part data and musical instrument part data correspond to, for instance, melody, accompaniment, chord, base, etc. and also correspond to upper keyboard, lower keyboard, foot keyboard, etc. These musical factor data are supplied to controller 20 for the switching of various signals, data and parameters as will be described later.

The performance data are processed in the controller 20, and various data thus produced are fed to a formant control parameter generator 40, a formant waveform generator 50 and an accumulator 70 to generate formant synthesis signal Wj(t). The controller 20 is constituted by a CPU etc.. A program/data storage 21 is constituted by such storage units as ROM and RAM. In the program/data storage 21 are stored programs for various processes which are executed by the controller 20 as well as the various data noted above and various other data. Among the various data are those necessary for time division processes and those for assignment of time division channels.

The formant synthesis signal Wj(t) is generated on a time division basis through the formant control parameter generator 40, formant waveform generator 50 and formant waveform controller 60. In Wj(t), "j" indicates the division order of time division process or channel number. The formant control parameter generator 40 can generate various parameters, i.e., formant control parameters ω cj(t), ω fj(t), aj(t), cj(t), dj(t), etc., which are necessary for generating the formant synthesis signal Wj(t).

These parameters will be described later in detail. Through the formant waveform generator 50 and formant waveform controller 60, formant synthesis signal Wj(t) is read out, generated and synthesized according to the formant control parameter input. The formant synthesis signal Wj(t) is accumulated and synthesized for each group channel in the accumulator 70 to be output and sounded as musical tone from a sounding unit 80.

From a timing generator 30 timing control signals for synchronizing the entire circuitry of the musical tone generation apparatus are output to the individual circuits. Among the timing control signals are clock signals at various frequencies, the AND or OR of these clock signals, a signal at a frequency corresponding to the channel division time in the time division process, channel number data j, etc.

2. Formant Control Parameters and Formants

Figures 2A, 2B, 2C, 2D, 2E, 2F:
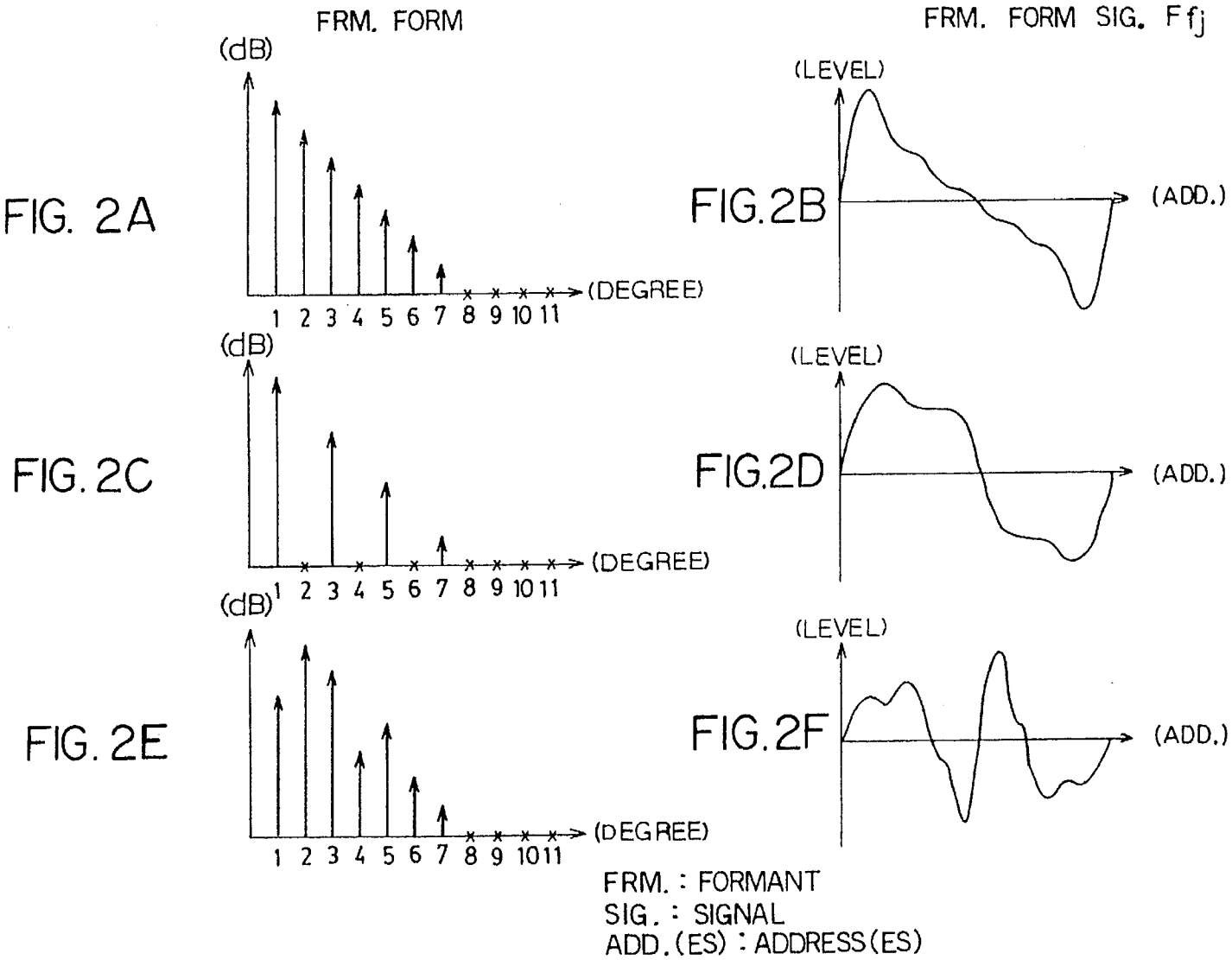
FIGS. 2A–2F is a view showing the correspondence between formant forms and formant waveform signals Ffj (t)

FIGS. 2 to 4 show the relation between the formant control parameter noted above and formant. FIG. 2 shows simple examples of the correspondence between formant and formant waveform signal Ffj (t) . Referring to FIG. 2A, it is shown that the levels of the first harmonics (fundamental wave), second harmonics, third harmonics, . . . , of frequency spectrum components are successively reduced with an equal difference. The formant form in FIG. 2A is a half triangle form. Shown in FIG. 2B is the waveform of the formant waveform signal Ffj(t) which is obtained as a result of synthesizing the frequency components in a specific frequency band corresponding to the formant of musical tone (of musical instruments) shown in FIG. 2B.

Shown in FIG. 2C is a formant form which is obtained by selecting only the odd number ones of the frequency spectrum components shown in FIG. 2A. While this formant form is also half triangular, the corresponding synthesized formant waveform signal Ffj(t) has a waveform as shown in FIG. 2D. Shown in FIG. 2E is a formant form obtained by changing the levels of the orders of the frequency spectrum components in FIG. 2A. This formant form is a two-hill form, and the corresponding synthesized formant waveform signal Ffj(t) has a waveform as shown in FIG. 2F.

The illustrated formant waveform signals Ffj(t) are only examples, and it is possible to realize various formant waveform signals Ffj(t) by varying the formant form. Such various formant waveform signals Ffj(t) are stored in a formant waveform memory 53 which will be described later. The frequencies of the frequency spectrum components in FIGS. 2A, 2C and 2E are in integral ratio relation to one another, but it is also possible to relate the frequencies in a non-integral ratio relation. Such non-integral ratio relation formant waveform signals Ffj (t) are also stored in the formant waveform memory 53.

Figure 3A:
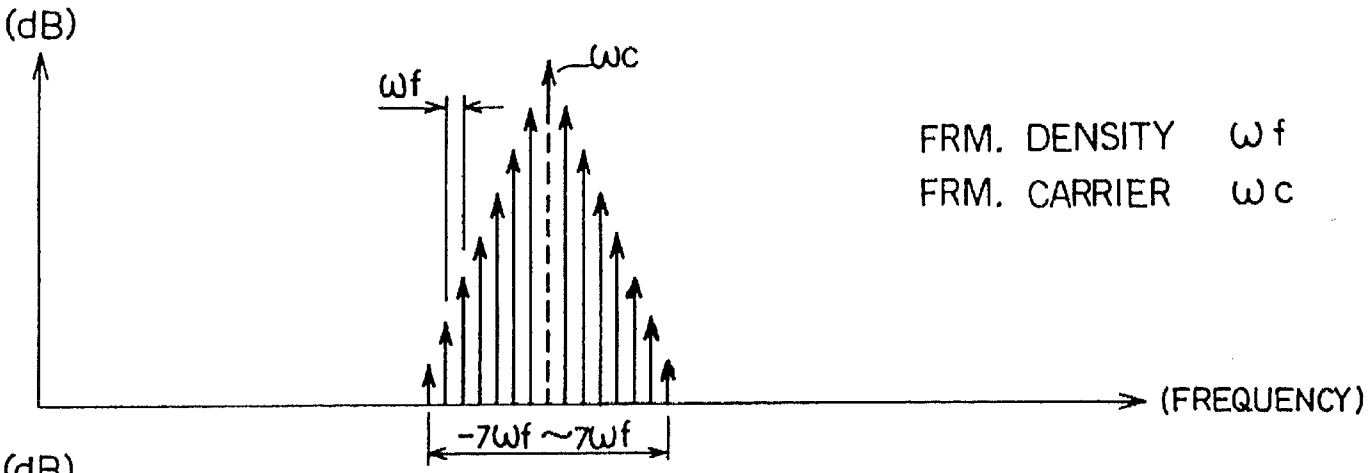
FIGS. 3A and 3B are views showing the relation between formant form and formant density parameter ω fj(t)

In FIG. 3A are shown the frequency spectral components of a musical tone waveform obtained as a result of synthesis of the formant waveform Ffj(t) shown in FIG. 2B, on formant carrier signal cosω c(t) as the formant center signal (fundamental wave). The formant waveform Ffj(t) is read out at a rate corresponding to formant density parameter ω fj(t), one of the formant control parameters. As the frequency spectrum of the resultant signal of synthesis of the formant waveform signal Ffj(t) on the formant carrier signal cosω c(t), the formant shown in FIG. 2A is formed on both side of formant carrier parameter ω c as the center. In this case the other formants except FIG. 2A are formed, but are not shown in this FIG. 2. The formant carrier parameter ω c determines the frequency of the formant carrier signal (or formant center signal) cosω c(t).

Figure 3B:
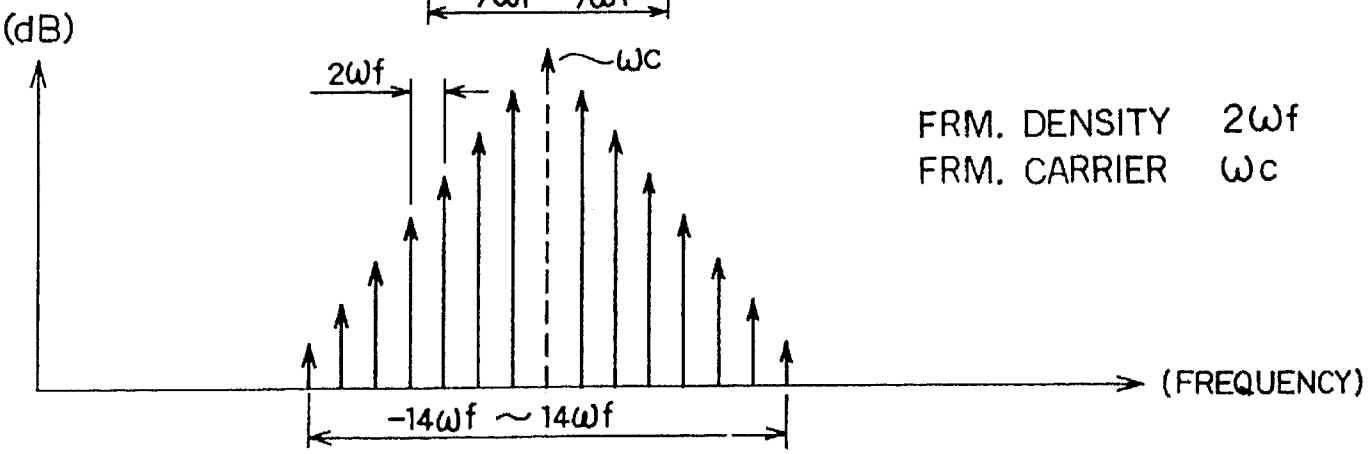

When the formant waveform signal Ffj(t) in FIG. 2B is read out at a rate corresponding to the formant density parameter ω f, the formant has a width of ±7ω f vertically as shown in FIG. 3A. When the formant waveform signal Ffj(t) is read out at double the rate corresponding to the formant density parameter ω f, the width of the formant is spread to ±14ω vertically as shown in FIG. 3B.

Thus, the formant density parameter ω f determines the width of the formant, i.e., the density of the frequency components of the formant. Further, a change in the value of the formant density parameter ω f causes the formant itself to slide along the frequency axis. Thus, the formant density parameter ω f further determines the position of the formant on the frequency axis.

Figures 4A, 4B, 4C, 4D, 4E, 4F:
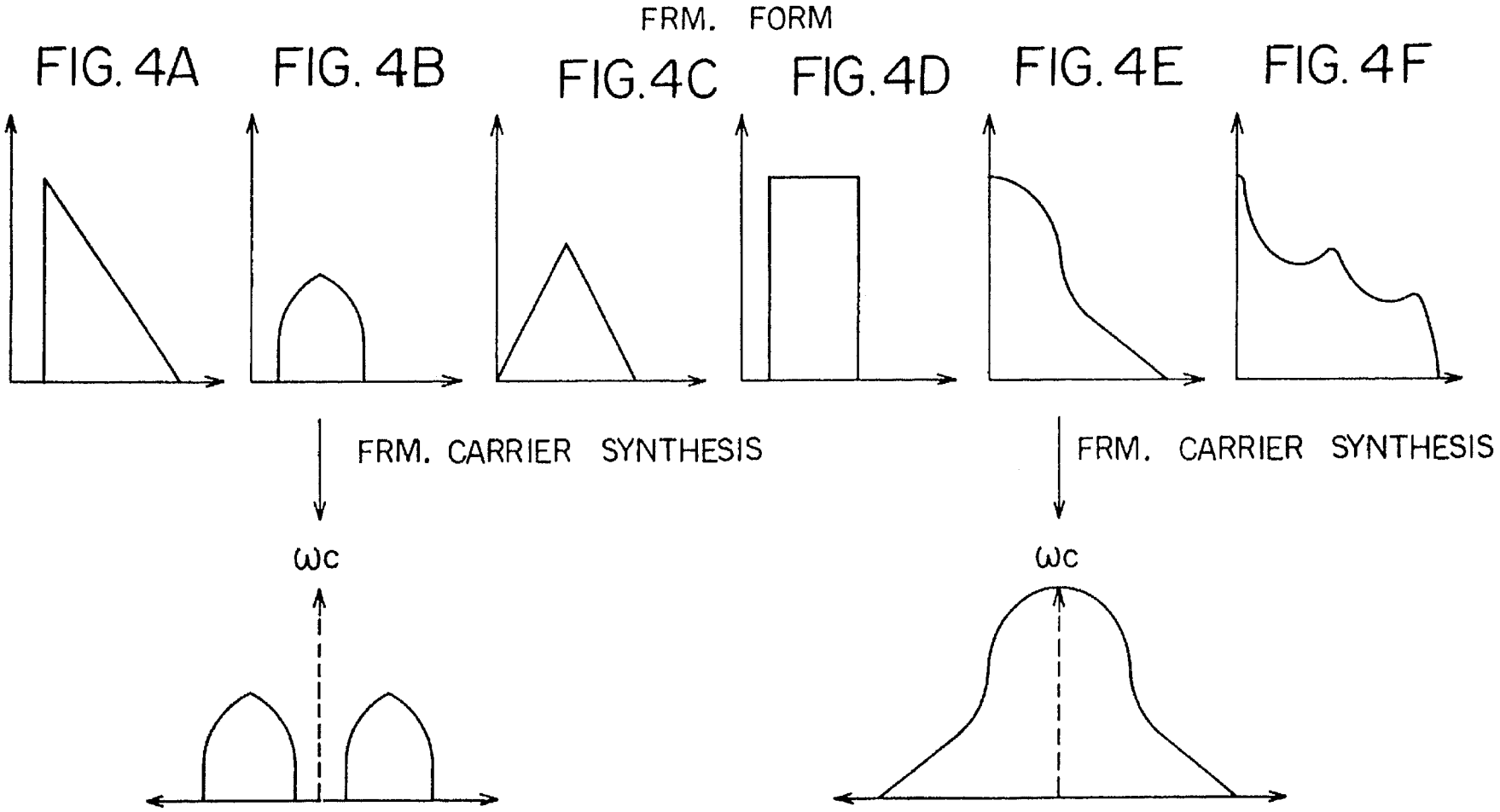
FIGS. 4A–4F are views showing various formant forms.

FIG. 4 shows forms of formants corresponding to various formant waveform signals Ffj(t), the forms being half triangular, pot-like, triangular, rectangular, etc. There are various other forms such as half circular, hill-like, two-hill-like, etc. Further, there are composite formants consisting of pluralities of these (like) formants combined (synthesized) to be or not to be overlapped. By synthesizing such a formant waveform signal Ffj(t) on the formant carrier signal cosω c(t), a line symmetry formant as shown in FIG. 4B is formed. Thus, with the same form of formant of the formant waveform signal Ffj(t), different formants are obtainable through synthesis on the formant carrier signal by shifting the formant along the frequency axis. Thus, it is possible to vary the character of musical tones that are output as a result of the synthesis.

To the formant waveform signal Ffj(t) is added formant waveform bias parameter dj(t). The signal after the addition is also called formant waveform signal Fj(t). The formant waveform bias parameter dj(t) is a factor which determines the level or bias of the formant waveform signal Ffj(t), and the strength of the formant is determined by the magnitude of the formant waveform bias parameter dj(t). The addition of the formant waveform bias parameter dj(t) may be replaced with multiplification thereby, with both the addition and multiplification or all kinds of calculations (1) will be described later in detail.

With multiplification synthesis of the formant waveform signal Fj(t) on the formant carrier signal cosω ct as the formant center signal, a musical tone having the corresponding tone pitch can be realized. In this case, the formant waveform signal Fj(t) is synthesized not only as harmonic components but also as subharmonic components on the formant carrier signal cosω ct, thus providing the synthesized musical tone with a spread.

When the formant density parameter ωfj(t) which determines the rate of reading of the formant waveform signal Fj(t) (formant waveform signal Ffj(t)) is changed according to the designated tone pitch, the formant waveform signal Fj(t) itself is changed to correspond to the tone pitch, but it is no longer possible to control the formant density of the formant waveform signal Fj(t) independently of the tone pitch. The multiplification of the formant carrier signal cosω ct by the formant waveform signal Fj(t) may be replaced with addition, by both the addition and multiplification or all kinds of calculations (1) will be described later in detail.

The formant carrier signal cosω ct is multiplied by the formant carrier level parameter aj(t), and formant carrier bias parameter c(t) is added. The formant carrier level parameter aj(t) and formant carrier bias parameter cj(t) are factors which determine the level of the the formant carrier signal cosω ct, a value of the both parameter aj(t) and cj(t) determine a strength of the musical sound. The formant carrier level parameter aj(t) has the same character as amplitude modulation signal, and by varying the value of the formant carrier level parameter aj(t), it is possible to obtain, in addition to the amplitude modulation effect, envelope control, stereo position control, measurement of the elapsed time from the start of sounding, etc.

The formant synthesis signal Wj(t) is expressed with the above formant control parameters ω cj(t), aj(t), cj(t) and dj(t) and the formant waveform signal Ffj(t) as follows.

$$Wj(t)=\{aj(t)\times cos\omega cj(t)\pm cj(t)\}$$
$$\times\{Ffj(t)+dj(t)\}$$

The formant carrier signal cosω ct may or may not be in accord with the formant center signal at the formant peak corresponding to the formant waveform signal Ffj(t). For example, the level of the formant carrier signal cosω ct is lower than the level at the formant peak point corresponding to the formant waveform signal Ffj(t). This can be attained by adequately selecting the values of the formant control parameters aj(t), cj(t) and dj(t).

3. Formant Control Parameter Generator 40

Figure 5:
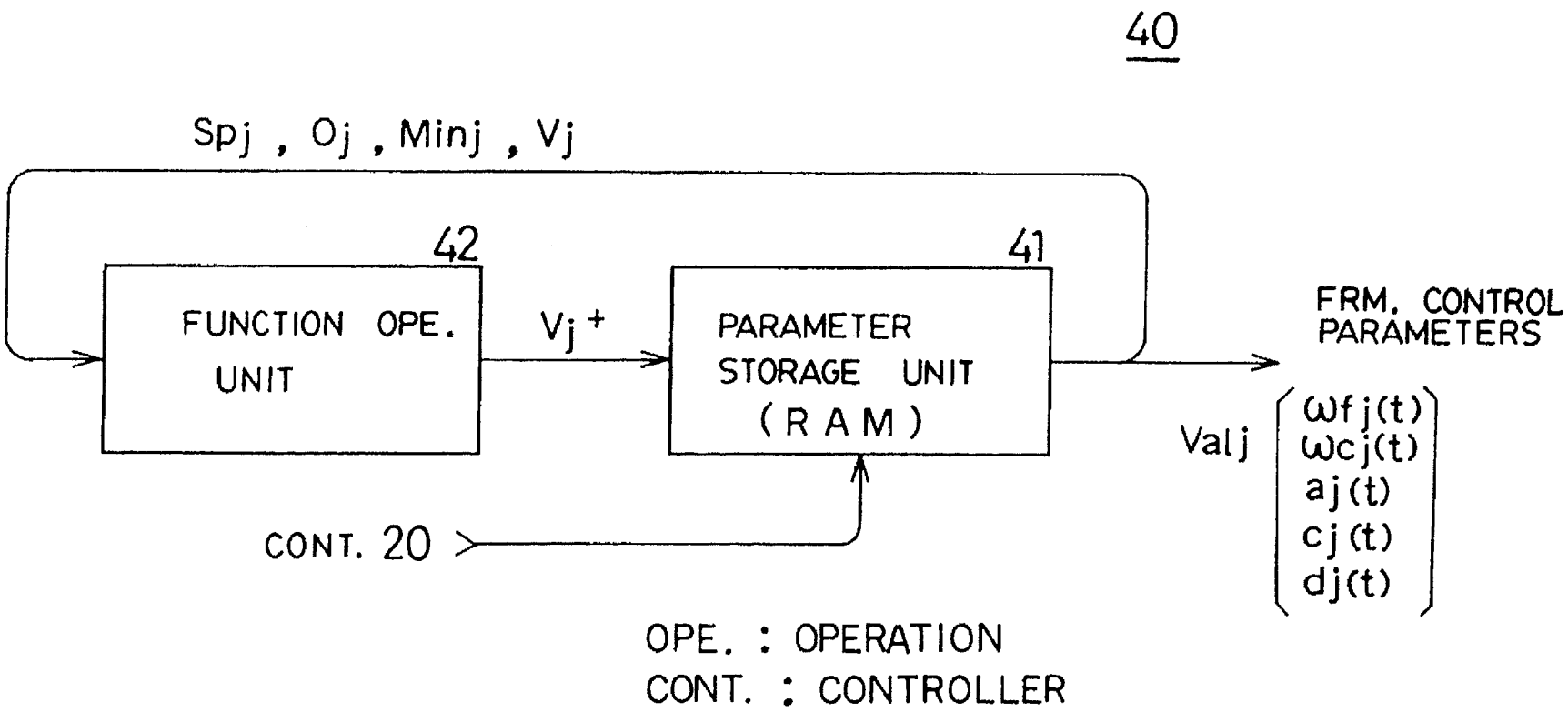
FIG. 5 is a circuit diagram showing a formant control parameter generator 40.

FIG. 5 shows the formant control parameter generator 40. Formant control parameters corresponding to the method of play as noted above, are written in the parameter storage 41 by the controller 20. Such formant control parameter are calculated (computed) and processed in the function operation unit 42, and the result is then written again in the parameter storage 41. In this way, the formant control parameters ωfj(t), ωaj(t), aj(t), cj(t) and dj(t) are updated.

Actually, there are provided five formant control parameter generators 40 for operation on the formant density parameter ωfj(t), formant carrier parameter ω cj(t), formant carrier level parameter aj(t), formant waveform bias parameter dj(t) and formant carrier bias parameter cj(t), respectively. Thus, the formant control parameters ωfj(t) , ωcj((t), aj(t), cj(t) and dj(t) can be generated as parallel data.

4. Parameter Storage 41

Figure 6:
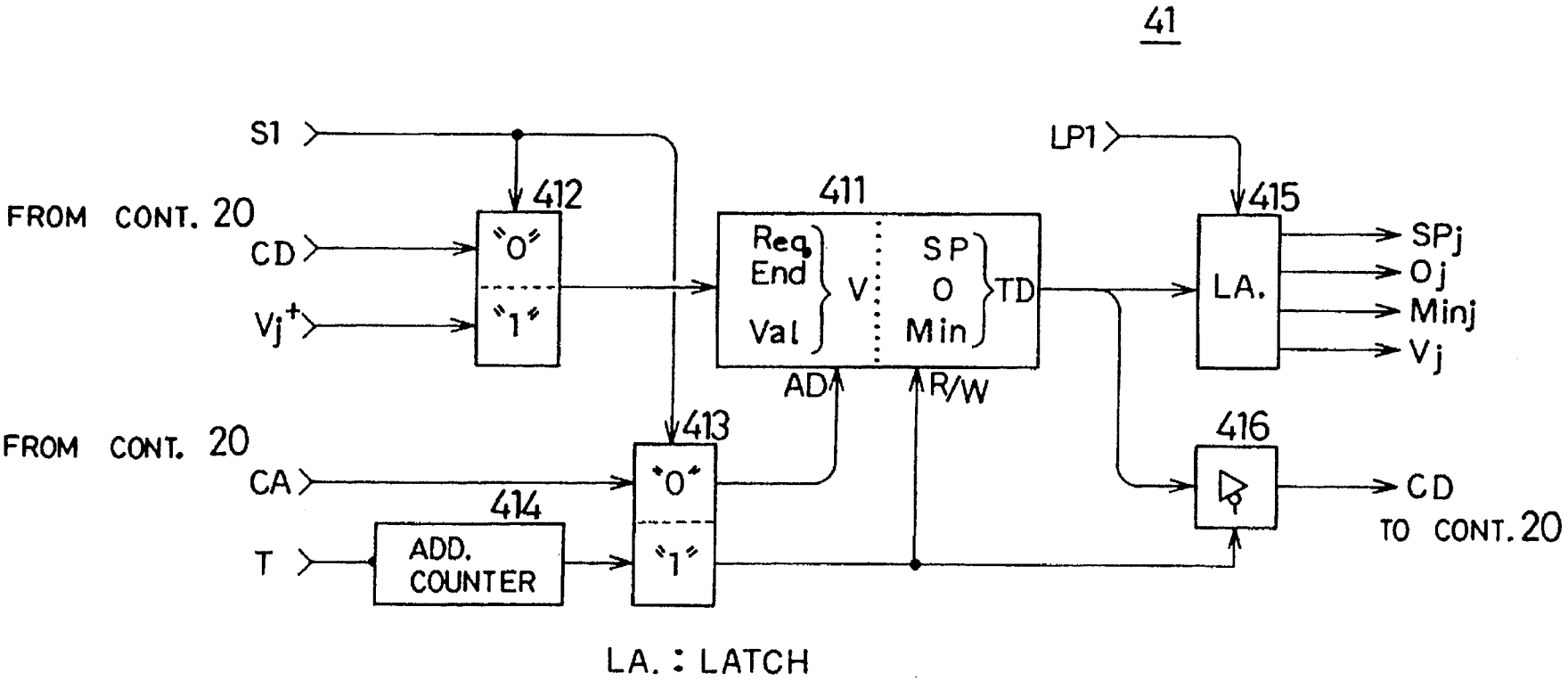
FIG. 6 is a circuit diagram showing a parameter storage 41.

FIG. 6 shows the parameter storage 41. Again there are provided five parameter storages 41 for the respective formant control parameters ωfj(t), ωcj(t), aj(t), cj(t) and dj(t). In the following description only one of the five parameter storages 41 and the formant control parameter Valj (Vj) will be explained.

Formant control parameter CD is fed from the controller 20 through a selector 412 to be written in a parameter memory 411. This writing is done, for instance, at the time of the start of sounding, i.e., at the time of the generation of an event signal for the sounding operation, or at the time of channel assignment to the musical tone to be sounded. This formant control parameter CD is written as formant control parameter TD, and the formant control parameter TD includes speed data SP, objective data O and mini data Min.

The speed data SP indicates the formant control parameter operation speed, i.e., operation step value. The objective data indicates the objective value of the operation. The mini data Min indicates a value which is to be subtracted from the objective data 0 to obtain data right before the objective data O. The controller 20 selects the speed data SP, objective data O and mini data Min according to the musical factor data indicative of the timbre, touch, tone pitch range, etc. input from the performance data generator 10, elapsed time from the start of sounding, envelope level, envelope phase, etc. to be described later, input data or select data by operator, etc.. These speed data SP, objective data O and mini data Min may be input from the performance data generator 10 by the operator.

Thus, the program/data storage 21 has a corresponding table between the musical factor data, elapsed time from the start of sounding, envelope level or envelope phase, and the speed data SP, objective data O, mini data Min, etc.. In this table, data is stored as multiple data corresponding to the musical factor. For example, the data SP, 0 and Min are stored for each of a plurality of timbres. Of these data, those for one timbre are stored for a plurality of musical instrument parts (tone pitch ranges). Of these data, those for one musical instrument part (tone pitch range) are stored for each touch. Of these data, those for one touch are stored for each elapsed time from the start of sounding, envelope level or envelope phase, and so forth.

Thus, the formant control parameters Valj (ω fj(t), ωcj(t), aj(t), cj(t) and dj(t)) are changed according to the musical factor data such as the timbre, touch, tone pitch range, etc., elapsed time from the start of sounding, envelope level, envelope phase or input data or select data by operator.

In this case, as for the musical factors the formant control parameter Valj, time count data, etc. which is changed according to the envelope data or elapsed time is synthesized by all kinds of calculations (1) will be described later in detail. It is possible to omit the storage of data for each elapsed time from the start of sounding or each envelope level, and instead modify for synthesis the elapsed time from the start of sounding of envelope level with respect to each of the data SP, O and Min. The modification synthesis is based on all kinds of calculations (1) will be described later in detail, and an operation (computation) device for the modification synthesis of the elapsed time from the sounding start or envelope level is provided at the output terminal of the parameter storage 41 or the output terminal of the function operation unit 42 shown in FIG. 5.

In the parameter memory 411 formant control parameter V is further stored. This formant control parameter V is obtained as a result of processing the formant control parameter TD in the function operation unit 42, and the formant control parameter V includes parameter value Val, request data Req and end data End.

The parameter value Val is a value of each formant control parameter as calculated in the above operation. The request data Req is to request the commencement of the next operation after the reaching of the objective value by the calculated value. The end data End indicates the end of all the operations with the parameter value Val brought to "0".

The above formant control parameters TD (SP, O and Min) and V are stored in sets corresponding in number to the number of the time division channels in the parameter memory 411. The j-th channel formant control parameters SPj, Oj, Minj and Vj are supplied via latch 415 to the function operation unit 42 for operation, and the results are written again as formant control parameters Vj+ in the parameter memory 411 via a selector 412.

The formant control parameters Req and End in the parameter memory 411 are supplied through a tri-state buffer 416 to the controller 20 for the request of formant control parameters TD (SP, O and Min) necessary for the next operation. Thus, the controller 20 counts the envelope phases for each musical tone. In this case, at the time of the channel assignment to a new musical tone, the envelope phase is cleared, and the request data Req is incremented by "+1" whenever it is supplied to the controller 20. According to such envelope phase, the controller 20 executes switching of various signals, data and parameters as described above or to be described later.

Address data and read/write signal R/W in the parameter memory 411 are supplied from the controller 20 through a selector 413 to the parameter memory 411 and also supplied from an address counter 414 through the selector 413 to the parameter memory 414. The read/write signal R/W is further supplied as a set signal to the tri-state buffer 416.

To the selectors 412 and 413 a select signal S1 is supplied to switch data to be selected. To the latch 415 a latch signal LP1 is supplied. The period of the latch signal LP1 is equal to the channel division time. The latch signal LP1, select signal S1 and count signal T of the address counter 414 are supplied from the timing generator 30.

5. Operation of Parameter Storage 41

Figures 7A, 7B, 7C:
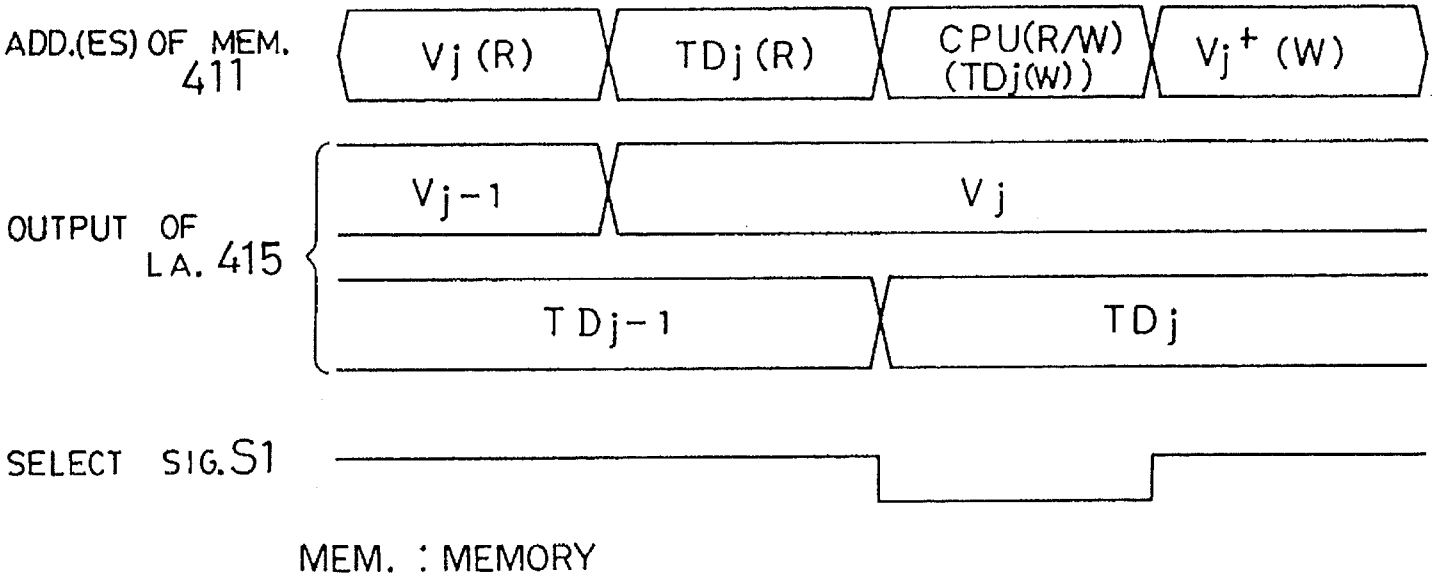
FIGS. 7A–7C are time charts concerning the parameter storage 41.

FIGS. 7A–7C are time charts illustrating the operation of the parameter storage 41. The reading of the j-th channel formant control parameter Vj, reading of the j-th channel formant control parameter TD, accessing of the controller 20 and writing of the formant control parameter Vjt+ after operation with respect to the j-th channel, are sequentially switched and repeated. Writing the formant control parameter TD is executed when accessing by the controller 20.

The output of the latch 415 is delayed by one step behind the read and write timings noted above, as shown in FIG. 7. The select signal S1 is at a low level when and only when accessing by the controller 20.

6. Function Operation Unit 42

Figure 8:
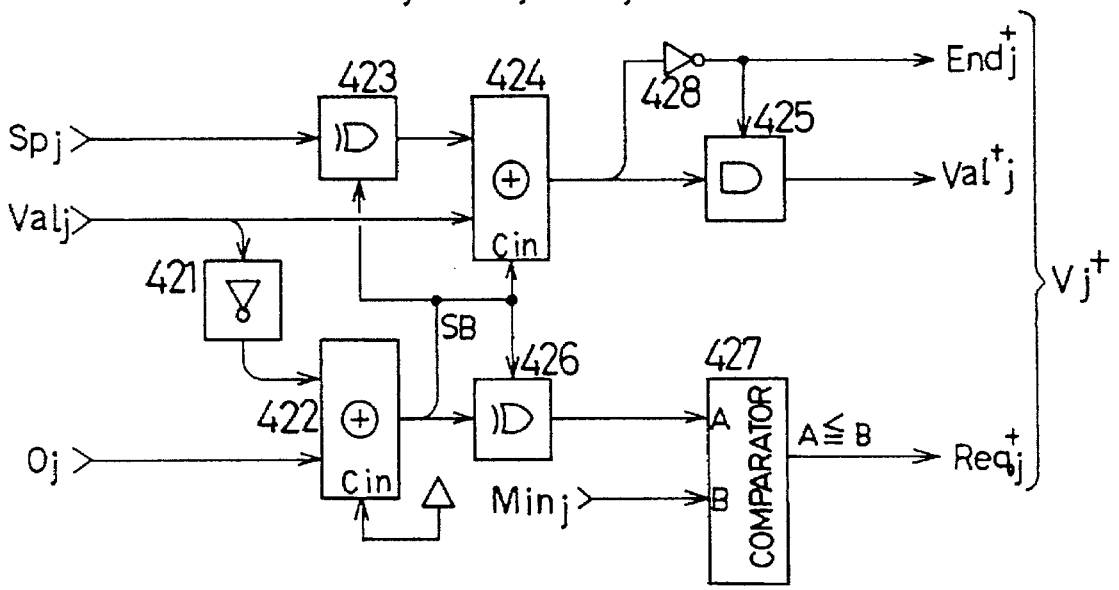
FIG. 8 is a circuit diagram showing a function operation unit 42 for performing linear operation.
Figure 9:
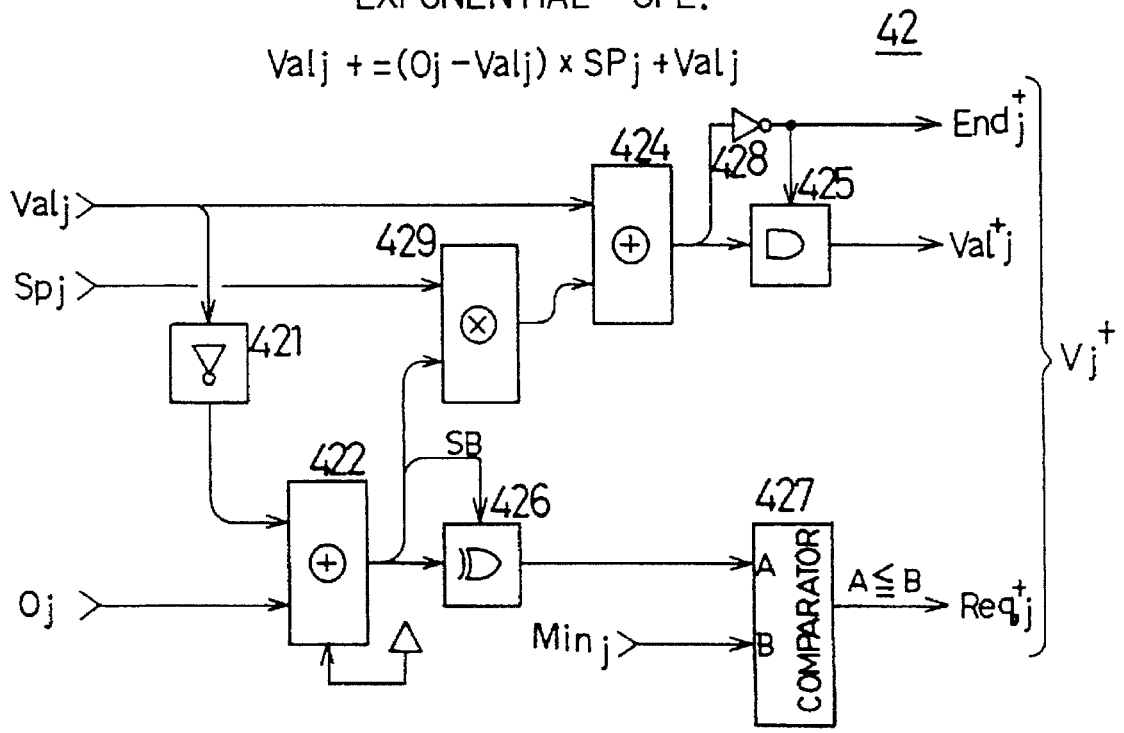
FIG. 9 is a circuit diagram showing a function operation unit 42 for performing exponential operation.

FIGS. 8 and 9 show examples of the function operation unit 42. The function operation unit 42 shown in FIG. 8 performs a linear operation, while the function operation unit 42 shown in FIG. 9 performs an exponential operation. An adder 424 adds the parameter value Valj and speed data SPj from an exclusive OR gate group 423, and its output is coupled through an AND gate group 425 to provide a new parameter value Valj+.

The parameter value Valj is sign inverted in an inverter group 421 before being added to the objective data Oj in an adder 422, and the sum output thereof is incremented by "+1". Thus, the parameter data Valj is subtracted from the objective data Oj. The sign bit SB of the subtraction data is supplied to the exclusive OR gate group 423 and also supplied as "+1" increment signal to the adder 424. Thus, when the objective data Oj is less than the parameter value Valj, the speed data SPj is sign inverted, and the speed data SPj is subtracted from the parameter value Valj.

The subtracted (difference) data from the adder 422 is supplied through an exclusive OR gate group 426 to a comparator 427. To the exclusive OR gate group 426 is also supplied the sign bit SB, and when the subtracted (difference) data has a negative value, it is inverted to the positive value. Thus, the exclusive OR gate group 426 provides the absolute value |Oj - Valj| of the difference between the parameter value Valj and the objective value Oj.

This absolute difference |Oj - Valj| is compared in a comparator 427 to the mini data Minj. When the absolute difference |Oj - Valj| becomes less than the mini data Mini, a comparative signal is provided as the request data Req+. The sign bit SB of the parameter value Valj from the adder 424 is inverted in an inverter 428 to be output as the end data Endj+. This end data Endj+ is inverted to a high level when and only when the parameter value Valj becomes negative with the end of the operation. The end data Endj+ is supplied to an AND gate group 425 to make the parameter value Valj+ to be "0". The above operation is expressed as $$Valj+=Valj\pm SPj$$

In the function operation unit 42 shown in FIG. 9 for the exponential operation, difference data (Oj-Valj between) between the parameter value Valj and the objective data Oj is obtained through inverter group 421 and adder 422. The difference data is multiplied in a multiplier 429 by the speed data SPj. The product data is added in an adder 424 to the parameter value Valj, and the sum is coupled through an AND gate group 425 to be provided as the parameter value Valj+. The remainder of the operation is the same as in the function operation unit 42 shown in FIG. 8. The above operation is expressed as $$Valj+=(Oj-Valj)\times SPj+Valj$$

The formant control parameters TD (i.e., speed data SP, objective data O and mini data Min), request data Req and end data End, are used for operations concerning the envelope levels of the attack, decay, sustain and release phases of the envelope waveform or operation concerning the elapsed time from the start till the end of sounding.

In this case, the formant control parameter aj(t) to be described later, which is obtained as a result of the above operation, represents the envelope level, and the formant control parameter cj(t) or dj(t) represents the elapsed time from the start of sounding. If the speed data SP is large or if the objective data O is small, the data obtained as the result of the operation can be used as representing the envelope level. On the other hand, if the speed data SP is small or if the objective data O is large, the operation result data can be used as representing the elapsed data from the start of sounding. Such data representing the envelope level or the elapsed time from the start of sounding, are supplied to the controller 20 to switch various signals, data and parameters as described above or to be described later.

The operation result data constitute the formant control parameters Valj (ωfj(t), ωcj(t), aj(t), cj(t) and dj(t)). Alternatively, it is possible to fix only values of the parameters ωfj(t) and ωcj(t). Further, it is possible to also fix value of the parameters aj(t), cj(t) and dj(t) or set these parameters to the same value. By so doing, it is possible to provide only a single function operation unit 42 or dispense with some of the function operation units 42. Further, it is possible to vary the parameters ω fj(t) and ω cj(t) for frequency modulation or vary the density of the frequency components of the formant of the formant waveform signal Ffj(t) according to the envelope or the elapsed time from the start of sounding.

The operation in the function operation unit 42 may be replaced with an operation using a digital signal processor, an operation circuit, etc. on the basis of a certain operation formula. Further, in place of the above operation, it is possible that calculated parameter values Val are stored in and successively read out from the memory. In this case, it is possible to use fluctuations (wavering, swings, sways) data FL from a fluctuation data memory 321 or frequency or amplitude modulation data FM1 to FM3, SFM, AM1 to AM3 or SAM described in specification U.S. patent application Ser. No. 08/172,146 (japan Patent Application Ser. No. 04-230136 and 04-346063) as the parameter values Val.

Further, it is possible to replace the circuits shown in FIGS. 8 and 9 with, for instance, a time counter for the operation concerning the formant control parameters Valj (ωfj(t), ωcj(t), aj(t), cj(t) and dj(t)). Such time counter is reset and caused to start counting under control of a sounding operation event signal or a signal produced at the time of the channel assignment to a musical tone to be sounded. The time counter counts the elapsed time from the start of sounding on a time division basis, i.e., for each channel.

Further, cumulative formant density parameter Σω fj(t) or cumulative formant carrier parameter Σω cj(t) represents the read address for the formant waveform signal Ffj(t) or formant carrier signal cosω ct. The number of times of repeated reading of such signal and also the value of the cumulative parameter Σω fj(t) or Σ ω cj(t) (read address) indicate the elapsed time from the start of sounding, and the value may be used as the elapsed time from the start of sounding. Particularly, the value is effective in case where the formant waveform signal Ffj(t) or the formant carrier signal cosω ct is stored for a plurality of periods from the rising (attack) or for all the periods from the start till the end of sounding. Such data indicative of the elapsed time from the start of sounding is supplied to the controller 20 to switch various signals, data and parameters as described above or to be described later.

The circuits shown in FIGS. 8 and 9 may both be provided in the musical tone generation apparatus for switching according to the musical factors, envelope phase, envelope level, elapsed time from the start of sounding or input data or select data by operator. As the data for the switching is used some or all of the musical factors from the performance data generator 10 or the parameters Valj (ωfj(t), ωcj(t), aj(t), cj(t) and dj(t)) .

7. Formant Waveform Generator 50

Figure 10:
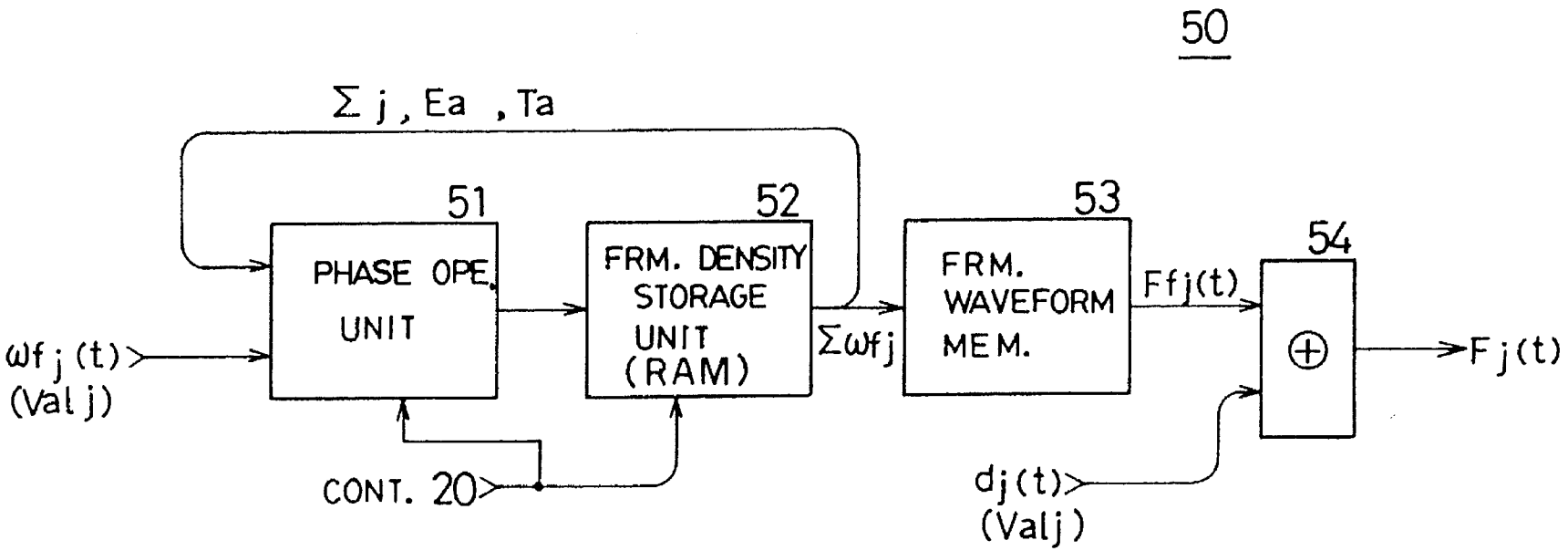
FIG. 10 is a circuit diagram showing a formant waveform generator 50.

FIG. 10 shows the formant waveform generator 50. The formant density parameter ω fj(t) as one of the calculated parameter values Valj noted above is processed in a phase operation unit 51 before being stored in a formant density storage unit 52. This formant density parameter ω fj(t) is stored for all the channels. When stored in the formant density storage unit 52, the formant density parameter ω fj(t) is read out for each channel to be supplied to a formant waveform memory 53 and also fed back to a phase operation unit 51 for accumulation. The start value for the accumulation, i.e., repeat top data Ta, is supplied from the controller 20.

The formant waveform signal Ffj(t) is stored in a large number in the formant waveform memory 53. That is, it is stored for each touch data, each tone pitch range data, timbre data, each elapsed time from the start of sounding, each envelope level, each envelope phase, etc.

It is also possible to store the formant waveform data Ffj(t) in the formant waveform memory 53 for each of other musical factor data, for instance each effect data, each rhythm data, each stereo data, each modulation data, each performance part data, each musical tone or sound part data, each musical instrument part data, etc. That is, the formant waveform data Ffj(t) are stored as multiple data corresponding to the musical factor. For example, each formant waveform signal Ffj(t) is stored for each of a plurality of different timbres, each timbre formant waveform signal Ffj(t) is stored for each musical instrument part (tone pitch range), each musical instrument part (tone pitch range) formant waveform signal Ffj(t) is stored for each touch, each touch formant waveform signal Ffj(t) is stored for each elapsed time from the start of sounding, each envelope level or each envelope phase, and so forth.

The each formant waveform signal Ffj(t) are selected according to the repeat top data Ta from controller 20, and the repeat top data Ta are selected according to the musical factors, for example, timbres, touch, tone pitch (tone pitch range), etc., envelope phase, envelope level, elapsed time from the start of sounding or input data or select data by operator input from the performance data generator 10. The formant waveform signal Ffj(t) are also input from the performance data generator 10 by operator.

In this case, the formant control parameter Valj or the time count data which is changed according to the envelope data or elapsed time is synthesized to the musical factors by all kinds of calculations (1) will be described later in detail.

It is possible to omit the storage of data for the each elapsed time from the start of sounding or each envelope level, and instead modify for synthesis the elapsed time from the start of sounding of envelope level with respect to the formant waveform signal Ffj(t). The modification synthesis is based on all kinds of calculations (1) will be described later in detail, and an operation (computation) device for the modification synthesis of the elapsed time from the sounding start or envelope level is provided at the output terminal of the formant waveform memory 53 shown in FIG. 10.

Accordingly, the program/data storage 21 includes a table relating the musical factor data, repeat top data Ta, repeat end data Ea, etc. to one another. In this table, data is stored as multiple data corresponding to the musical factors. For example, each of the data Ta and Ea is stored for each of a plurality of different timbres, the data for each timbre is stored for each musical instrument part (tone pitch range), the data for each musical instrument part (tone pitch range) is stored for each touch, the data for each touch is stored for each elapsed time from the sounding start, each envelope level or each envelope phase, and so forth.

The each of the data Ta and Ea are selected according to the repeat top data Ta from controller 20, and the repeat top data Ta are selected according to the musical factors, for example, timbres, touch, tone pitch (tone pitch range), etc., envelope phase, envelope level, elapsed time from the start of sounding or input data or select data by operator input from the performance data generator 10. The each of the data Ta and Ea are also input from the performance data generator 10 by operator.

In this case, the formant control parameter Valj or the time count data which is changed according to the envelope data or elapsed time is synthesized to the musical factors by all kinds of calculations (1) will be described later in detail.

It is possible to omit the storage of data for the each elapsed time from the start of sounding or each envelope level, and instead modify for synthesis the elapsed time from the start of sounding of envelope level with respect to each of the repeat top data Ta and repeat end data Ea. The modification synthesis is based on all kinds of calculations (1) will be described later in detail, and an operation (computation) device for the modification synthesis of the elapsed time from the sounding start or envelope level is provided between the output terminal of the formant density storage unit 52 and the input terminal of the phase operation unit 51 shown in FIG. 10.

As noted before, there are various forms of formant of the formant waveform signal Ff(t), such as half triangular, pot-like, triangular, rectangular, half circular, hill-like, two-hill-like, etc., and also there are composite formants obtained by combining a plurality of like formants with or without overlap.

The formant waveform signal Ffj(t) which is read out on a time division basis from the formant waveform memory 53, is fed to an adder 54 for bias provision, i.e., addition of the formant waveform bias parameter dj(t), and the result is fed as formant waveform signal Fj(t) to the formant waveform generator 60. The bias provision, instead of the addition bias, may be the multiplification of the formant waveform signal Ffj(t) by the formant waveform bias parameter dj(t) or both the multiplification and addition or all kinds of calculations (1) will be described later in detail.

The formant density parameter ω fj(t) for the each musical tone may be supplied directly from the controller 20. This transfer of parameter ω fj(t) from the controller 20 is made according to the musical factor data input from the performance data generator 10, such as the timbre, touch, tone pitch range, etc., the elapsed time from the sounding start, the envelope level, envelope phase or input data or select data by operator. To this end, the program/data storage 21 includes a table relating the musical factor data, etc. to the formant density parameter ω fj(t). The formant density parameter ω fj(t) are also input from the performance data generator 10 by operator.

Thus the density of frequency components of the formant of the formant waveform signal Ffj(t), and the formant position thereof of the formant waveform signal Ffj(t) on the frequency axis from the formant carrier signal, are changed according to the musical factor data such as the timbre, touch, tone pitch range, etc., the elapsed time from the sounding start, envelope level, envelope phase or input data or select data by operator etc.. In this case, each parameter is stored as multiple data corresponding to the musical factors same as the data SP, O, Min, Ta, Ea, or the formant waveform signal Ffj(t).

In this case, as for the musical factors the formant control parameter Valj or the time count data which is changed according to the envelope data or elapsed time is synthesized by all kinds of calculations (1) will be described later in detail.

It is possible to omit the storage of data for the each elapsed time from the sounding start or each envelope level and, instead, modify for synthesis the elapsed time from the sounding start of envelope level with respect to the formant density parameter ω fj(t). The modification synthesis is based on all kinds of calculations (1) will be described later in detail, and an operation (calculation) device for the modification synthesis of the elapsed time from the sounding start or envelope level is provided at the input terminal of an exclusive OR gate group 512 shown in FIG. 13.

8. Formant Density Storage unit 52

Figure 11:
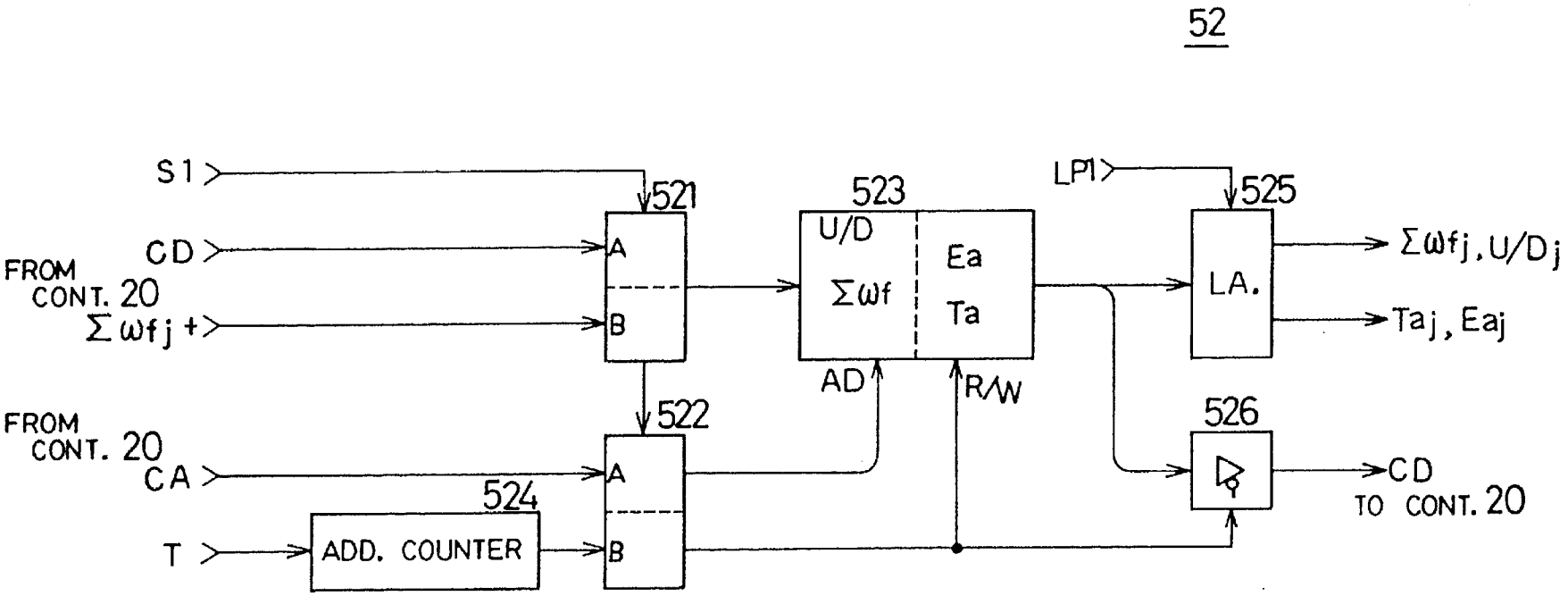
FIG. 11 is a circuit diagram showing a formant density storage 52.

FIG. 11 shows the formant density storage unit 52. This formant density storage unit 52 has substantially the same structure as the parameter storage 41 noted above. Formant control parameter CD from the controller 20 is coupled through a selector 521 to be written in a formant density memory 523. This parameter is written at the time of, for instance, the generation of event signal for sounding operation or the channel assignment to a musical tone to be sounded.

The formant control parameter CD consists of the repeat top data Ta, the repeat end data Ea and an up/down flag U/D. The repeat top data Ta and the repeat end data Ea indicate the first and last addresses, respectively, of an area of the formant waveform memory 53 in which the formant waveform signal Ffj(T) to be read out is stored. The up/down flag U/D indicates that the accumulation of the formant density parameter fj(t) is addition or subtraction.

The formant density parameter ω fj(t) which has been accumulated in the phase operation unit 51, i.e., cumulative formant density parameter Σω fj(t), is coupled through a selector 521 to be written in a formant density memory 523. The cumulative formant density parameter T. Σ ωfj(t) and formant control parameters Ta and Ea and U/D are stored in the formant density memory 523 in a number corresponding to the number of time division channels. The j-th channel cumulative formant density parameter Σωfj(t) and formant control parameters Taj, Eaj and U/Dj are fed through a latch 525 to the phase operation unit 51 and also fed through a tri-state buffer 526 to the controller 20 for such purposes as requesting formant control parameter CD necessary for the next operation.

Address data CA and read/write signal R/W are supplied from the formant density memory 523 through the controller 20 and selector 522 to the formant density memory 523 and also supplied through an address counter 524 and the selector 522 to the formant density memory 523. The read/write signal R/W is further supplied as set signal to the tri-state buffer 526.

A select signal S1 is supplied to the selectors 521 and 522 to switch data to be selected. A latch signal LP1 is supplied to the latch 525. The cycle period of the latch signal LP1 is equal to the channel division time. The latch signal LP1, select signal S1 and count signal T of the address counter 524 are supplied from the timing generator 30.

9. Operation of Formant Density Storage 52

Figures 12A, 12B, 12C:
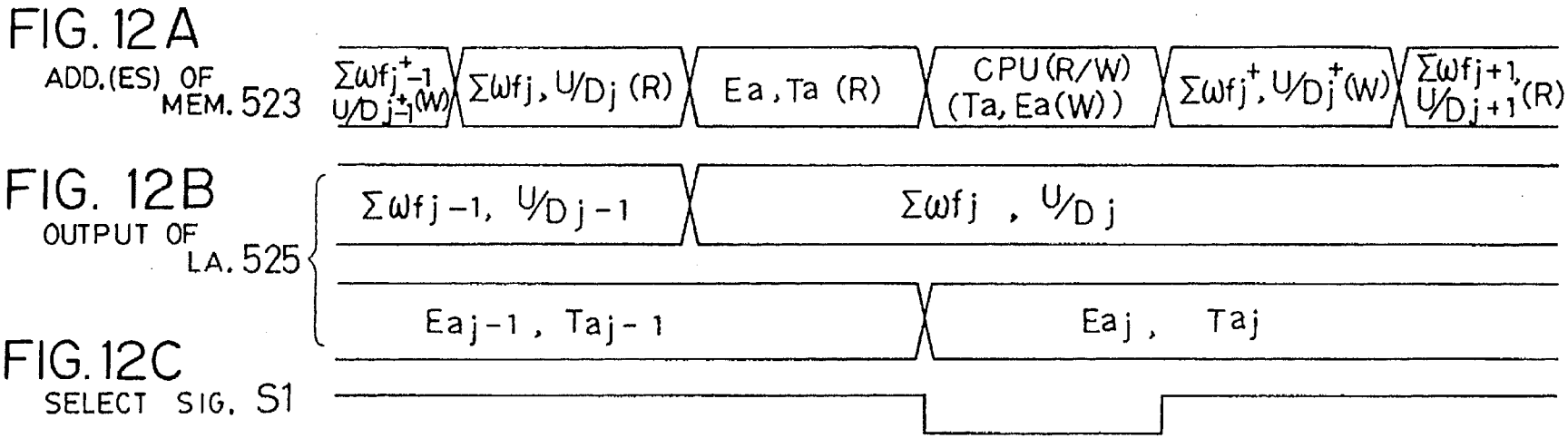
FIGS. 12A–12C are time charts concerning the formant density storage 52.

FIGS. 12A–12C are time charts illustrating the operation of the formant density storage unit 52. The reading of the j-th channel cumulative formant density parameter Σω fj(t) and up/down flag U/D, reading of the j-th channel repeat top data Taj and repeat end data Eaj, accessing of the controller 20, and writing of the cumulative formant density parameter Σω fj(t)+ and up/down flag U/Dj+ after the accumulation for the j-th channel, are executed repeatedly by sequential switching. The repeat top data Taj and repeat end data Eaj are written in the timing of accessing by the controller 20.

The output of the latch 525 is delayed by one step behind the above read and write timings, and thus it is as shown in FIG. 12. The select signal S1 is at a low level when and only when the controller 20 accesses.

10. Phase Operation Unit 51

Figure 13:
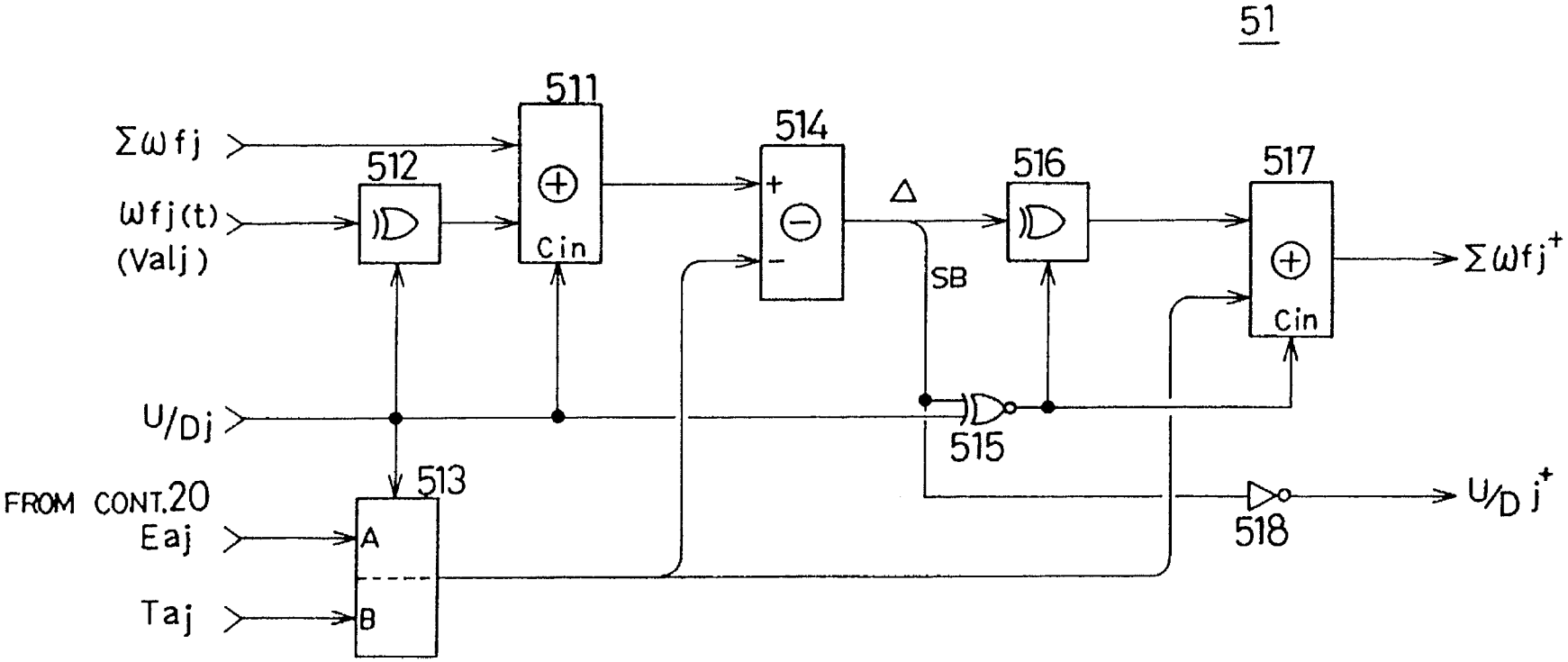
FIG. 13 is a circuit diagram showing a phase operation unit 51.

FIG. 13 shows the phase operation unit 51. The formant density parameter ω fj(t) from the formant control parameter generator 40 is coupled through an exclusive OR gate group 512 to an adder 511 for addition, i.e., accumulation, to the cumulative formant density parameter Σω fj(t) from the formant density storage unit 52. A subtracter 514 obtains difference data, i.e., arrival difference data Δ j, between the sum output of the adder 511 and repeat top data Taj or repeat end data Eaj. The arrival difference data Δ j is coupled through an exclusive OR gate group 516 to an adder 517 to be added to the repeat top data Taj or repeat end data Eaj, thus producing cumulative formant density parameter Σω fj(t)+ after accumulation which is fed to the formant density storage unit 52.

The up/down flag U/Dj from the formant density storage unit 52 is supplied to the exclusive OR gate group 512. When the accumulation of the formant density parameter ω fj(t) is subtraction, the formant density parameter ω fj(t) is sign inverted. A selector 513 selectively provides either of the repeat top data Taj and repeat end Eaj from the formant density storage unit 52 to the subtracter 514 and adder 517. The up/down flag U/Dj is supplied as select signal to the selector 513, which thus selects the repeat end data Eaj when the accumulation of the formant density parameter ω fj(t) is addition and selects the repeat top data Taj when the accumulation of the formant density parameter ω fj(t) is subtraction.

The up/down flag U/Dj is input to an exclusive NOR gate 515, to which the sign bit SB of the arrival difference data a Δ j from the subtracter 514 is also input. Thus, the exclusive NOR gate 515 can detect that the cumulative formant density parameter Σωfj(t) has exceeded the repeat top data Taj or repeat end data Eaj as a result of the accumulation. The detection signal from the exclusive NOR gate 515 is fed to the exclusive OR gate group 516 for sign inversion of the value of the arrival difference data Δ j. The sign bit SB of the arrival difference data Δ j is fed through an inverter 518 as up/down flag U/Dj to the formant density storage unit 52. It is possible as well that when the cumulative formant density parameter Σω fj(t) become more than the repeat end data Eaj, the cumulative formant density parameter Σω fj(t) is not subtracted but the parameter Σωfj(t) jump to the repeat top data Taj and the addition may be repeated.

Each formant waveform signal Ffj(t) is stored in the formant waveform memory 53 for one period or a plurality of periods. As the plurality of periods of the formant waveform signal Ffj(t), a plurality of periods of a rising (attack) portion and a plurality of periods of a portion subsequent to the rising are stored. The rising portion is read once, while the portion subsequent to the rising is read repeatedly. Alternatively, the whole waveform from the start till the end of sounding is stored and read out once.

In this case, the repeat top data Taj and repeat end data Eaj indicate the top and end of the portion that is repeatedly read out. The initial data Iaj indicate the top of the rising (attack) that is read out in sounding start. Thus, initial data Iaj is also stored in the formant density memory 523.

The initial data Iaj is determined by the controller 20 as one of the formant control parameters CD. Like the repeat top data Taj and repeat end data Eaj, it is determined according to the musical factor data, elapsed time from the sounding start, envelope level, envelope phase or input data or select data by operator etc., and it is written in the formant density memory 523. It is read out from the formant density memory 523 to be fed through the latch 525 to the formant waveform memory 53 and also fed to the phase operation unit 51.

In the phase operation unit 51, the initial data Iaj is output through a selector (not shown) as cumulative formant density parameter Σω fj(t)+. In the selector, the cumulative formant density parameter Σω fj(t)+ as the output of the adder 517 and the initial data Iaj are selected. To the selector, a key-on event signal is supplied as selection switching signal. At the time of sounding operation event signal generation or at the time of channel assignment to a musical tone to be sounded, the initial data Iaj is output as cumulative formant density parameter Σω fj(t)+ for successive accumulation.

This parameter Σω fj(t) (initial data Iaj) is written again through a selector 521 in the formant density storage unit 52 in the formant density memory 523. Subsequently, the cumulative formant density parameter Σω fj(t) is successively accumulated from the initial data Iaj toward the repeat end data Eaj, and further accumulation from the repeat top data Taj to the repeat end data Eaj is repeated.

11. Operation of Phase Operation Unit 51

Figure 14:
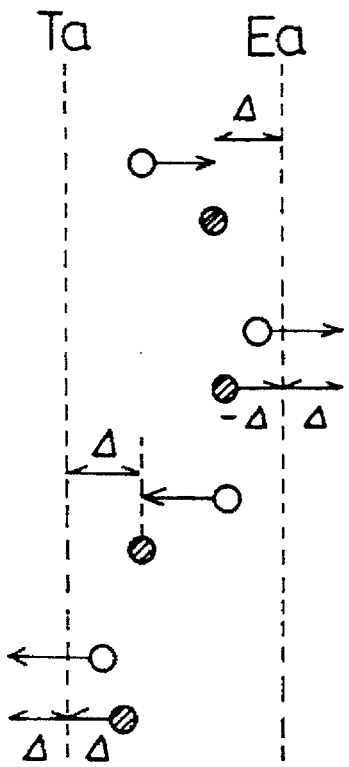
FIG. 14 is a view illustrating the operation of the phase operation unit 51.

FIG. 14 shows the relation between the operation in the phase operation unit 51 to accumulate the formant density parameter ω fj(t) and the repeat top and end data Ta and Ea. When the up/down flag U/D is indicative of addition and the sign bit of the arrival difference data Δ j is negative, the output of the exclusive NOR gate 515 is at a low level, and the cumulative formant density parameter Σω fj(t)+ the formant density parameter ω fj(t) becomes to the repeat end data Ea+arrival difference data Δj.

When the up/down flag U/D is indicative of addition and the sign bit of the arrival difference data Δj is positive, the output of the exclusive NOR gate 515 is at a high level, and the cumulative formant density parameter Σωfj(t)+the formant density parameter ω fj(t) becomes to the repeat end data Ea—the arrival difference data Δ j. Thus, fold-back correction is made when the repeat end data Ea is exceeded by the cumulative formant density parameter Σω fj(t).

When the up/down flag U/D is indicative of addition and the sign bit of the arrival difference data Δ j is positive, the output of the exclusive NOR gate 515 is at a low level, and the cumulative formant density parameter Σω fj(t)+the formant density parameter ω fj(t) becomes to the repeat top data Ta+the arrival difference data Δj.

When the up/down flag U/D is indicative of subtraction and the sign bit of the arrival difference data Δ j is negative, the output of the exclusive NOR gate 515 is at a high level, and the cumulative formant density parameter Σω fj(t)+the formant density parameter Σω fj(t) becomes to the repeat top data Ta—the arrival difference data Δ j. Thus, fold-back correction is made when the repeat top data Ta is exceeded by the cumulative formant density parameter Σω fj(t).

12. Formant Waveform Generator 60

Figure 15:
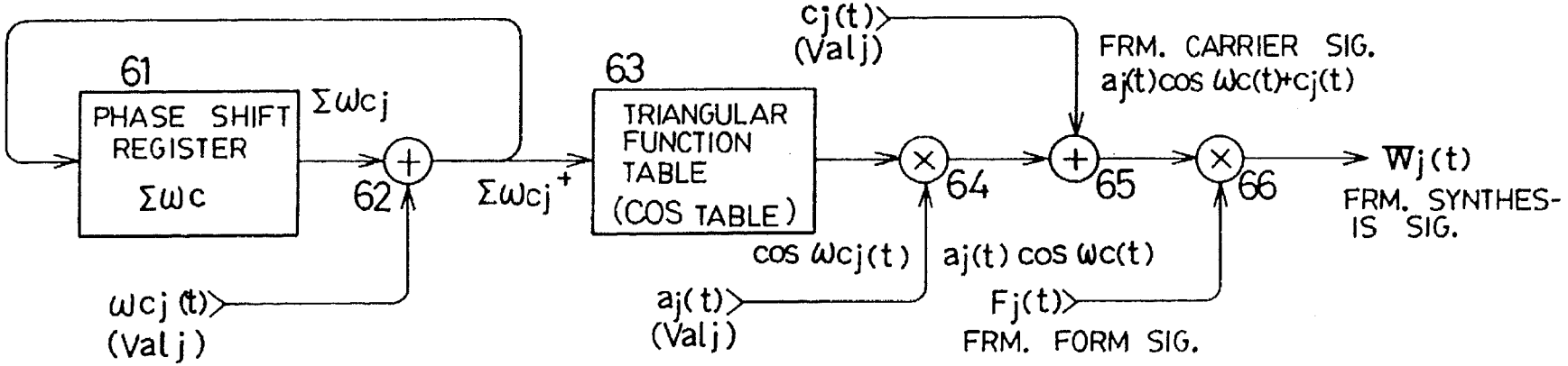
FIG. 15 is a circuit diagram showing a formant waveform generator 60.

FIG. 15 shows the formant waveform generator 60. Formant carrier parameter ω cj(t) is fed from the formant control parameter generator 40 to an adder 62 to be accumulated to cumulative formant carrier parameter Σωcj(t) from a phase shift register 61, and the output of the adder 62 is set again in the phase shift register 61. The phase shift register 61 has shift areas corresponding in number to the cumulative formant carrier parameters Σω cj(t) of all the channels. The all channel cumulative formant carrier parameters Σω cj(t) are thus stored and shifted successively to be output. The cumulative formant carrier parameter Σω cj(t) is supplied as read address data to a triangular function table (cos table) 63. In the triangular function table 63 cos waveform data are stored. These cos waveform data cosω cj(t) are read out on a time division basis as formant carrier signal Gj(t).

The formant carrier signal cosω cj(t) is multiplied in a multiplier 64 by the formant carrier level parameter aj(t) for such purposes as envelope control. The output of the multiplier 64 is fed to an adder 65 for adding the formant carrier bias parameter cj(t) to it. The output of the adder 65 is in turn fed to a further multiplier 66 to be multiplied by the formant waveform signal Fj(t). In this way, formant synthesis signal Wj(t) is obtained through the synthesis of the formant waveform signal Fj(t) on the formant carrier signal, and it is output to the accumulator 70. In this way, the formant waveform signal Fj(t) is synthesized on the formant carrier signal cosω cj(t) as formant center signal (fundamental wave).

The frequency of the formant carrier signal Gj(t) and the frequency of the formant waveform signal Fj(t) (Ffj(t)), can be selected independently to generate various different kinds of musical tones. The frequency of the formant carrier signal Gj(t) is determined by a designated tone pitch and also by various frequency data concerning formants, other frequency data, frequency modulation data, etc. The frequency of the formant waveform signal Fj(t) (formant waveform signal Ffj(t)), is determined by the musical factor data, such as the timbre, touch, tone pitch range, etc., elapsed time from the sounding start, envelope level, envelope phase or input data or select data by operator.

It is possible as well to generate the formant carrier signal cos ω cj(t) using a digital signal processor, an operation circuit, etc. for executing an operation based on an operation formula. Further, it is possible to store in the cos table 63, instead of the cos waveform data, sin waves, triangular waves, trapezoid waves, rectangle waves, sawtooth waves and other complex waveform data containing harmonic components.

Further, it is possible to supply the formant waveform signal Fj(t) in lieu of the cumulative formant carrier parameter Σω cj(t) to the triangular function table 63. As a further alternative, it is possible to supply to the triangular function table 63 a signal obtained by adding or multiplying the formant waveform signal Fj(t) to or by the cumulative formant carrier parameter Σω cj(t). The synthesis of data from the formant waveform signal Fj(t), formant carrier Gj(t) and cosω cj(t) may be based on all kinds of calculations (1) will be described later in detail. It is thus possible to make the synthesis of the formant waveform signal Fj(t) on the formant carrier signal Gj(t) and cosω cj(t) complicated to permit generation of various musical tones.

The formant carrier parameter ω cj(t) may be fed directly to the controller 20. The transfer of data from the controller 20 is made according to the performance data such as tone pitch data input from the performance data generator 10. The program/data storage 21 has a table (frequency number memory) relating the tone pitch data, etc. to the formant carrier parameter ω cj(t). In this case, the formant carrier parameter ω cj(t) corresponds to the first formant at the lowest frequency among a plurality of formants of a musical tone, but it may correspond to the second formant, the third formant, etc. as well.

Further, the transfer of the formant carrier parameter ω cj(t) from the controller 20 is made according to the musical factor data from the performance data generator 10 such as the timbre, touch, tone pitch range, etc., the elapsed time from the sounding start, envelope level, envelope phase, input data or select data by operator, etc. The program/data storage 21 has a table relating the musical factor data, etc. to the formant carrier parameter ω cj(t). The formant carrier parameter ω cj(t) are also input from the performance data generator 10 by operator.

Thus, the frequency of the formant carrier signal Gj(t) is changed according to the musical factor data such as the timbre, touch, tone pitch range, etc., the elapsed time from the sounding start, envelope level or envelope phase, input data or select data by operator, etc. In this case, the formant carrier parameter ω cj(t) is stored as multiple data corresponding to the musical factors same as the data SP, O, Min, Ta, Ea, the formant waveform signal Ffj(t) or the formant density parameter Σωfj(t).

In this case, as for the musical factors the formant control parameter Valj or the time count data which is changed according to the envelope data or elapsed time is synthesized by all kinds of calculations (1) will be described later in detail.

It is possible to omit the storage of data for the each elapsed time from the sounding start or envelope level, and instead, modify for synthesis the elapsed time from the sounding start or envelope level with respect to each formant carrier parameter ωcj(t). The modification synthesis is based on all kinds of calculations (1) will be described later in detail, and an operation (calculation) device for the modification synthesis of the elapsed time or envelope level is provided at the input terminal of an adder 62 shown in FIG. 15.

In this case, the formant carrier signal ω cj(t) corresponds to the second formant, third formant, etc. other than the first formant at the lowest frequency among a plurality of formants of one musical tone, but it may correspond to the first formant as well. The value of the formant carrier parameter ω cj(t) corresponding to the second formant, third formant, etc. is comparative data with respect to "1" which is the value of the formant carrier parameter ω cj(t) corresponding to the first formant, for instance "1.2", "1.5", "1.8", "2.0", "3.5", "4.9", etc. This comparative data is multiplied on the tone pitch data (frequency number data) of the first formant to obtain actual calculated formant carrier parameter ω cj(t).

The formant carrier signal Gfj(t), cosω cj(t) and formant waveform signal Ffj(t) corresponding to the first formant, the second formant, the third formant, . . . according to one musical sound of one operating sound start generate on a time division basis for each channel. In this case, a plurality of the formant carrier signal Gfj(t), cosω cj(t) and formant waveform signal Ffj(t) corresponding to each formants of one sound are all different or same in part.

The formant carrier signal {aj(t)×cosω cj(t)+cj(t)}, i.e., the formant center signal, may or may not be in accord with the formant peak center signal corresponding to the formant waveform signal Ffj(t)+dj(t). What is to be considered is a case when the formant carrier signal level is lower than the formant peak level. In the example shown in FIG. 4, with formant carrier signal level reduction a single formant peak at the center is changed to two peaks on the opposite sides of the center. In this case, the character of musical tone, such as the timbre, is also changed. This can be attained by adequately selecting the values of the formant control parameters aj(t), cj(t) and dj(t). Consequently, the character of musical tone can be changed according to the musical factor data, envelope data, data of the elapsed time from the sounding start, etc.

Instead of synthesizing the formant waveform signal Ffj(t) on the formant carrier signal cosω cj(t) by multiplification, it is possible to let the formant waveform signal Ffj(t) be output directly as musical tone by making the formant density parameter ω fj(t) to correspond to a designated tone pitch.

13. Accumulator 70

Figure 16:
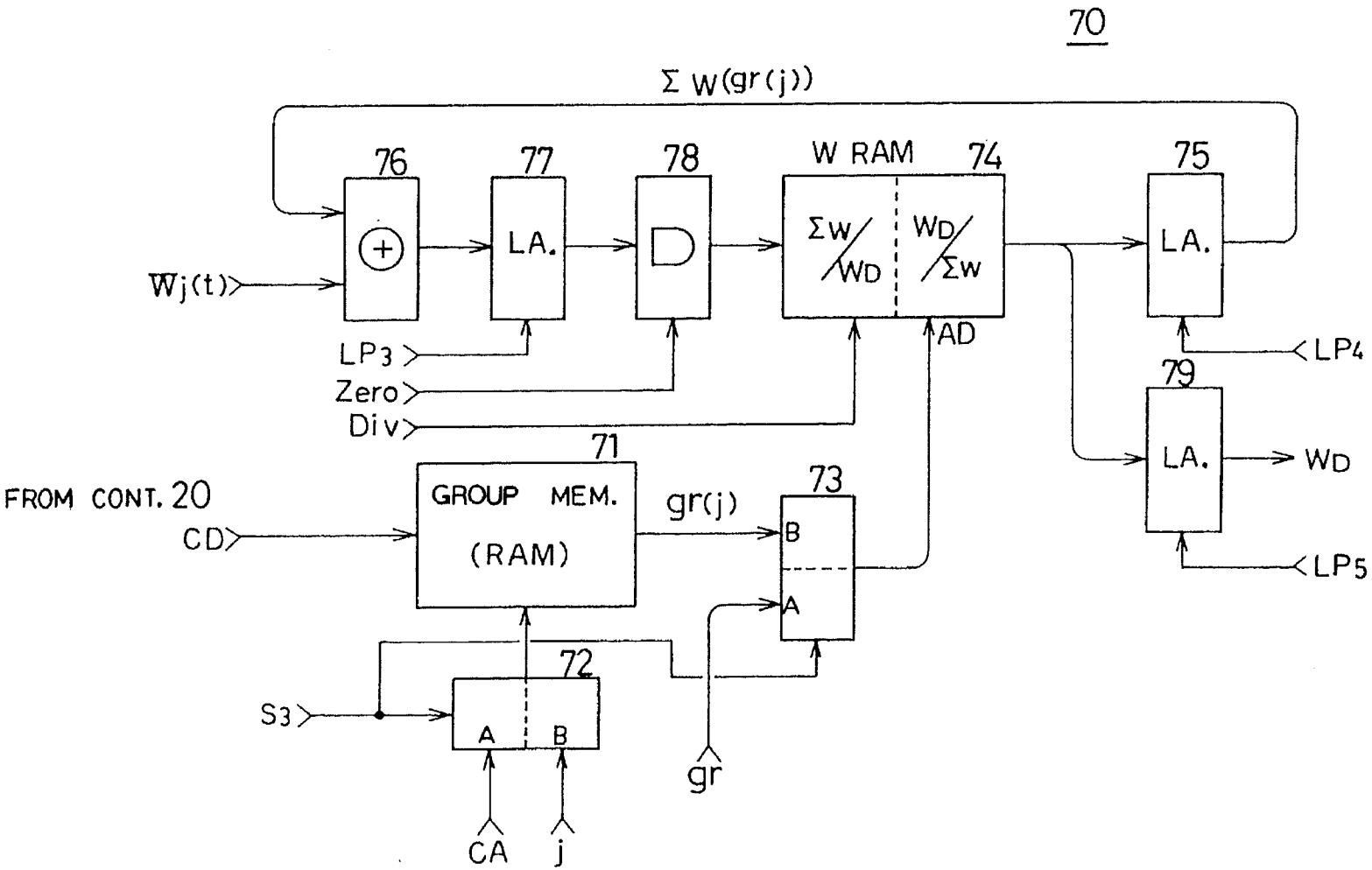
FIG. 16 is a circuit diagram showing an accumulator 70.

FIG. 16 shows the accumulator 70. Formant synthesis signal Wj(t) from the formant waveform generator 60 is fed to an adder 76 to be accumulated to cumulative formant synthesis signal Σ W(gr(j)) from a latch 75. The output of the adder 76 is fed through a latch 77 and an AND gate group 78 to be written in an accumulation memory 74. The accumulation memory 74 has two storage areas which are switched for writing and reading of data. The two storage areas of the accumulation memory 74 are divided for groups. The formant synthesis signal Wj(t) is accumulated for each group.

Cumulative formant synthesis signal Σ W(gr(j)) in the area in which data is being written, is successively accumulated for each group channel to be fed to the latch 75. Cumulative formant synthesis signal Σ W(gr(j)) in the area from which data is being read out is data after the end of accumulation for each group channel, and is fed through a latch 79 to the sound output unit 80.

The groups noted above each correspond to the musical factor data (or elapsed time from the sounding start, envelope level or envelope phase) or each sound of each channel formant synthesis signal Wj(t). Accumulation synthesis of the formant synthesis signal Wj(t) is made for each group. This processes for each group is carried out on a like division basis. This means that group channels are formed, which are different from the aforementioned channels to be assigned to musical tones. The musical factors that are corresponded by the groups are the timbre, touch, tone pitch range, stereo, etc. as noted above. As for the timbre, there may be a percussion instrument group and a strings/keyboard instrument group. As for the tone pitch range, there may be a high and a low tone pitch range. As for the stereo, they may be a left and a right stereo. The each group corresponding to the each sound noted a plurality of formants in one sound of one operating sound generation.

Latch signals LP3 to LP5 are supplied to the respective latches 77, 75 and 79. A zero signal Zero which is inverted to a low level for each channel time is provided on the AND gate group 78 to clear cumulative formant synthesis signal Σ W(gr(j)) which has been output. A division switching signal Div is supplied to the accumulation memory 74 to switch the writing and reading of the cumulative formant synthesis signal Σ W(gr(j)).

In a group memory 71, group data gr of musical tone to which each channel is assigned, i.e., the formant synthesis signal Wj(t), is stored for each channel. Thus, the group memory 71 has storage areas corresponding to all the channels. If there are two different groups, the group data gr can assume values of "0" and "1". If there are four different groups, it can assume values of "00", "01", "10" and "11". The group data gr(j) for each channel is supplied successively as address data through a selector 73 to the accumulation memory 74. Further, group data gr from the sound output unit 80 or controller 20 is supplied as address data through the selector 73 to the accumulation memory 74.

The address data supplied from the controller 20 to the group memory 71 or time division channel number data j from a channel counter (not shown) in the timing generator 30, is supplied through a selector 72 to the group memory 71. Select signal S3 is supplied to the selectors 72 and 73 to switch the data to be selected. The select signal S3, the zero signal Zero and division switching signal Div are supplied from the timing generator 30.

14. Operation of Accumulator 70

FIGS. 17A–17C are time charts illustrating the operation of the accumulator 70. The reading of cumulative formant synthesis signal Σ W(gr(j)) for accumulation, reading of cumulative formant synthesis signal Σ W(gr(j)) after accumulation, writing of the cumulative formant synthesis signal Σ W(gr(j)) after the accumulation, and clearing of the cumulative formant synthesis signal Σ W(gr(j)) after the accumulation, are repeated sequentially for each group. The zero signal Zero is inverted to a low level when the cumulative formant synthesis signal Σ W(gr(j)) after the accumulation is cleared.

When a cycle of accumulation for all the channels is completed, the division switching signal Div is switched from a signal shown by solid line in FIG. 17 to a signal shown by a dashed line. Thus, the two storage areas of the group memory 71 are switched, that is, the writing and reading are interchanged. The outputs of the latches 79 and 75 are each delayed by one step as the timing is shown in FIG. 17.

15. Parameter of Formant Center Signal (Formant Carrier)

FIG. 18 shows a harmonic wave memory 211 in the program/data storage unit 21. The harmonic wave memory 211 is storing a plurality of sets (k=1 to k=n) of formant carrier parameters ωcjk(t) (frequency of component waveforms), formant carrier level parameters ajk(t) (amplitude coefficient of component waveforms), and formant carrier bias parameters cj(t) (direct current component of synthesized waveform).

The n sets of parameters ω cjk(t), ajk(t) and cj(t) are stored for each of the musical factors, lapse of times from the start of sounding, envelope levels and/or envelope phases. The musical factors include the above-mentioned timbre, touch, tone pitch range, etc. The storage for each of the musical factors is being multiplexed like the storage of the aforementioned data SP, O, Min, Ta, Ea, formant waveform signals Ffj(t), formant density parameters ω fj(t) and formant carrier parameters ω cj(t).

The parameters ω cjk(t), ajk(t) and cj(t) for each of the musical factors are selected based (depending) upon the musical factor data input from the aforementioned performance (play) data (information) generator 10, lapse of time(s) from the start of sounding, envelope levels, envelope phases and/or instructions by the operator. The parameters ω cjk(t), ajk(t) and cj(t) are input by the operator through the performance data generator 10.

In this case, the musical factors can be synthesized with the above-mentioned formant control parameters Valj and time count data that vary depending upon the envelope information (data) or upon the lapse of time in compliance with various operations (1) that will be described later.

Here, the storage based on the lapse of time from the start of sounding or on the envelope level may be omitted, and, instead, the lapse of time from the start of sounding or the envelope level may be modification-synthesized for each of the parameters ω cjk(t), ajk(t) and cj(t). The modification-synthesis is based upon a variety of operations (1) that will be described later, and an operation unit for modification-synthesizing the elapsed time of sounding or the envelope level is provided at the input terminals of the shift registers 601 . . ., 601 . . ., 603 . . . in FIG. 19.

These parameters ω cjk(t), ajk(t) and cj(t) can be selected and switched depending upon the envelope or the lapse of time from the start of sounding. The data for effecting the selection and switching will be part or whole of the parameters Valj (ω fj(t), ω cj(t), aj(t), cj(t), dj(t)) from the function operation unit 42.

The above-mentioned plural sets of formant carrier parameters ω cjk(t), formant carrier level parameters ajk(t) and formant carrier bias parameters cj(t) are for forming a formant carrier signal. A formant carrier signal is formed by addition-synthesizing or accumulation-synthesizing a plurality of sine waves or cosine waves having different frequencies, i.e., component waveforms.

The formant carrier parameters ω cjk(t) determine the speed of reading the cosine waves, i.e., frequency (frequency number). The formant carrier level parameters ajk(t) determine the level (amplitude coefficient) of cosine waves, i.e., weighing. The formant carrier bias parameters cj(t) determine the direct current component, i.e., bias of the formant carrier signal formed by synthesizing the cosine waves, and are stored in a number of only one in each of the sets. The formant carrier bias parameters cj(t) can be stored in a plurality of numbers (k=1 to k=n) per a musical factor.

Parameters ω cjk(t), ajk(t), cj(t) of n sets of from "k=1" to "k=n" are stored in the harmonic wave memory 211 wherein the formant carrier level parameter ajk(t) of k=1 is larger than other formant carrier level parameters ajk(t) and k=1 represents a first harmonic wave, i.e., a fundamental wave. However, a formant carrier level parameter ajk(t) of other than k-1 may be regarded to have the greatest value, the component wave corresponding to the formant carrier level parameter ajk(t) of other than k=1 may be regarded to be a fundamental wave, and subharmonic components may be stored in addition to harmonic components.

The formant carrier parameter ω cjk(t) does not represent a value of frequency number but represents a ratio or a difference of the fundamental wave relative to the frequency number. For instance, if the value the formant carrier parameter ω cjk(t) of the fundamental wave is "1" then the other formant carrier parameters ω cjk(t) will have values of "2" "3" "4" "5" "0.5" "0.25", "0.125", . . . This means that the frequencies of the harmonic components or subharmonic components have a relation of integral ratios with respect to the frequency of the fundamental wave.

They, however, may have non-integral ratios such as "1.1", "1.2""1.3". . . "2.1", "2.2", "2.3". . . "1.01", "1.02", "1.03", "0.9", "0.8", "0.7". . . "0.4", "0.3", "0.2", "0.99", "0.98", "0.97". . . , When the formant carrier parameters ω cjk(t) have differences from the formant carrier parameter ω cjk(t) of the fundamental wave, the formant carrier parameters ω cjk(t) will be, for example, "+0.01", "+0.02", "+0.03" . . . , "+0.11", "+0.12" , "+0.13" "–0.01", "–0.02", "–0.03" . . . "–0.11", "–0.12", "0.13". . . .

Tone pitch information (data) or frequency number data input through the performance data generator 10 relying upon the formant carrier parameters ω cjk(t) are subjected to the multiplication or division depending upon the ratio, subjected to the addition or subtraction depending upon the difference, or are subjected to a variety of operations (1) that will be described later, and are sent to the formant waveform generator 60 that will be described later. If the formant carrier parameter ω cjk(t) representing a ratio or a difference relative to the frequency number of the fundamental wave undergoes a change depending upon the musical factors and the like, then, the frequencies of the component waves or the ratios of the frequencies undergo a change resulting in a change in the density of frequency components of the synthesized signals.

16. Formant Waveform Generator 60

Figure 19:
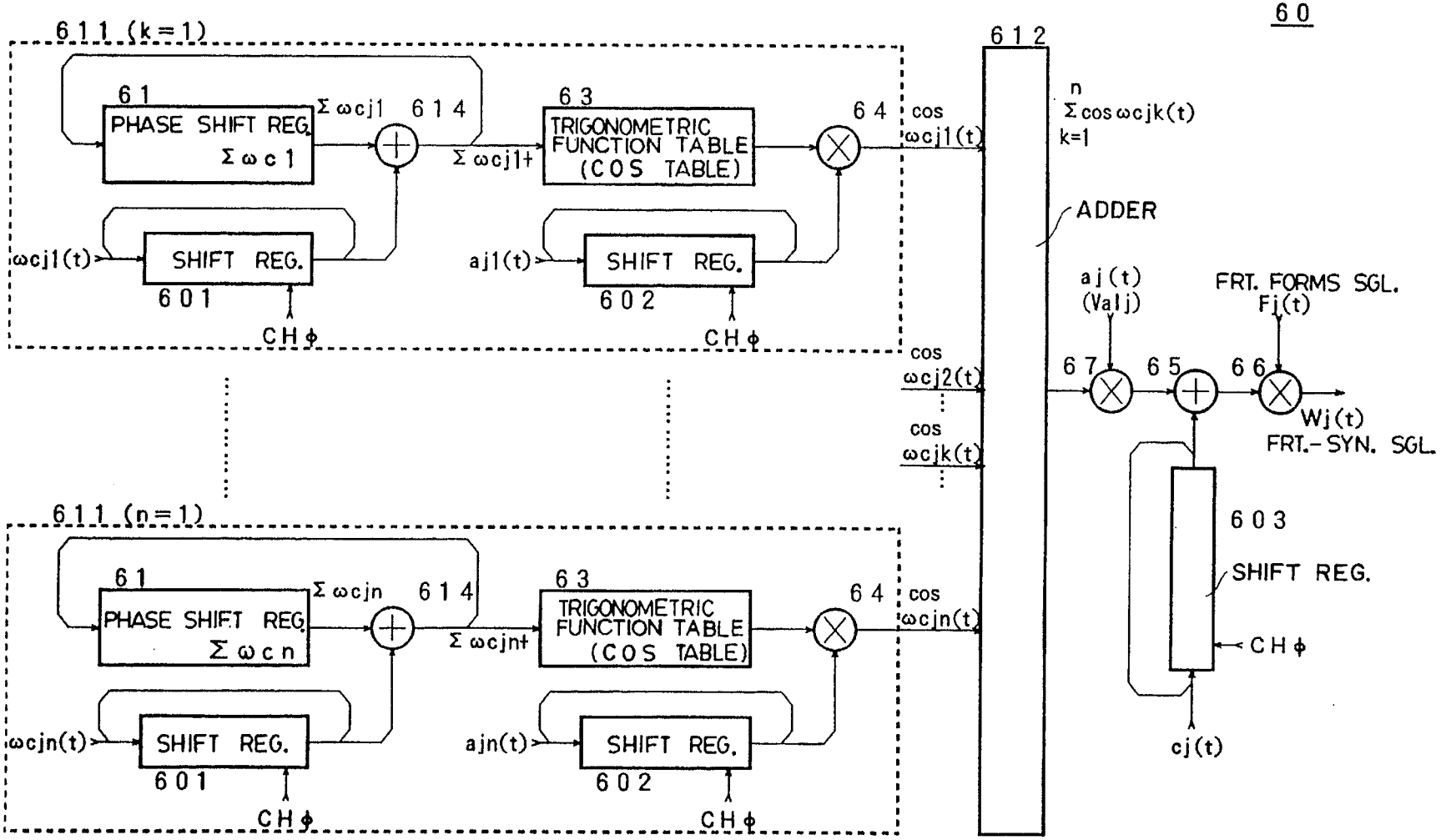
FIG. 19 is a diagram showing the formant waveform generator 60 according to a second embodiment.

FIG. 19 illustrates the formant waveform generator 60 according to another embodiment. The harmonic wave generators 611 generate cosine waves corresponding to a component waveform of a formant carrier signal, i.e., corresponding to harmonic waves or subharmonic waves, which are addition-synthesized through an adder 612 and are output in the form of a formant carrier signal.

The parameters ω cjk(t), ajk(t) and cj(t) corresponding to musical factors read out from the harmonic wave memory 211 by the controller 20, are stored in the shift registers 601 . . . , 602 . . . , and 603 . . . . The shift registers 601 . . . , 602 . . . and 603 . . . have shift areas corresponding to the number of channels, and the above-mentioned parameters are stored in the divisional times of the channels to which is assigned musical tone that is synthesized by the formant waveform generator 60. The parameters ω cjk(t), cjk(t) and cj(t) of the channels are output being sequentially shifted. In this case, the formant carrier parameters ω cjk(t) that are stored are values that are converted and operated into the frequency numbers.

The formant carrier parameters ω cjk(t) from the shift registers 601 . . . are accumulated in the adders 614 . . . upon the accumulated formant carrier parameters Σω cjk(t) sent from the phase shift registers 61 . . ., and are stored again in the phase shift registers 61 . . . The phase shift registers 61 . . . have shift areas corresponding to the number of channels such as j=1 to j=32, store accumulated formant carrier parameters Σω cjk(t) of all channels, and output them sequentially.

The accumulated formant carrier parameters Σω cjk(t) are fed as read-out address data to the trigonometric function tables 63 . . . . The trigonometric function tables 63 . . . are storing waveform data of cosine waves; (i.e.,) the waveform data cos ω cjk(t) of cosine waves are read out in a time-divisional manner as a component waveform of a formant carrier signal Gj(t).

The component waveform of the formant carrier signal Gj(t) in the multipliers 64 . . . multiplies the formant carrier level parameters ajk(t) from the shift registers 602 and is envelope-controlled, and is further addition-synthesized in the adder 612 with other component waveforms controlled by envelope from other harmonic wave generator 611, and the formant waveform signal Fj(t) is multiplication-synthesized in the multiplier 66 for each of the channels. The synthesized formant carrier signal Gj(t) is multiplied and is envelope-controlled at the multiplier 67 by the formant carrier level parameter aj(t) from the formant control parameter generator 40, and is added at the adder 65 with a formant carrier bias parameter c; (t) from the shift register 603, i.e., added with a direct current component.

Thus, the formant carrier signal Gj(t) synthesized with the formant waveform signal Fj(t) acquires a waveform that contains harmonic components. In particular, values of the formant carrier parameters ω cjk(t), formant carrier level parameters ajk(t) and formant carrier bias parameters cj(t) stored in the harmonics memory 211 can be arbitrarily set or can be selectively switched in various ways, whereby the composition of harmonic components or subharmonic components is changed and, hence, the content (composition), frequency and/or a density of frequency components of a formant of component waveforms of the formant carrier signal Gj(t) is changed enabling the waveform of the formant carrier signal Gj(t) to be switched and selected in various ways.

In particular, the formant carrier parameter ω cjk(t) is representing a ratio or a difference with respect to the frequency number of the fundamental wave of the formant carrier signal Gj(t). Therefore, if the formant carrier parameter ω cjk(t) changes depending upon the musical factors and the like, the frequencies of component waveforms or ratios of the frequencies undergo a change resulting in a change in the density of the frequency components of the formant carrier signal Gj(t). In this case, if some of the formant carrier level parameters ajk(t) are set to "0", then, the number or range of the component waveforms of the formant carrier signal Gj(t) can be changed.

Furthermore, a formant-synthesized signal Wj(t) obtained by synthesizing the formant carrier signal Gj(t) and the formant waveform signal Fj(t) together, is output to the accumulator 70. The formant carrier signal Gj(t) is synthesized as a formant center signal (fundamental wave) with the formant waveform signal Fj(t).

Here, a plural (k=1 to k=n) of formant carrier bias parameters cj(t) may be stored in the shift registers and may be fed to the adder provided before or after the multipliers 64 . . . . Moreover, the adder 65 may be a multiplier where the formant carrier bias parameter cj(t) may be multiplied.

Figure 20:
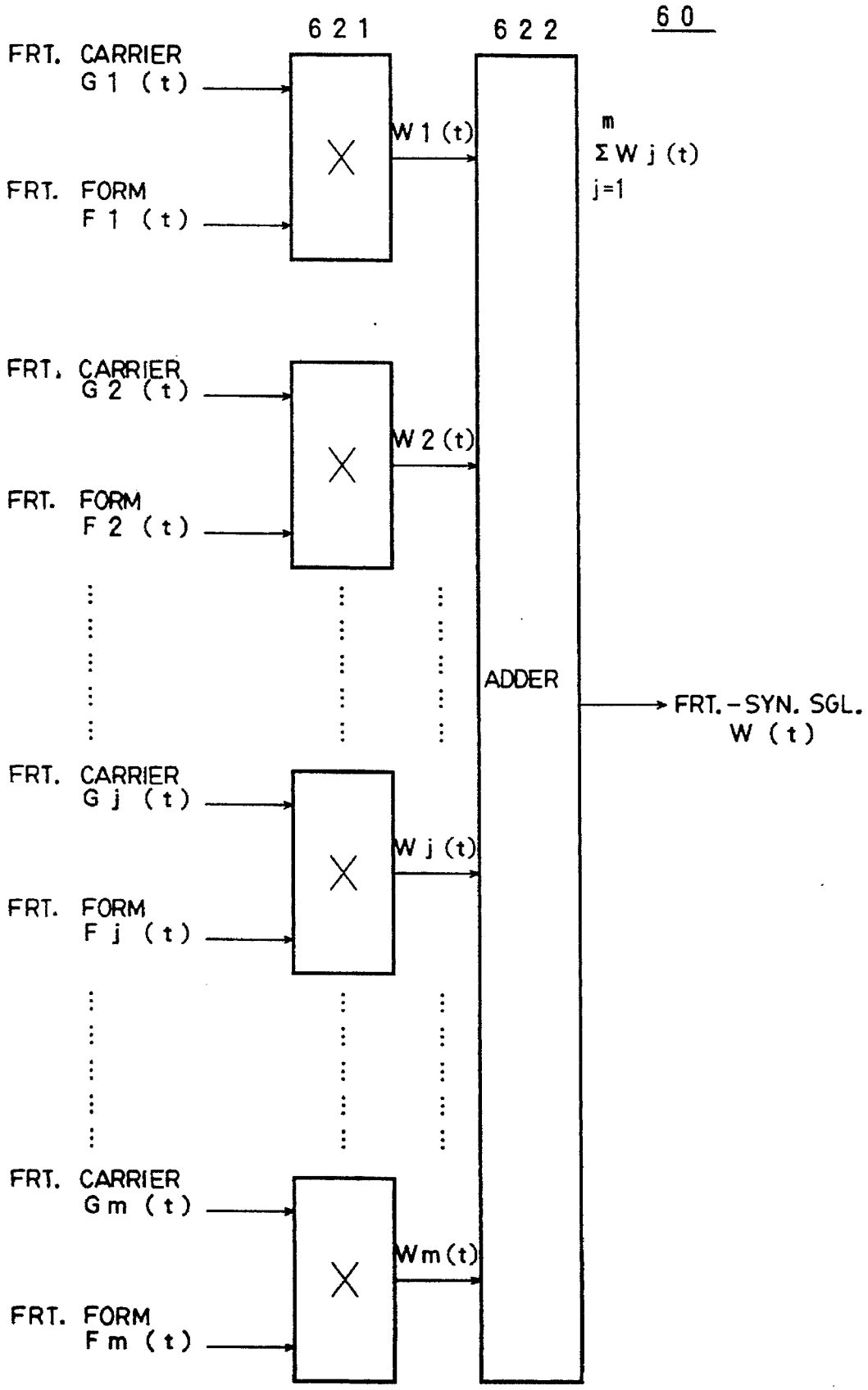
FIG. 20 is a diagram showing the formant waveform generator 60 according to a third embodiment.

The formant carrier signal Gj(t) and the formant waveform signal Fj(t) can also be synthesized together in a circuit shown in FIG. 20. In this case, the formant carrier signal Gj(t) and the formant waveform signal Fj(t) of each of the channels are simultaneously generated in parallel, multiplication-synthesized through the multipliers 621 . . . , addition-synthesized through the adder 622 and are output. In this case, the formant waveform generators 60 shown in FIG. 15 or 19 and the formant form waveform generators 50 shown in FIG. 10 are provided in a number corresponding to the number of channels.

Furthermore, the multiplication by the formant carrier level parameter ajk(t) at the multiplier 64 may be the addition of formant carrier level parameter ajk(t), may be the division when the parameter is not larger than "1", may be the subtraction when the parameter has a minus value, or may be a variety of operations (1) that will be described later, or the multiplication by the parameter ajk(t) may be omitted.

The content of operation may be varied depending upon the musical factors, lapse of time from the start of sounding, envelope level, envelope phase and/or instruction of setting by the operator. For example, the above-mentioned operation will be a multiplication when the touch is small, tone pitch range is small, timbre is complex, envelope is small and lapse of time from the start of sounding is small. The operation will be a bit shift when the touch is large, tone pitch range is large, timbre is simple, envelope is large and lapse of time from the start of sounding is large. In this case, the operation units are provided in a plural number depending upon the operations, and the data input to the operation units are switched depending upon the musical factors and the like.

The harmonic wave generators 611 can be used in a reduced number or in a number of one by effecting the high-speed time-divisional processing. In this case, the numbers of shift registers 601 . . . , 602 . . . , and phase shift registers 61 will be "(number of channels)×(degree of harmonics)", the number of the shift registers 603 is a (degree of harmonics), and the adder 65 is an accumulator.

As described above, the frequency of the formant carrier signals Gj(t) and the frequency of the formant waveform signals Fj(t) (formant waveform signals Ffj(t)) can be selected independently of each other, making it possible to produce a variety of musical tones. The frequency of formant carrier signals Gj(t) is determined depending upon a variety of frequency information (data) related to formant, other frequency information (data) and frequency modulation information (data) in addition to a specified tone pitch, and the frequency of the formant waveform signals Fj(t) (formant waveform signals Ffj(t)) is determined depending upon the above-mentioned musical factors such as timbre, touch, tone pitch, etc.

The formant carrier signals Gj(t) or the component waveforms cos ω cjk(t) may be produced by the operation based upon the arithmetic operation executed by a digital signal processor or an operation circuit. The trigonometric function table 63 may store waveform data of a complex shape containing sine wave, chopping wave, rectangular wave or any other harmonic components instead of the waveform data of cosine wave.

Furthermore, the formant waveform signals Fj(t) may be fed, instead of the accumulated formant carrier parameters Σω cjk(t), to the trigonometric function table 63. Besides, the accumulated formant carrier parameters Σω cjk(t) may be added with or multiplied by the formant waveform signals Fj(t) and may, then, be fed to the trigonometric function table 63. The formant waveform signals Fj(t) and the formant carrier signals Gj(t) may be synthesized together by the above-mentioned multiplication or by various operations (1) that will be described later. This permits the formant waveform signals Fj(t) and the formant carrier signals cos ω cjk(t) to be synthesized together in a complex manner, making it possible to realize a variety of musical tones.

The formant carrier signals {aj(t)×Gj(t)+cj(t)} or the formant center signals, usually, may or may not be in agreement with a center signal at a peak point of formant corresponding to the formant waveform signals {Ffj(t)+dj (t)}. This may, for instance, be the case where the level of the formant carrier signal Gj(t) is lower than the level at a peak point of formant. In the case of FIG. 4, the peak point of formant changes into two points on both sides of the center from a central point as the level of the formant carrier signal Gj(t) decreases. This is accompanied by a change in the quality of tone such as timbre. This is accomplished by suitably selecting the values of the formant control parameters ajk(t), cj(t) and dj(t). As a result, the quality of tone changes depending upon the musical factors, lapse of time (s) from the start of sounding, envelope levels and/or envelope phases.

It is also allowable that the formant waveform signals Ffj(t) are not multiplication-synthesized with the formant carrier signals Gj(t), the formant density parameters ω fj(t) are the ones determined by a specified tone pitch, and the formant waveform signals Ffj(t) are directly output as musical tones. Furthermore, the whole or part of the formant carrier parameters ω cjk(t) stored in the harmonic wave memory 211 can be omitted. In this case, the tone pitch data, i.e., frequency number data input through the performance data generator 10 are bit-shifted into 2 times, 4 times, 8 times . . ., ½ times, ¼ times, ⅛ times . . ., and are sent to the shift registers 601 . . . where harmonic wave components and subharmonic wave components are formed.

The formant carrier parameters ω cjk(t), formant carrier level parameters ajk(t) and formant carrier bias parameters cj(t) can be changed depending upon the lapse of times from the start of sounding like the aforementioned formant control parameters Valj (ω fj(t), ωcj(t), aj(t), cj(t), dj(t)) .

In this case, the parameters ω cjk(t), ajk(t), cj(t) are read out by the controller 20 from the harmonic wave memory 211, sent to the formant control parameter generator 40, operated into values corresponding to the lapse of time from the start of sounding (e.g., subjected to various operations (1) that will be mentioned later), and are sent to the formant waveform generator 60 shown in FIG. 19. Thus, the formant carrier parameter ω cjk(t) (frequency of component waveform), formant carrier level parameter ajk(t) (amplitude coefficient of component waveform), formant carrier bias parameter cj(t) (direct current component of synthesized waveform), and content of component waveform are changed depending upon the lapse of time from the start of sounding.

Moreover, the content of operation of the formant carrier level parameter ajk(t) at the multiplier 64 may be varied depending upon the lapse of time from the start of sounding. For instance, the operation is a multiplication when the elapsed time is short and is a bit shift when the elapsed time is long. In this case, the operation units are provided in a plural number depending upon the operations, and the data input to the operation units are switched depending upon the musical factors.

A variety of modifications, changes, uses, diversions, substitutions, additions, etc. for the formant control parameters Valj (ω fj(t), ω cj(t), aj(t), cj(t) and dj(t)) that are described above or will be described later, quite hold true directly and exclusively for the formant carrier parameters ω cjk(t), formant carrier level parameters ajk(t) and formant carrier bias parameters cj(t) that are described above or will be described later. This is because, the parameters Valj (ω cj(t), aj(t), cj(t)) and the parameters ω cjk(t) , ajk(t) and cj(t) have quite the same natures. The above modifications will not be described here to avoid the specification from becoming lengthy.

The above-mentioned formant carrier signals Gj(t), formant carrier parameters ω cj(t), formant carrier level parameters ajk(t) and formant carrier bias parameters cj(t) can be directly diverted as parameters for forming formant waveform signals Ffj(t).

In this case, the parameters stored in the harmonic wave memory 211 for each of the musical factors are read out by the controller 20, subjected to the conversion operation depending upon the ratio or the difference, and are stored in the shift registers 601 . . . , 602 . . . , 603 . . . in the formant waveform generator 60. The component waveforms are then read out from the trigonometric function tables 63 . . . , multiplied by amplitude coefficients through the multipliers 64, and are addition-synthesized through the adder 612 with the component waveforms of which the amplitudes are controlled. Thus, the formant waveform signals Ffj(t) are produced by the synthesis of harmonic waves (subharmonic waves).

The thus synthesized formant waveform signals Ffj(t) are multiplication-synthesized by the parameters aj(t) through the multiplier 67, addition-synthesized with the parameters cj(t) through the adder 65, and are further multiplication-synthesized with the formant carrier signals Gj(t) through the multiplier 66.

As shown in FIGS. 3 and 4, the amplitude coefficients of frequency spectral components have various formant forms, which can be selected and switched depending upon the musical factors, lapse of times from the start of sounding, envelope levels, envelope phases and/or settings instructed by the operator. The multiplication by parameters aj(t) at the multiplier 67 may be omitted.

In this case, the frequency of the formant carrier signals Gj(t) determines the tone pitch of the synthesized musical tone, and the frequency of fundamental wave of component waveforms of formant waveform signals Ffj(t) can be set constant irrespective of the tone pitch or can be arbitrarily set irrespective of the tone pitch. Moreover, the density of frequency components of formant of the formant waveform signals Ffj(t) can be set irrespective of the tone pitch.

The formant carrier signals Gj(t) and the formant waveform signals Ffj(t) can be both produced by the synthesis of harmonic waves (subharmonic waves). These two signals produced by the synthesis are further subjected to the synthesis such as multiplication and are output to produce sound.

The formant carrier signals Gj(t) or the formant waveform signals Fj(t) formed by the synthesis of harmonic waves (subharmonic waves) can be once written and stored in the memory and can then be read out at the time of sounding so as to be sounded as musical tones. In this case, the signals that are synthesized are written into the formant form waveform memory (RAM) 53 or into the trigonometric function table (RAM) 63.

A variety of modifications, changes, uses, diversions, substitutions and additions mentioned with reference to the parameters ω cjk(t), ajk(t) and cj(t) for the formant carrier signals Gj(t) described earlier or will be described later, quite hold true directly and exclusively even for the modifications and the like of the parameters for the formant waveform signals Ffj(t) that are described above or will be described later. This is because, these parameters have the same natures. The modifications and the like are not described here to avoid the specification from becoming lengthy.

Though not diagramed, selectors are provided at the input terminals of the shift registers 601 . . . , 602 . . . , 603 . . . . Under normal condition, the selectors select the outputs of the shift registers 601 . . . , 602 . . . , 603 . . . , and feed them back, and the selection is switched by the controller 20 at a moment when the parameters ω cjk(t), ajk(t) and cj(t) are written by the controller 20.

17. Weight Interpolation Circuit

Figure 21:
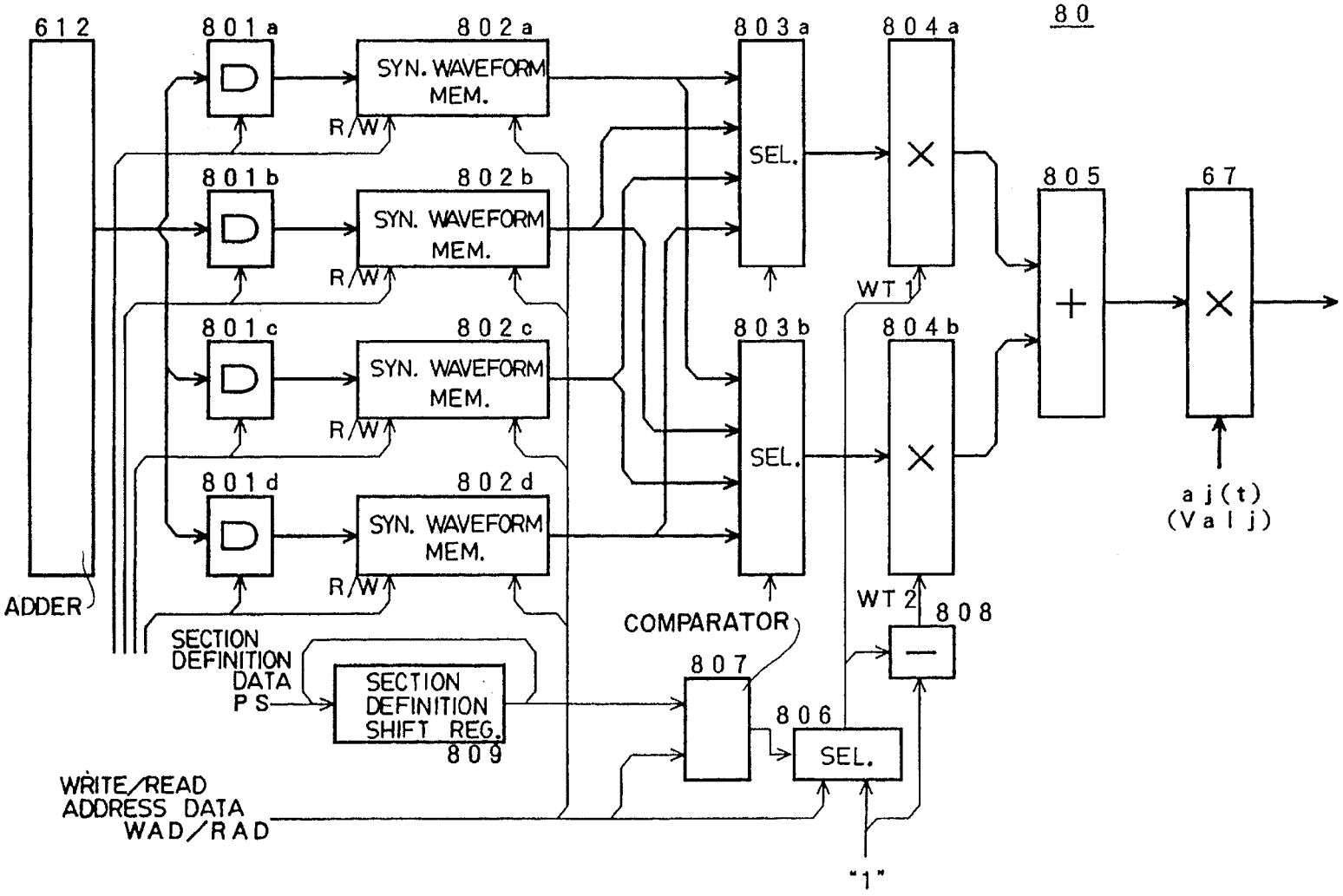
FIG. 21 is a diagram showing a weight interpolation circuit 80.

FIG. 21 shows a weight interpolation circuit 80 which is provided between the adder 612 and the multiplier 67 in FIG. 20. The signals Gj(t), Fj(t) and Ffj(t) addition-synthesized through the adder 612. The formant waveform generator 50 or the triangular function table 63 are written into any of synthesized waveform memories 802*a*, 802*b*, 802*c*, 802*d* through the AND gate groups 801*a*, 801*b*, 801*c*, 801*d*. The signals from the adder 612 are either the formant waveform signals Ffj(t) or formant carrier signals Gj(t). Here, the signals from the adder 612 are the formant waveform signals Ffj(t). In this case, the formant waveform signals Fj(t) and the formant carrier signals Gj(t) are replacemently (alternatingly) input to the multiplier 66 of FIG. 19.

Figure 22:
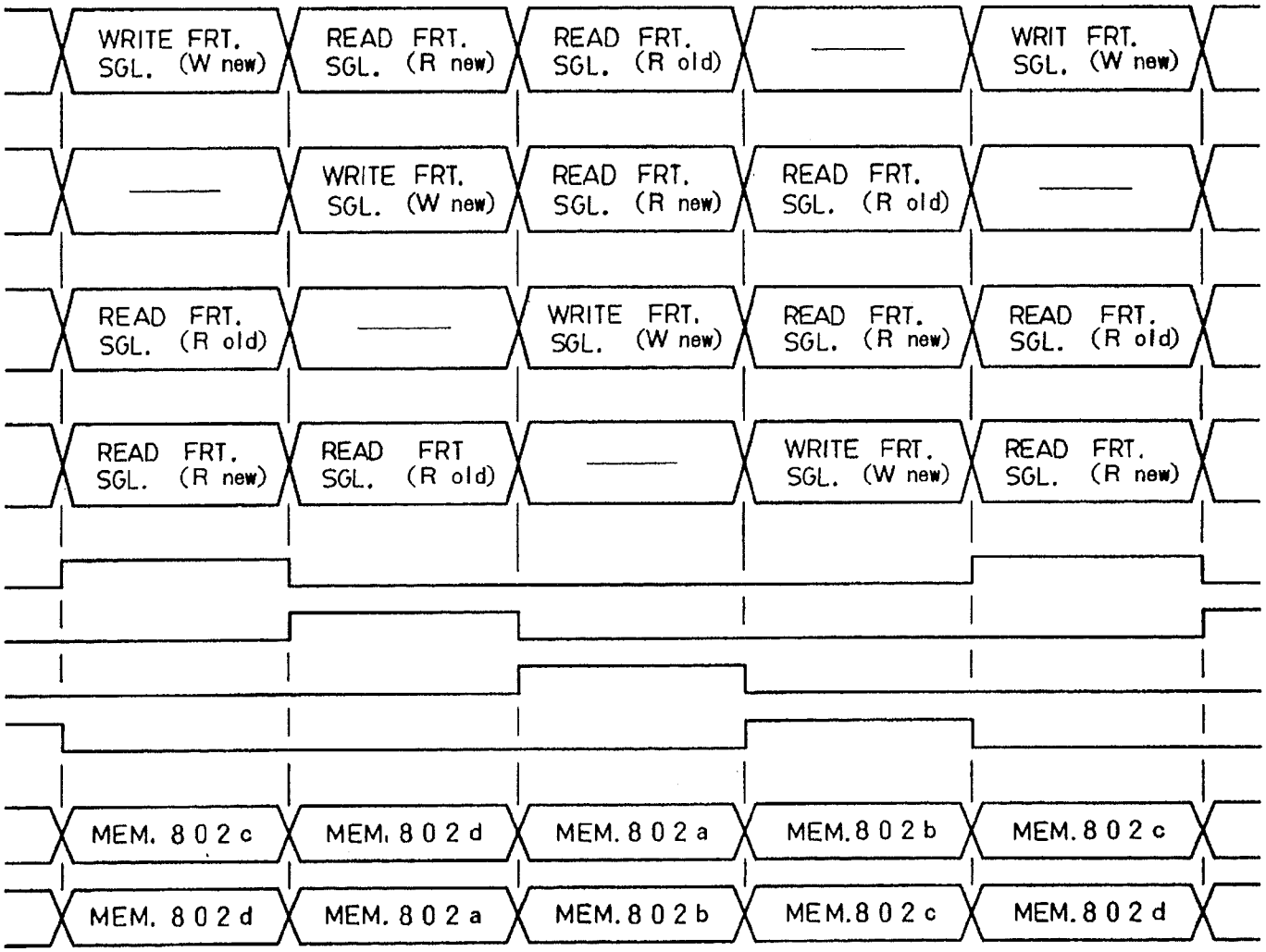
FIG. 22A–22J are time charts illustrating the write/read switching state of synthesized waveform memories 802*a* to 802*d* in the weight interpolation circuit 80.

As shown in FIGS. 22A–22S, the formant waveform signals Ffj(t) are written into any one of the synthesized waveform memories 802*a*, 802*b*, 802*c*, 802*d* which are sequentially switched by a selector 801. Among these synthesized waveform memories 802*a* to 802*d*, the synthesized waveform memories 802*a* to 802*d* from which the formant waveform signals Ffj(t) are read out as signal after changed are the synthesized waveform memories 802*a* to 802*d* into which the latest signal are written as shown in FIG. 22, and the synthesized waveform memories 802*a* to 802*d* from which the formant waveform signals Ffj(t) are read out as signals of before being changed are the synthesized waveform memories 802*a* to 802*d* into which the signal are written just before the latest signals are written into the synthesized waveform memories 802*a* to 802*d*.

The select signal to the above-mentioned AND gate groups 801*a*, 801*b*, 801*c*, 801*d*, 803*a* and 803*b*, enables the reading/writing shown in FIG. 22. The select signal is the one converted from the channel count data of a channel of time-divisional processing, or is a select signal from the controller 20. The read/write signal R/W to the synthesized waveform memories 802*a*, 802*b*, 802*c* and 802*d* is just an enable signal of the AND gate groups 801*a*, 801*b*, 801*c* and 801*d* or an inverted enable signal thereof.

The synthesized waveform memories 802*a*, 802*b*, 802*c* and 802*d* have channel areas corresponding to the number of time-divisional channels (16, 32, etc.), and store formant waveform signals Ffj(t) or formant carrier signals Gj(t) for all musical tones assigned to the channels.

As the write address data WAD or the read address data RAD for the synthesized waveform memories 802*a*, 802*b*, 802*c* and 802*d*, (use is made of) the above-mentioned integer data in accumulated formant carrier parameters Σω cjk(t) of the phase shift register 61 of the harmonic wave generator 611 that generates the fundamental wave are used. This brings the generation of formant waveform signals Ffj(t) into synchronism with the write/read of formant waveform signals Ffj(t) to and from the synthesized waveform memories 802*a* to 802*d*.

As the write address data WAD and the read address data RAD, there can be used high-order integer data of the accumulated formant density parameters Σω fj(t) of the phase operation unit 51 or of the accumulated formant carrier parameters Σω cj(t) of the phase shift register 61. Moreover, the write address data WAD or the read address data RAD may be the count data from the address counter (not shown). The address counter makes a count in response to a channel clock signal CHϕ.

The formant waveform signals Ffj(t) of one cycle are written into the synthesized waveform memories 802*a*, 802*b*, 802*c* and 802*d*. In this case, the formant waveform signals Ffj(t) have no relation to the tone pitch and, hence, the length of a cycle of the formant waveform signals Ffj(t) does not change depending upon the tone pitch. In reading the formant waveform signals Ffj(t), there is no need to change the reading speed depending upon the tone pitch. It is of course allowable to change the reading speed depending upon the tone pitch. When the formant carrier signals Gj(t) are written into the synthesized waveform memories 802*a* to 802*d* and are read out therefrom, high-order integer data of accumulated formant carrier parameters Σω cj(t) of the phase shift register 61 are used as the read address data RAD.

When the formant waveform signals Ffj(t) and formant carrier signals Gj(t) of a plurality of cycles are written into the synthesized waveform memories 802*a* to 802*d*, the following processing is carried out. That is, cosine waves of a plurality of cycles are stored in the trigonometric function tables 63 . . . of the harmonic wave generators 611. Or, carry high-order bit groups are added to the high-order integer data of accumulated formant carrier parameters Σω cjk(t) of the phase shift register 61 used for the write address data WAD or the read address data RAD of synthesized waveform memories 802*a* to 802*d*.

The selector 803*a* selects any one of the formant waveform signals Ffj(t) of the synthesized waveform memories 802*a*, 802*b*, 802*c* and 802*d*, and outputs it as a formant waveform signal Ffj(t) of before changed. The selector 803*b* selects any one of the formant waveform signals Ffj(t) of the synthesized waveform memories 802*a*, 802*b*, 802*c* and 802*d*, and outputs it as a formant waveform signal Ffj(t) of after changed.

The formant waveform signal Ffj(t) of before changed selected by the selector 803*a* is multiplied by a weight data WT1 through the multiplier 804*a*, the formant waveform signal Ffj(t) of after changed selected by the selector 803*b* is multiplied by a weight data WT2 through the multiplier 804*b*, and these two formant waveform signals Ffj(t) are additionally synthesized together through the adder 805, whereby the two formant waveform signals Ffj(t) are interpolated and are sent to the multiplier 67.

The relation between the weight data WT1 and the weight data WT2 is such that the sum of the two data is "1". Therefore, either one of the weight data WT1 or WT2 may be obtained by subtracting the other data from "1". As the weight data WT1, there can be used high-order data or the whole data of read address data RAD of the synthesized waveform memories 802*a* to 802*d*, and the weight data WT2 can be the one obtained by subtracting the read address data RAD from "1".

The weight data WT1 and WT2 change like, for example, "1, 0", "7/8, 1/8", "6/8, 2/8", "5/8, 3/8"... "1/8, 7/8", "0, 1", whereby weighing between the formant waveform signal Ffj(t) of before changed and the formant waveform signal Ffj(t) of after changed are sequentially shifted from the former toward the latter, and the interpolation between the two formant waveform signals Pfj(t) is shifted from before changed to after changed, permitting the formant waveform signals Ffj(t) to be smoothly changed.

In the above-mentioned case, the section where the formant waveform signals Ffj(t) of before changed and the formant waveform signals Ffj(t) of after changed are interpolated, is the whole section of formant waveform signals Ffj(t) that are stored in the synthesized waveform memories 802*a* to 802*d*. Here, however, the two formant waveform signals Ffj(t) may be partly interpolated. In this case, the above-mentioned fixed values "1" and "0" are used as the weight data WT1 and WT2 in the section where no interpolation is effected, and the high-order data or the whole data of the read address data RAD are used as the weight data WT1 and WT2 in the section where interpolation is effected as described above.

The selector 806 and comparator 807 of FIG. 21 work to realize part of this interpolation. Either the read address data RAD or the data "1" is directly fed to the multiplier 804*a* via the selector 806, and a value obtained by subtracting the address data RAD or the data "1" from the data "1" is fed to the multiplier 804*b* via the subtractor 808.

The comparator 807 compares the section definition data PS with the read address data RAD. When the read address data RAD is larger than the section definition data PS, the comparator 807 outputs a detection signal to switch the select data of the selector 806. Therefore, the section definition data PS defines a section for effecting the interpolation.

The section definition data PS is stored in the harmonic wave memory 211 together with the parameters ω cjk(t), ajk(t) and cj(t) for each of the musical factors, lapse of times from the start of sounding, envelope levels and/or envelope phases. Then, the section definition data PS assigned to the channels and corresponding to a musical tone that is to be sounded, is read out and is stored in a section definition shift register 809. The section definition shift register 809 has shift areas corresponding to the number of channels, the data are stored in the divisional time of a channel to which is assigned a musical tone synthesized by the formant waveform generator 60, and the section definition data PS of the channels are sequentially output.

Though not diagramed, a selector is provided at an input terminal of the section definition shift register 809. When the output of the section definition shift register 809 is selected by the selector and is fed back and when the section definition data PS is written by the controller 20, the selection of the selector is switched by the controller 20.

As described above, the contents of component waveforms in the harmonic wave generators 611 . . . , amplitude coefficients ajk(t), contents of operation, weight data WT1 and WT2, and section definition data PS are changed depending upon the musical factors (timbre, volume of sound, effect, filtering characteristics, etc.), lapse of times from the start of sounding, envelope levels, envelope phases and/or settings instructed by the operator. Changes in the musical factors are detected by the controller 20, and the contents such as component waveforms are changed. This change causes a change in the waveforms of the formant waveform signals Ffj(t) that are synthesized and output by the harmonic wave generators 611 . . . , and in the content of interpolation and in the section of interpolation. In these changes, the formant waveform signals Ffj(t) are written into the synthesized waveform memories 802*a* to 802*d* and the above-mentioned interpolation is effected in these changes.

As described above, the formant waveform signals Ffj(t) in FIGS. 21 and 22 are all substituted by the formant carrier signals Gj(t), and whereby the formant carrier signals Gj(t) are synthesized for their harmonic waves in a time-divisional manner. Furthermore, one of the synthesized waveform memories 802*a* to 802*d* can be omitted, and a memory can be omitted into which no formant waveform signal Ffj(t) is written or from which no formant waveform signal Ffj(t) is read.

Moreover, the synthesized waveform memories 802*a* to 802*d* may be all omitted and, instead, there may be provided harmonic wave generators 611 . . . for synthesizing the component waveforms of the formant waveform signals Ffj(t) of before changed, an adder 612, harmonic wave generators 611 . . . for synthesizing the component waveforms of formant waveform signals Ffj(t) after changed, and an adder 612, so that the formant waveform signals Ffj(t) of before changed and after changed are weighed and interpolated by the multipliers 804*a*, 804*b*, adder 805, selector 806, comparator 807, and subtractor 808.

With the above-mentioned formant waveform signals Ffj(t) of a plurality of cycles being stored in the synthesized waveform memories 802*a* to 802*d*, zero-cross points at the ends can be brought into agreement despite the frequencies of harmonic waves generated by the harmonic wave generators 611 have non-integral ratios with respect to the frequency of the fundamental wave. For instance, when there are synthesized harmonic wave components having non-integral ratios such as "1.25" and "1.05" with respect to the fundamental wave "1", zero-cross points are not in agreement in one cycle between the synthesized waveform and the fundamental wave, and the phases are not in agreement, either.

Figure 23:
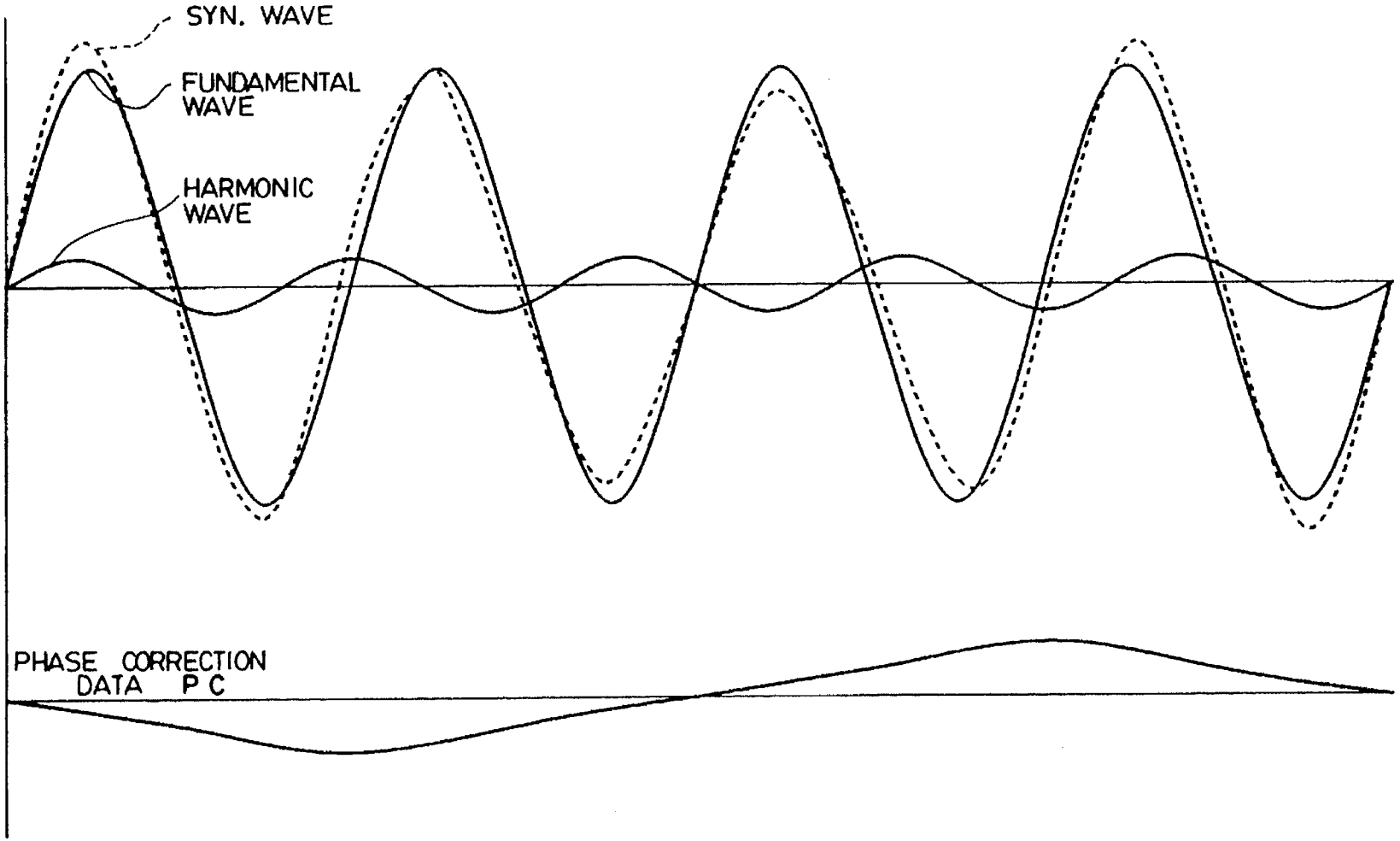
FIG. 23 is a diagram illustrating a phase difference between a fundamental wave and a waveform obtained by synthesizing the fundamental wave with a harmonic wave of a non-integral ratio.

When the fundamental wave is stored by 20 cycles, however, phases at the ends of the synthesized waveform and the fundamental wave come into agreement. This is shown in FIG. 23 where a broken line represents a waveform synthesized by the fundamental wave "1" and a harmonic wave "1.25". Though the phases are in agreement at the heads of the synthesized wave and the fundamental wave, zero-cross points are no longer in agreement in the way. However, zero-cross points are in agreement at the ends and phases are in agreement, too.

The phase difference caused by containing the component waveforms of harmonic components of non-integral ratios is corrected by phase correction data PC. In the example of FIG. 23, all phases and zero-cross points of the synthesized wave represented by the broken line are brought by the phase correction data PC into agreement with all phases and zero-cross points of the fundamental wave represented by a solid line. The phase correction data PC work to gradually correct tone pitch of the synthesized waveform, and are added to, multiply or divide the read address data RAD or the write address data WAD of the formant waveform signals Ffj(t) of before changed or after changed. Accordingly, the phase can be corrected during when the formant waveform signals Ffj(t) of before changed or after changed are written or are read out, or during both of them.

The phase correction data PC are stored in the harmonic wave memories 211 together with the parameters ω cjk(t), ajk(t) and cj(t) for each of the musical factors, lapse of times from the start of sounding, envelope levels and/or envelope phases. The phase correction data PC assigned to the channels and corresponding to a musical tone to be sounded are read out, and are written into a phase correction memory (not shown). The read address data RAD are fed even to the phase correction memory, whereby the phase correction data PC are sequentially read out, and are time-divisionally operated upon the read address data RAD of the synthesized waveform memories 802*a*, 802*b*, 802*c* and 802*d*. The correction memory is provided for each of the synthesized waveform memories 802*a*, 802*b*, 802*c*, and 802*d*.

This makes it possible to correct the phase. Even when the synthesized waveforms containing component waveforms of harmonic wave components of non-integral ratios are stored in the synthesized waveform memories 802*a*, 802*b*, 802*c* and 802*d*, such synthesized waveforms can be stored in one cycle, or can be stored in a plurality of cycles, as a matter of course.

The phase can be corrected even by using a filter. In this case, either one or both of the formant waveform signals Ffj(t) of before changed and after changed are written into the synthetic waveform memories 802*a* to 802*d*, and 802 via the filter, or are sent to the multipliers 804*a*, 804*b* via the filter. The phase correction data PC are sent as filter characteristics data to the filter.

The interpolation through the adder 805 is a linear interpolation by an arithmetic mean value, but may be a curved interpolation by a geometrical mean value through the multiplier. Further, the value (or interpolated value) of the formant waveform signal Ffj(t) of before changed sent from the selector 803*a* may be set to be "A", the value of the formant waveform signal Ffj(t) of after changed sent from the selector 803*b* may be set to be "B", and the interpolation may be carried out based upon these two values and the above-mentioned weight data WT by using an operation circuit which repeats the operation of "A+(B−A)×WT→A". Here, if the weight data WT is "½", the difference "B−A" between the interpolated value "A" and the target value "B" is simple shifted toward the low-order side by one bit, construction of the operation circuit is simple.

Furthermore, the selector 806, comparator 807 and section definition shift register 809 may be omitted, the section definition data PS may be omitted, the read address data RAD may be fed to the multipliers 804*a* and 804*b* at all times, and the whole sections of formant waveform signals Ffj(t) and Gj(t) stored in the synthesized waveform memories 802*a* to 802*d* may be specified as a section to be interpolated.

Figure 24:
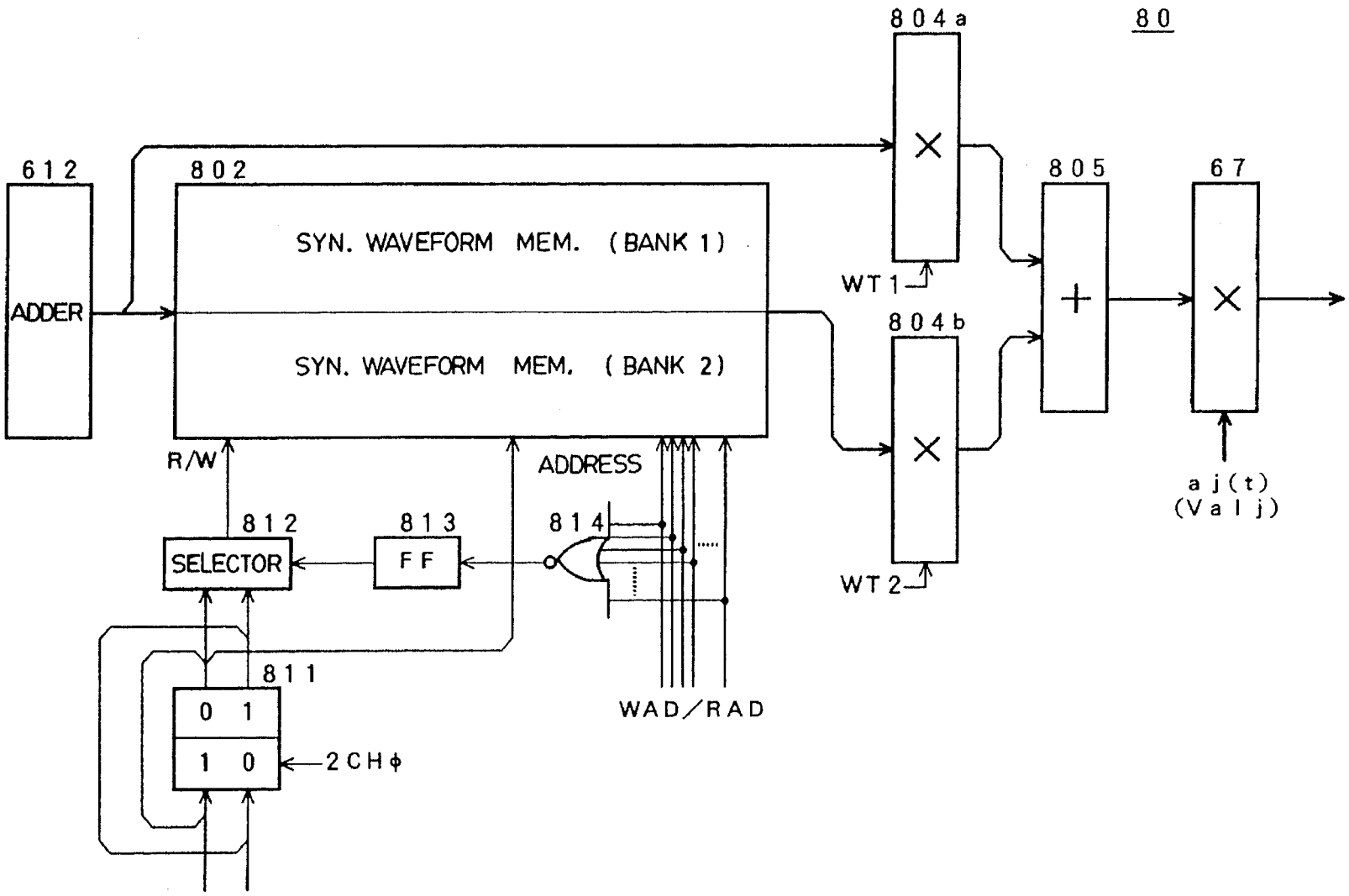
FIG. 24 is a diagram showing the weight interpolation circuit 80 according to the second embodiment.

FIG. 24 illustrates the weight interpolation circuit 80 according to a further embodiment. In this embodiment, the formant signals Fj(t) and Gj(t) are written into, and are read out from, one memory. The synthesized waveform memories 802*a*, 802*b*, 802*c* and 802*d* are merged into a single memory 802 which has two memory banks, each memory bank storing the formant signals Fj(t) and Gj(t) of after changed and before changed of all channels.

The two states, i.e., writing of formant signals Fj(t), Gj(t) of after changed and reading of formant signals Fj(t), Gj(t) of before changed, are further switched in a time-divisional manner for each of the musical tones assigned to the channels. The formant signals Fj(t), Gj(t) after changed written into the synthesized waveform memory 802 are also sent to the multiplier 804*a*, and the formant signals Fj(t), Gj(t) of before changed read out from the synthesized waveform memory 802 are sent to the multiplier 804*b*. Thus, the formant signals Fj(t) and Gj(t) of after changed and before changed are weighed and interpolated.

In the switching shift register 811 are stored switching data CG "01", "10" which are sequentially ring-shifted. Among them, the high-order bits are fed as high-order data of write/read address data WAD/RAD of the synthesized waveform memory 802, i.e., fed as bank switching data for the synthesized waveform memory 802. The frequency of shift clock signals 2CHϕ of the switching shift register 811 is twice as great as the frequency of the above channel clock signals CHϕ.

The high-order bits or the low-order bits of switching data CG "01", "10" of the switching shift register 811 are fed as read/write signal R/W to the synthesized waveform memory 802 via the selector 812. The bits of the write/read address data WAD/RAD of the synthesized waveform memory 802 are fed as an inverted signal to the flip-flop 813 via the NOR gate 814. The output signal of the flip-flop 813 is fed as a select signal to the selector 812.

Therefore, the output side of high-order bits or low-order bits of the switching data CG "01", "10" is switched (changed) only when the write/read address data WAD/RAD are "000 . . . 0 (all zeros)". Therefore, the banks of the synthesized waveform memory 802 into which the data are written or from which the data are read out, are alternatingly (replacemently) changed (switched). Other constitutions, operations, modifications, changes, uses, diversions, substitutions and additions are the same as those of the aforementioned embodiment of FIG. 21.

The formant waveform signals Ffj(t) of before changed (or after changed) may be stored in the synthesized waveform memories 802*a* to 802*d* and in the banks of the synthesized waveform memory 802, and differential waveforms between the formant waveform signals Ffj(t) of before changed (or after changed) and the formant waveform signals Ffj(t) of after changed (or before changed) may be stored therein for each of the sampling points. Either one or both of these formant signals are corrected for their phases, additionally synthesized, and are output.

The synthesized waveform memory 802 may be substituted by a memory constituted by CCD (BBD) of the shift register type or of the delay line type. This memory is provided with CCDs of columns of a number equal to the number of bits of the formant signals Fj(t), Gj(t), and the formant signals Fj(t), Gj(t) of all channels are sequentially shifted by the shift clock signals SCϕ, and are output after one cycle or after a plurality of cycles.

The formant signals Fj(t), Gj(t) after changed that are input to the synthesized waveform memory 802 of CCDs are then sent to the multiplier 804*a*, and the formant signals Fj(t), Gj(t) of before changed that are output are sent to the multiplier 804*b* where they are weighed and interpolated. The cycle of the shift clock signals SCϕ is equal to the increment cycle of the write/read address data WAD/RAD. Other items are the same as those of the embodiment of FIG. 21.

It is of course allowable to use any other shift register, delay memory or latch memory as the synthesized waveform memory 802. The formant signals Fj(t), Gj(t) of before changed (or after changed) and the formant signals Fj(t), Gj(t) of before changed (or after changed) which is one before the above change, which are read out in a time-divisional manner from the synthesized waveform memory 802, may be multiplied by the weight data WT1 and WT2 through the multipliers 804*a* and 804*b*, and may be accumulatation-synthesized through the accumulator and may then be sent to the multiplier 67. Furthermore, described above or later formant waveform signals Ffj (t) from the formant waveform memory 53 etc., described above or later formant carrier signals Gj (t) from the trigonometric function table 63 etc. (inclusive of the above-mentioned change), formant-synthesized signals Wj(t) from the multiplier 66 or accumulated formant-synthesized signals Σω (gr(j)) from the accumulation memory 74 may be written into, or read out from, the synthesized waveform memories 802*a*, 802*b*, 802*c*, 802*d* and 802.

A variety of modifications, changes, uses, diversions, substitutions and additions mentioned for the formant carrier signals Gj(t), formant waveform signals Fj(t), other parameters Valj (ω fj(t), ω cj(t), aj(t), cj(t), dj(t), ω fjk(t), ω cjk(t), ajk(t), cjk(t), djk(t), WAD/RAD, etc.), data TD, SP, 0, Min, Req, End, Ea and Ta which are mentioned above or will be mentioned later, all hold true directly and exclusively for the modifications and the like of the formant carrier signals Gj(t), formant waveform signals Fj(t) and other parameters that are mentioned above with reference to FIGS. 18 to 24 or will be mentioned later. This is because, these signals, parameters and data have the same natures. The modifications and the like are not described here to avoid the specification from becoming lengthy.

18. Formant Form Table 212

FIG. 25 shows a formant form table 212 of the program/data storage unit 21. In the formant form table 212 are stored the above-mentioned number of repeat top data Ta for each of the musical factors, lapse of times from the start of sounding, envelope levels and/or envelope phases.

The repeat top data Ta are specified being corresponded to the formant waveform signals Ffj(t) that are stored in the formant form waveform memory 53 for each of the musical factors, lapse of times from the start of sounding, envelope levels and/or envelope phases. In the formant form table 212 are also stored the repeat end data Ea, formant density parameters ω fj(t), speed data SP, target data O and mini-data Min in addition to the repeat top data Ta for each of the musical factors, lapse of times from the start of sounding, envelope levels and/or envelope phases.

The repeat top data Ta, formant density parameters ω fj(t) and repeat end data Ea are stored each in a set being corresponded to each other. The repeat top data Ta select and specify a number of formant waveform signals Ffj(t) stored in the formant form waveform memory 53 as described above.

The numbers of sets of repeat top data Ta, formant density parameters ω fj(t) and repeat end data Ea differ depending upon the musical factors, lapse of times from the start of sounding, envelope levels and/or envelope phases. The selection and switching of the parameters ω fj(t) and data Ta, Ea, SP, O and Min can be input and specified by the operator through panel switch groups of the performance data generator 10. Depending upon the selection and switching, the corresponding parameters and data are written into the formant form table 212. The number or combination of formant waveform signals Fj (t) for a musical tone that is formed is changed and determined depending upon the musical factors, lapse of times from the start of sounding, envelope phases, envelope levels and/or settings instructed by the operator. The repeat top data, formant density parameters ω fj(t) and repeat end data Ea are input by the operator through the performance data generator 10.

As the number or combination of formant waveform signals Fj(t) changes, the number or combination of channels assigned to a musical tone changes in response thereto. The data are stored in a multiplexed manner for each of the musical factors, lapse of times from the start of sounding, envelope phases and/or envelope levels like the storage of the above-mentioned data SP, O, Min, Ta, Ea, formant waveform signals Ffj(t), formant density parameters ω fj (t) , formant carrier parameters ω cj(t) or n sets of parameters ω cjk(t), ajk(t), cj(t).

In this case, the musical factors can be synthesized with the formant control parameters Valj, time count data, etc. that vary depending upon the envelope data or upon the lapse of time, in compliance with various operations (1) that will be described later.

The musical factors are input through the performance data generator 10 as described above. As described above, furthermore, the formant control parameters Valj, accumulated formant density parameters Σω cj(t) ω fj(t), accumulated formant carrier parameters Σω cj(t) or time count data are used as the lapse of times from the start of sounding, the formant control parameter aj(t) are used as the envelope level data, and the envelope phases are determined based upon the number of requested data Req that are counted.

The data may not be stored for each of the lapse of times from the start of sounding or the envelope levels, and, instead, the lapse of times from the start of sounding or the envelope levels may be correction-synthesized for each of the parameters ω fj(t) and data Ta, Ea, SP, O, Min. The correction-synthesis comply with various operations (1) that will be described later. An arithmetic unit for correction-synthesizing the elapsed time of sounding or the envelope level is provided at the output terminal of the parameter storage unit 41 or at the output terminal of the function operation unit of FIG. 5, between the output terminal of the formant density storage unit 52 and the input terminal of the phase operation unit 51 of FIGS. 10 and 28, at the input terminal of the exclusive OR gate group 512 of FIG. 13, at the input terminal of the selector 513, and at the input terminal of the adder 62 of FIG. 15.

The repeat top data Ta, formant density parameters ω fj(t), repeat end data Ea, and data SP, O, Min that are selected or input, are read out and are written by the controller 20 into the channel memory areas corresponding to the assigned channels of the assignment memory 213. Among the data that are written, the data SP, O and Min are sent to the formant control parameter generator 40, and the repeat top data Ta, formant density parameters ω fj(t) and repeat end data Ea are sent to the formant form waveform generator 50 where the form of the synthesized formant is changed and the number or combination of the formant waveform signals Fj(t) is controlled.

The data are sent by the controller 20 for each of the corresponding channel timings. The sending method has been disclosed in the specifications and drawings of, for example, japanese Patent Applications Nos. 42298/1989, 305818/1989, 312175/1989, 2089178/1990, 409577/1990 and 409578/1990.

In the formant form table 212 can be further stored the above-mentioned formant control parameters cj(t), dj(t) of fixed values for each of the musical factors, lapse of times from the start of sounding, envelope phases and/or envelope levels, or being corresponded to the repeat top data Ta, formant density parameters ω fj(t) and repeat end data Ea.

19. Assignment Memory 213

Figure 26:
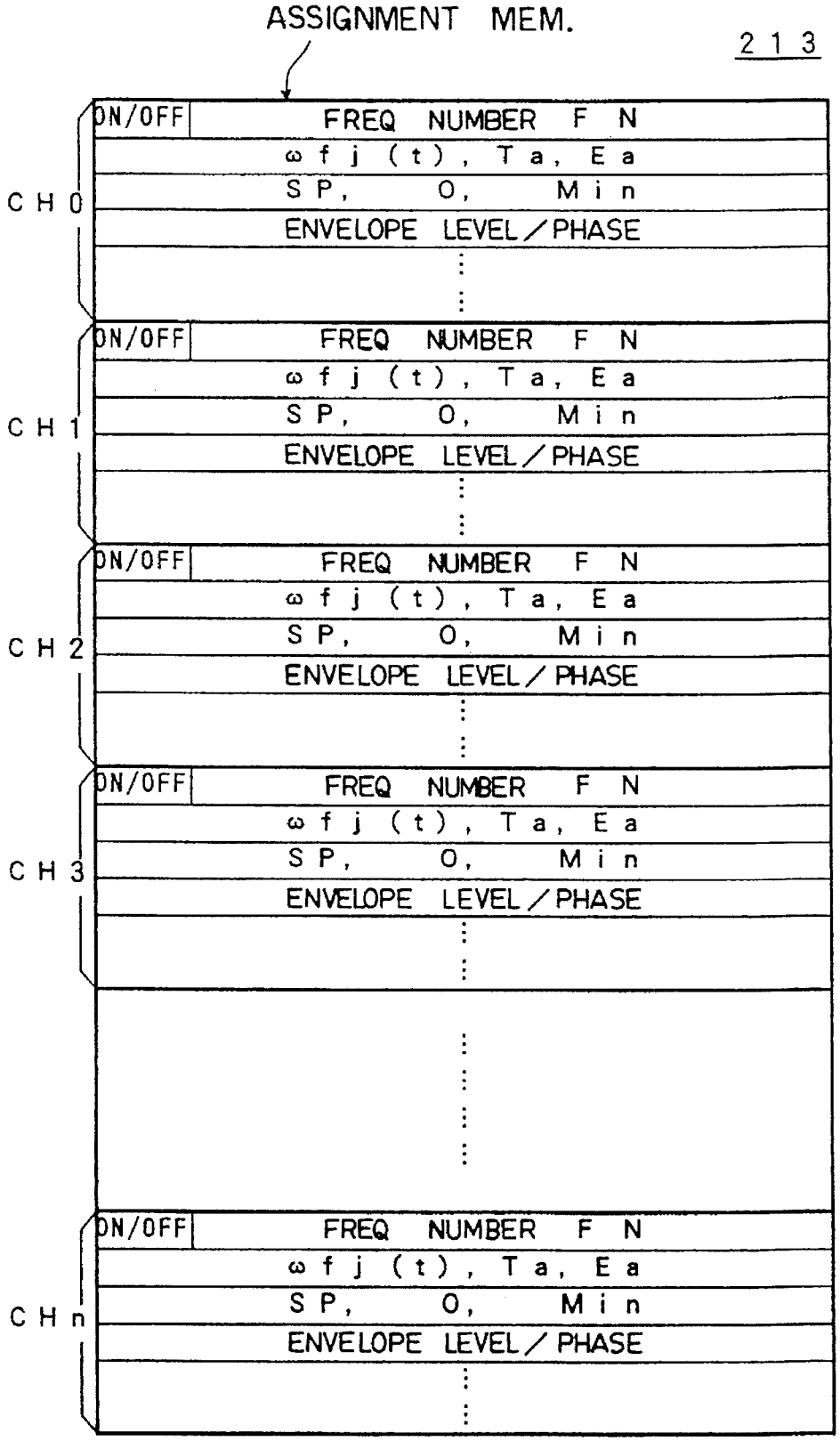
FIG. 26 is a diagram showing an assignment memory 213 in the program/data storage unit 21.

FIG. 26 illustrates the assignment memory 213 in the program/data storage unit 21. The assignment memory 213 has a plurality (16, 32, etc.) of channel memory areas and stores the data related to musical tones assigned to a plurality of musical tone-generating channels formed in the formant control parameter generator 40, formant form waveform generator 50 and formant waveform generator 60.

In the channel memory areas are stored repeat top data Ta of a musical tone to which the channels are assigned, formant density parameters ω fj(t), repeat end data Ea, various data SP, O, Min as well as on/off data, frequency number data FN (or key number data KN), envelope phase data, envelope level data, etc.

The on/off data represents that the musical tone that is assigned and is to be sounded is during the key-on period, or is sounding ("1"), or is during the key-off period, or is in a silent state ("0"). The frequency number data FN represents the tone pitch of a musical tone which is assigned and is sounded. The high-order data of the frequency number data FN represents a tone pitch range or octave. The frequency number data FN are sent by the controller 20 to the formant waveform generator 60 during the divisional time of the corresponding channel. The envelope phase data represent the attack, decay, sustain or release of the envelope, and are counted depending upon the number of outputs of the request data Req.

When the number of set of the repeat top data Ta, formant density parameter ω fj(t) and repeat end data Ea is one and when musical tones that are assigned and are to be sounded are in a plural number, the frequency number data FN are written in a number same as the number of the plurality of musical tones into each of the channel memory areas at nearly the same sounding start timing. In this case, the plurality of frequency number data FN that are written have the same value but may have values that are slightly different from each other.

The plurality of formant waveform signals Fj(t) and the plurality of formant carrier signals Gj(t) assigned to the channels are formed by the formant control parameter generator 40, formant for waveform generator 50 and formant waveform generator 60, and are (additionally or multiplicationally) synthesized by being added, subtracted, multiplied or divided.

In the channel memory areas of the assignment memory 213 can be further stored musical factor data of musical tones that are assigned and sounded. Moreover, the assignment memory 213 may be provided not in the program/data storage unit 21, but in the formant control parameter generator 40, in the formant form waveform generator 50 or in the formant waveform generator 60. In the channel memory areas of the assignment memory 213 can be also stored the formant control parameters cj(t) and dj(t) having fixed values.

The method of assigning or truncating the channels formed by the time-divisional processing to the musical tones, i.e., the method of assigning or truncating the plurality of musical tone-generating systems for generating a plurality of musical tones in parallel to the musical tones, has been disclosed in, for example, japanese Patent Applications Nos. 42298/1989, 305818/1989, 312175/1989, 2089178/1990, 409577/1990 and 409578/1990.

20. State for Changing the Number and/or the Combination of Formants

Figure 27A:
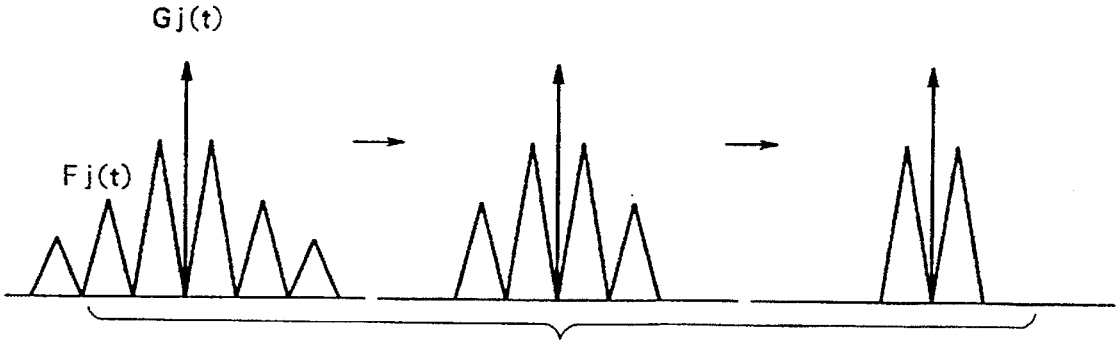
FIGS. 27A–27D are diagrams showing the shapes of formant waveform signals Fj(t) and synthesized formants of which the number or combination is to be controlled.

FIGS. 27A–27D show a relationship between the formant waveform signals Fj(t) of which the number or combination is controlled as described above and the formant of a synthesized waveform. In FIG. 27A, three formant waveform signals Fj(t) are formed from one formant waveform signal Fj(t) by changing values of the formant density parameters ω fj(t) and the formant control parameters dj(t). The number of the three formant waveform signals Fj(t) changes into two and into one. Combination of the formant waveform signals Fj(t) does not change.

Figure 27B:
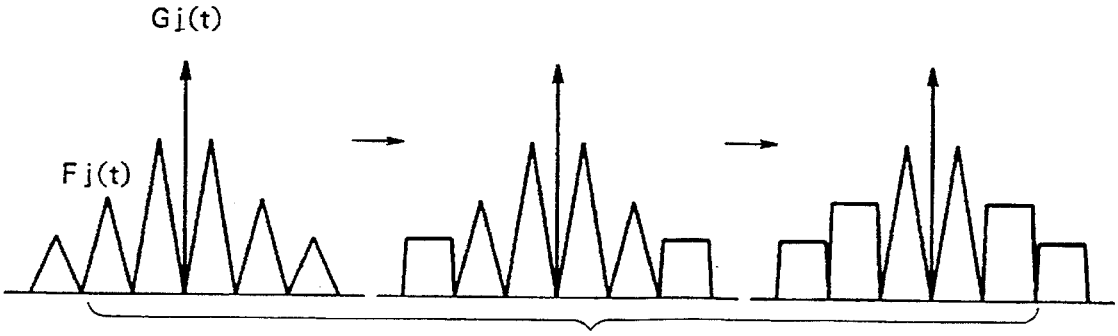
Figure 27C:
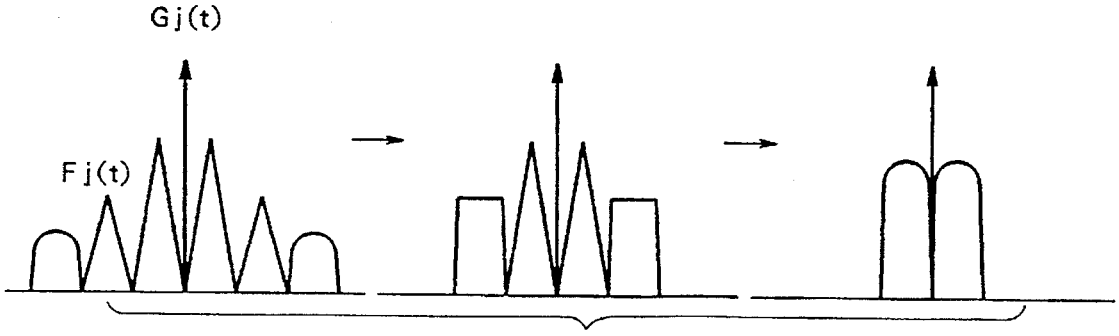
Figure 27D:
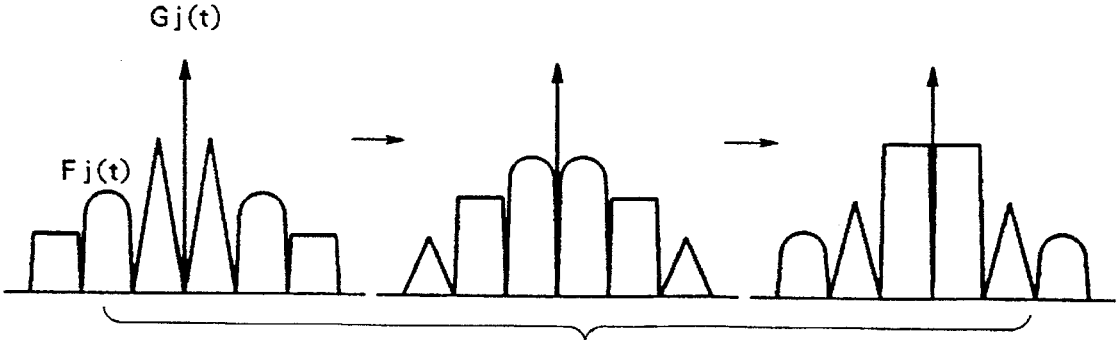

In FIG. 27B, the combination of formant waveform signals Fj(t) is changing. The number of the formant waveform signals Fj(t) does not change. In FIG. 27C, the combination and the number of the formant waveform signals Fj(t) are both changing. In FIG. 27D, it appears that neither the number nor the combination of the formant waveform signals Fj(t) is changing. Here, the formant density parameters ω fj(t) and the formant control parameters dj(t) only are changing. This is one of the changes in the combination of the formant waveform signals Fj(t).

As described above, the number or combination of the formant waveform signals Fj(t) can be changed depending upon the musical factors, lapse of times from the start of sounding, envelope levels, envelope phases and/or settings instructed by the operator, and the quality of tone can be varied in a variety of ways. In this case, the number of peak points, positions and/or heights of formants change, too.

In the above-mentioned changes, the formant control parameters dj(t) only of the same formant waveform signal Fj(t) may be changed. The formant carrier signals Gj(t) are added by a number of times corresponding to the number of times of synthesis. Moreover, changes are not limited to those shown in FIG. 27; i.e., order of changes may be reversed, order of changes may be partly replaced, or patterns of changes may be increased or decreased.

The number of the formant waveform signals Fj(t) to be synthesized may be 4 or larger. Moreover, the formants of the formant waveform signals Fj(t) may be overlapped partly or entirely. This is done by suitably selecting the values of the formant density parameters ω fj(t). Then, the level additionally increases at a portion where the formants are overlapped, and new formant peak points can be formed. Furthermore, the formants shown in FIG. 27 may be added with other formants which, however, are not shown in FIG. 27.

21. Formant Form Waveform Generator 50

Figure 28:
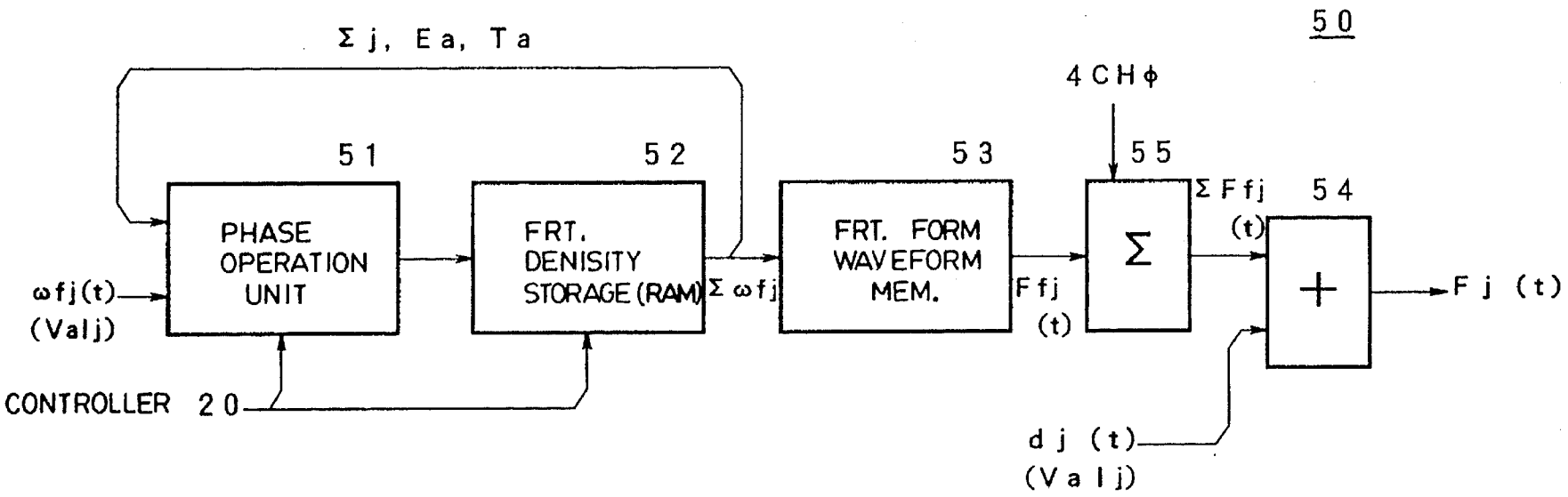
FIG. 28 is a diagram showing the formant form waveform generator 50 according to the second embodiment.

FIG. 28 illustrates the formant form waveform generator 50 according to another embodiment. In this formant form waveform generator 50, four formant waveform signals Ffj(t) are read out in a time-divisional manner during the period of time-division of a channel. Therefore, the time-divisional cycle for reading a formant waveform signal Ffj(t) is one-fourth the time-divisional cycle of the processing for forming the whole musical tone.

In the formant density memory 523 of the formant density storage unit 52 are stored the accumulated formant density parameters Σω fj(t), and formant control parameters Taj, Eaj, U/D by amounts of (number of time-division channels)×4, and the formant waveform signals Ffj(t) are read out in a number of four from the formant form waveform memory 53 for each of the channels. In response thereto, the formant control parameters Vaj, TD and V are stored by amounts of (number of time-division channels)×4 in the parameter memory 411 in the parameter storage unit 41.

The four formant waveform signals Ffj(t) that are read out are accumulated by the accumulator 55 for each of the channels, added to the formant waveform bias parameters dj(t) through the adder 54, and are sent as formant waveform signals Fj(t) to the formant waveform generator 60.

Then, as shown in FIGS. 27A to 27D, a plurality of formant waveform signals Fj(t) are additionally synthesized, formant waveform signals Fj(t) are synthesized having a formant as obtained by synthesizing a plurality of formants, and the number or combination of the formant waveform signals Fj(t) is controlled. The thus synthesized formant waveform signals Fj(t) are additionally or multiplicationally synthesized with the formant carrier Signals Gj(t) by being added, subtracted, multiplied or divided through the multipliers 66, 621 of the formant waveform generator 60.

In this embodiment, four formant waveform signals Fj(t) are multiplicationally or additionally synthesized with a formant carrier signal Gj(t) by the addition, subtraction, multiplication or division. The number of the formant waveform signals Fj(t) to be synthesized may be other than 4. In this case, the cycle of time division for reading the formant waveform signals Fj(t) is changed, or the value of formant density parameters ω fj (t) of the formant control parameter generator 40 and the value of accumulated formant density parameters Σω fj(t) of the formant density storage unit 52 are set to "0" for some of the four formant waveform signals Fj(t), so that the formant waveform signals Fj(t) are not partly read out. This makes it possible to control the number or combination of the formant waveform signals Fj(t).

The formant carrier signal Gj(t) and a plurality of the formant waveform signals Fj(t) can be synthesized together even by using the circuit shown in FIG. 20. In this case, the formant carrier signal Gj(t) and the formant waveform signals Fj(t) of each of the channels are generated simultaneously and in parallel, and are multiplication-synthesized through the multipliers 621 . . . , and are addition-synthesized through the adder 622, and are output. In this case, the formant waveform generators 60 of FIG. 15 or 19 and the formant form waveform generators 50 of FIG. 10 or 28 are provided in a number corresponding to the number of channels.

22. Formant Waveform Generator 60

Figure 29:
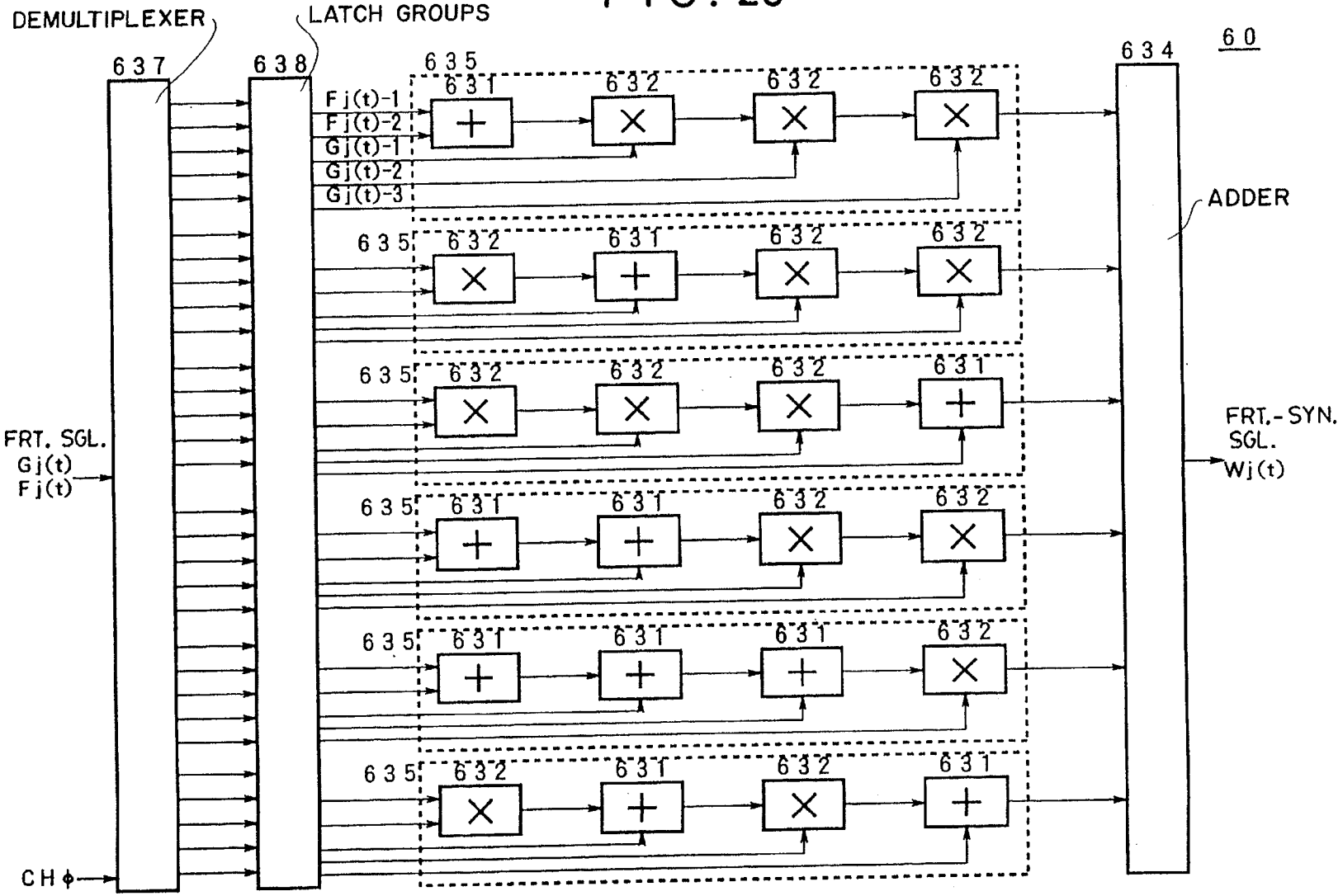
FIG. 29 is a diagram showing the formant waveform generator 60 according to a fourth embodiment.

FIG. 29 illustrates the formant waveform generator 60 according to a further embodiment. In the first multiple synthesis device 635, a plurality of formant waveform signals Fj (t)-1, Fj (t)-2 are additionally synthesized through the adder 631, and are then multiplexingly and multiplicationally synthesized with the formant carrier signals Gj(t)-1, Gj(t)-2, Gj(t)-3 through the three multipliers 632, 632, 632, sequentially. The form of the synthesized formant can be changed even by such a multiplex synthesis, and the number or combination of the formant waveform signals Fj(t) can be thus changed.

This is shown in FIG. 31A–31E. The formant waveform signals Fj(t)-1 and Fj(t)-2 are synthesized to form a synthesized formant which is then synthesized with formant carrier signals Gj(t)-1, Gj(t)-2 and Gj(t)-3, successively. Therefore, the number of synthesized formants increases and it is possible to generate musical tones having more complex formant forms. The formants shown in FIG. 31 may further be added with other formants depending upon the cases, which other formants, however, are not shown in FIG. 31.

This holds true even for the second multiple synthesis device 635, third multiple synthesis device 635, fourth multiple synthesis device 635, fifth multiple synthesis device 635 . . . . In these cases, forms of the synthesized formants, combinations, positions and numbers thereof are different from those of the first multiple synthesis device 635. The adders 631 . . . and multipliers 632 . . . may be those of the two-input type or may be those having not less than two inputs, and more than two formant signals Gj(t), Fj(t) may be (additionally or multiplicationally) synthesized simultaneously by the addition, subtraction, multiplication or division.

In this embodiment, the formant waveform controller 60 of FIG. 1 is omitted, and a plurality of formant carrier signals Gj(t) are stored as a formant waveform signal Fj(t) in the formant density storage unit 52. Five channels are assigned for one musical tone, and the selected and switched formant carrier signals Gj(t) or the formant waveform signals Fj(t) are generated through the channels. The number of channels for a musical tone may be other than 5.

The formant carrier signals Gj(t) or the formant waveform signals Fj(t) are selected and switched based upon the musical factors, lapse of times from the start of sounding, envelope levels, envelope phases and/or settings instructed by the operator. In this case, the formant form table 212 is used for storing the above-mentioned numbers of repeat top data Ta, repeat end data Ea, formant density parameters ω fj(t) (or formant carrier parameters ω cj(t)), speed data SP, target data 0, and mini-data Min for each of the musical factors, lapse of times from the start of sounding, envelope levels and/or envelope phases.

The selection and switching of the formant signals Gj(t), Fj(t) are input and specified by the operator through panel switch groups of the performance data generator 10. In this case, the corresponding data Ta, Ea, ω fj(t) (ω cj(t)), SP, 0 and Min are written into the formant form table 212 depending upon the selection and switching.

The repeat top data Ta, formant density parameters ω fj(t) (or formant carrier parameters ω cj(t)) and repeat end data Ea are stored each in a set being corresponded to each other. In this case, the formant carrier signals Gj(t) read out by the formant carrier parameters ω cj(t) and the formant waveform signals Fj(t) read out by the formant density parameters ω fj(t) are stored in the same memory 53. Therefore, the parameters ω cj(t) are the same as the parameters ω fj(t).

In the channel memory areas of the assignment memory 213 are stored repeat top data Ta of a musical tone assigned to the channels, formant density parameters ω fj(t) (ω cj(t)), repeat end data Ea and various data SP O, Min, as well as on/off data, frequency number data FN (or key number data KN), envelope phase data, envelope level data, etc.

These data are sent to the formant control parameter generator 40 and to the formant form waveform generator 50, and the formant carrier signals Gj(t) or the formant waveform signals Fj(t) are read out and are generated in a time-divisional manner. The formant signals Gj(t), Fj(t) are stored in parallel in the latch groups 638 via a demultiplexer 637, and are fed to the adders 631 . . . or to the multipliers 632 . . . in the multiple synthesis groups 635 . . . . The formant-synthesized signals Wj(t) multiplexingly synthesized through the multiple synthesis devices 635 . . . are sent to the adder 634 where the musical tones are additionally synthesized and are output. The demultiplexer 637 and the latch group 638 may be provided on the input side of the circuit of FIG. 20 in order to receive formant signals Gj(t) and Fj(t) that are being sent in a time-divisional manner.

23. Multiple Synthesis Device 635

Figure 30:
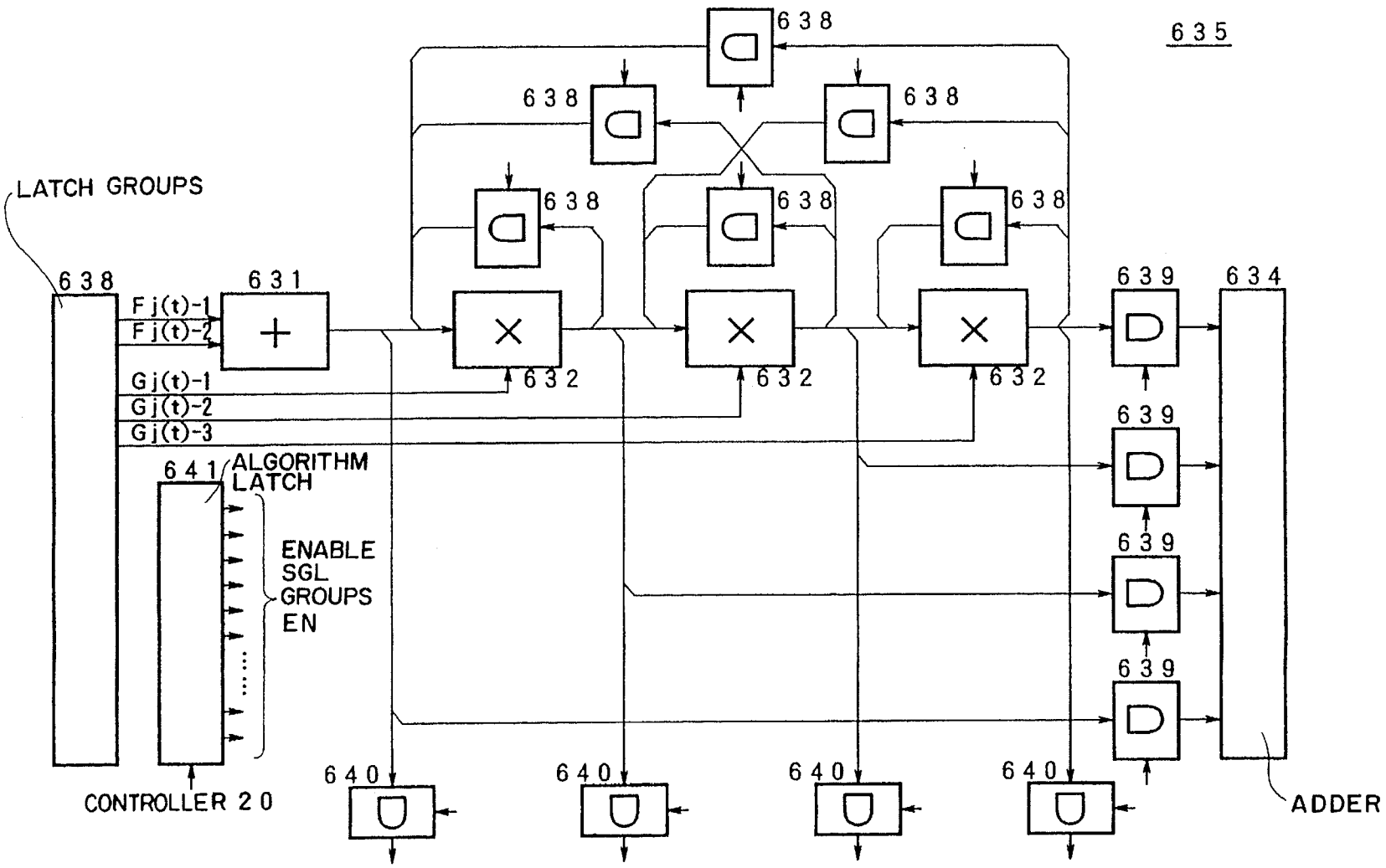
FIG. 30 is a diagram illustrating a multiple synthesis devices 635 in further detail.
Figures 31A, 31B, 31C, 31D, 31E:
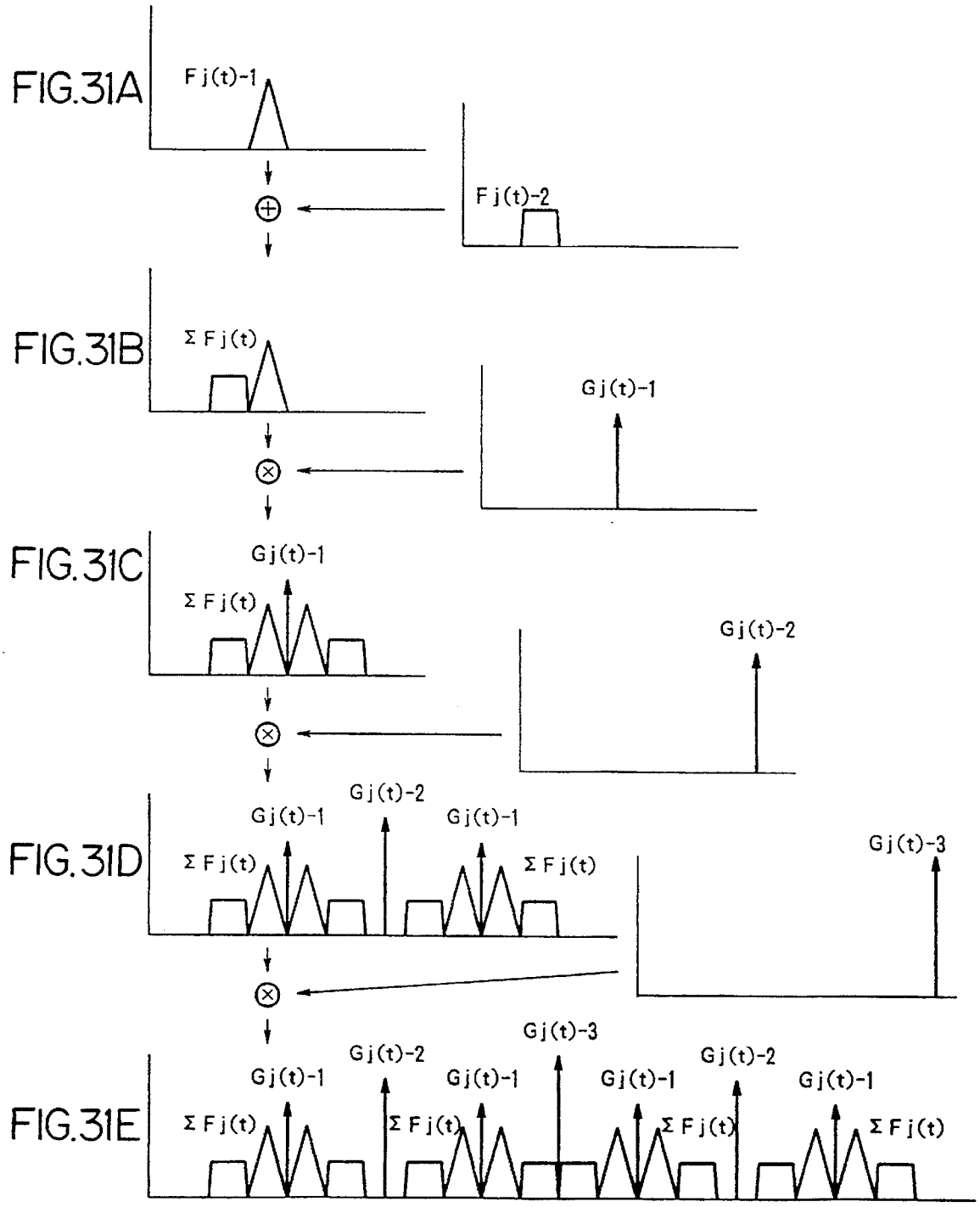
FIGS. 31A–31E are diagrams showing the shapes of formant waveform signals Fj(t) formant carrier signals Gfj(t) of which the number or combination is to be controlled and synthesized formant.

FIG. 30 is a diagram illustrating the multiple synthesis device 635 in more detail. The outputs of the multipliers 632 . . . are fed back to other multipliers 632 or to the same multipliers 632 via AND gate groups 638 . . . . Due to this feedback, the formant signals Gj(t) and Fj (t) are synthesized with the same signals Gj(t), Fj(t) or with other signals Gj(t), Fj(t), so that the synthesis is effected in a more complex and multiplexed manner, and the form of the synthesized formant is changed and the number or combination of the formant waveform signals Fj (t) is controlled.

Furthermore, the outputs of the multipliers 632 are input to the adders 634 via AND gate groups 639 . . . . Therefore, synthesized signals are output from the last or middle portions of the multiple synthesis device 635, the steps of multiple synthesis are switched, the form of the synthesized formant is changed, and the number or combination of the formant waveform signals Fj(t) is controlled.

The outputs of the multipliers 632 . . . are input via the AND gates 640 . . . to the adders 631 . . . and multipliers 632 of other multiple synthesis devices 635. Accordingly, the multiple synthesis becomes more complex and more multiplexed, whereby the form of the synthesized formant is changed, and the number or combination of the formant waveform signals Fj(t) is controlled.

Enable signal groups EN of the AND gate groups 639 . . . are simultaneously sent in parallel from the algorithm latch 641. The contents of the enable signal groups EN change depending upon the musical factors, lapse of times from the start of sounding, envelope levels, envelope phases and/or settings instructed by the operator. This results in a change in the course of multiple synthesis, i.e., in the algorithm of synthesis operation, in a change in the combination of formant signals Gj(t) and Fj(t) that are synthesized, and in a change in the form of the synthesized formant, whereby the number or combination of the formant waveform signals Fj(t) is controlled.

In this case like in the above-mentioned formant form table 212, the enable signal groups EN are stored in a multiplexing manner for each of the musical factors, lapses of times from the start of sounding, envelope levels and/or envelope phases, and the corresponding signals are read out and are stored in the algorithm latch 641 by the controller 20. The enable signal groups EN are selected and are read out even by the settings instructed by the operator.

The contents of the enable signal groups EN are input by the operator through the panel switch groups of the performance data generator 10. Here, the input enable signal groups EN are written into the same table as the formant form table 212. Though not diagramed, OR gate groups are provided at the input terminals of the multipliers 632 . . . .

In this case, the musical factors can be synthesized with formant control parameters Valj and time count data that change depending upon the envelope data or upon the lapse of time in compliance with various operations (1) that will be described later.

The data may not be stored for each of the lapse of times from the start of sounding and/or the envelope levels, and, instead, the lapse of times from the start of sounding or the envelope levels may be modification-synthesized for each of the enable signal groups EN. The correction-synthesis is effected in compliance with various operations (1) that will be described later, and an operation unit is provided at the input terminal of the algorithm latch 641 of FIG. 30 in order to modification-synthesize the lapse of time from the start of sounding or the envelope level.

24. Multiple Synthesis Devices 635

Figure 32:
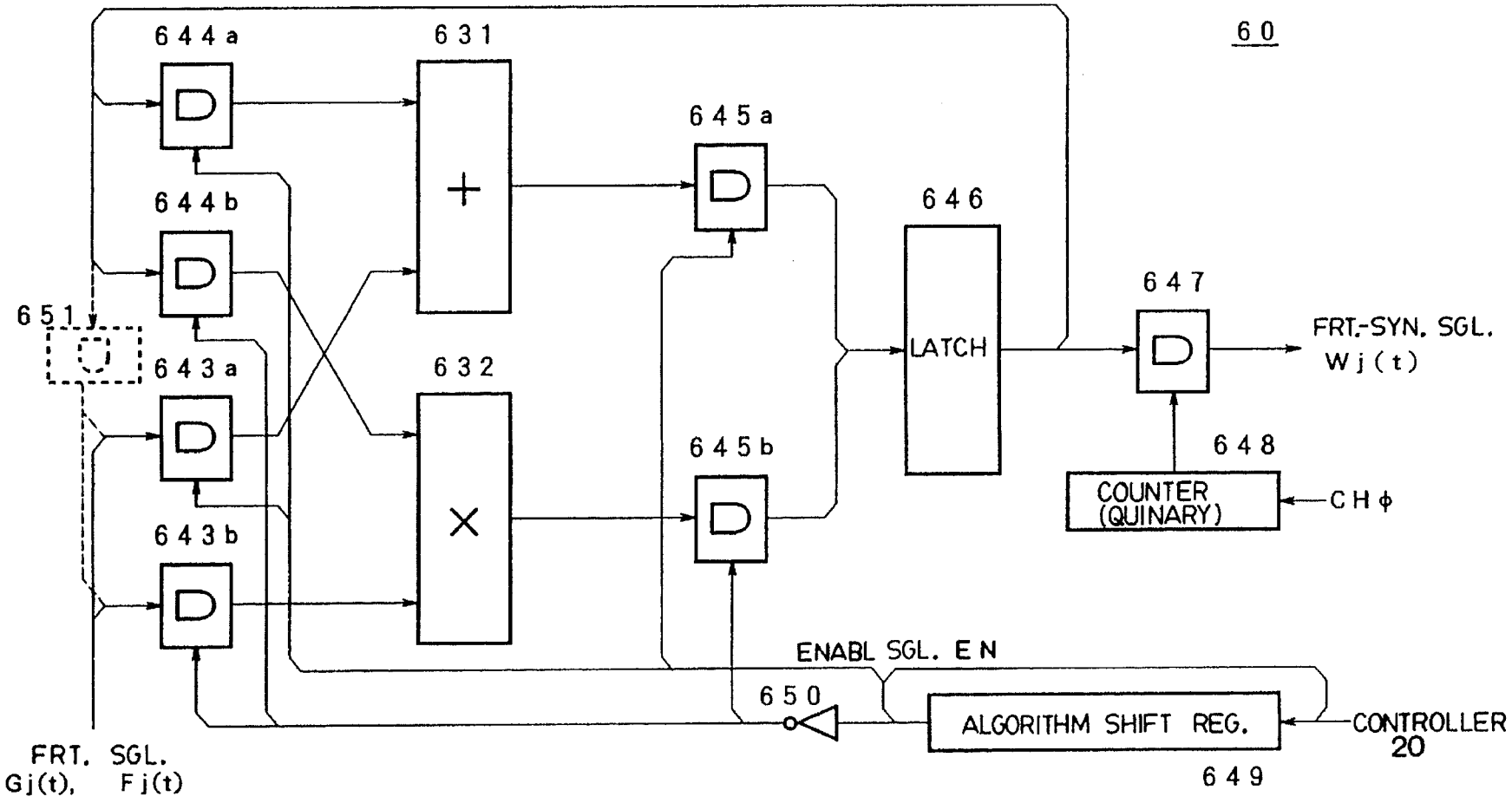
FIG. 32 is a diagram showing the formant waveform generator 60 according to a fifth embodiment.

The circuit of FIG. 32 is realized by modifying the formant waveform generator 60 of FIG. 29 based on a time-divisional manner. The formant signals Gj(t) and Fj(t) that are generated in a time-divisional manner and sequentially from the formant form waveform generator 50 are fed to the adder 631 or to the multiplier 632 through the AND gate group 643*a* or 643*b*. Furthermore, the signals operation-synthesized by the latch 646 are fed to the adder 631 or to the multiplier 632 via the AND gate group 644*a* or 644*b*.

The above signals are-additionally or multiplicationally synthesized through the adder 631 or the multiplier 632 by being added, subtracted, multiplied or divided, and are stored in the latch 646 through the AND gate group 645*a* or 645*b*. The operation-synthesis of formant signals Gj(t), Fj(t) based upon addition, subtraction, multiplication or division is repeated in a multiplexed manner for each of the channel times, whereby the form of the synthesized formant is changed, and the number or combination of the formant waveform signals Fj(t) is controlled.

The formant synthesized signal Wj(t) synthesized by the latch 646 is output through the AND gate group 647. The enable signal of the AND gate group is an overflow signal from the counter 648 to which a channel clock signal CHϕ is input as an increment signal. The counter 648 is a quinary one which is the same as the number of channels to which a musical tone is assigned, and the base changes if the number of channels of one musical tone changes.

To the AND gate groups 643*a*, 644*a* and 645*a* are serially fed the enable signal groups EN from the algorithm shift register 649 sequentially and for each of the time-divisional channels, and to the AND gate groups 643*b*, 644*b* and 645*b* are fed the enable signals from the algorithm shift register 649 being inverted through the inverter 650. The contents of the enable signal groups EN change depending upon the musical factors, lapse of times from the start of sounding, envelope levels, envelope phases and/or settings instructed by the operator, and whereby the multiple synthesis route (course, source) or the algorithm of synthesizing operation changes, the combination of the formant signals Gj(t), Fj(t) to be synthesized changes, the form of the synthesized formant changes, and the number of combination of the formant waveform signals Fj(t) is controlled.

In this case, like in the above-mentioned formant form table 212, the enable signal groups EN are stored in a multiplexed manner for each of the musical factors, lapse of times from the start of sounding, envelope levels and/or envelope phases, or are input by the operator through the panel switch groups of the performance data generator 10, and the corresponding signals are read out and are stored by the controller 20 to the algorithm shift register 649. In this case, the enable signal groups EN can also be selected and read out even by the settings instructed by the operator.

In this case, the musical factors can be synthesized with the formant control parameters Valj or the time count data that vary depending upon the envelope data or upon the lapse of time in compliance with a variety of operations (1) that will be described later.

The data may not be stored for each of the lapse of times from the start of sounding and/or the envelope levels, and the lapse of times from the start of sounding and/or the envelope levels may be modification-synthesized for each of the enable signal groups EN. The modification-synthesis is carried out in compliance with various operations (1) that will be described later, and an operation unit is provided at the input terminal of the algorithm shift register 649 of FIG. 32 in order to modification-synthesize the lapse of times from the start of sounding and/or the envelope levels.

The algorithm shift register 649 is of the ring-shift type having stages of a number of (number of channels per a musical tone)×(number of all musical tones). When a new musical tone is sounded, the enable signal EN is stored at each of the channel timings of the musical tone that is sounded. The enable signal EN determines in time series the course of multiple synthesis.

The circuit of FIG. 32 does not permit the algorithm of feedback to the same signal. This, however, can be done if the output of the latch 646 is fed to the AND gate groups 643*a* and 643*b* via the AND gate group 651 as indicated by a chain line in FIG. 32. However, the formant signals Gj(t) and Fj(t) from (of) the formant form waveform generator 50 are not fed to the AND gate groups 643*a* and 643*b* at the time of the channel of self feedback. In this case, no data is assigned to the channel which corresponds to this channel timing. The circuit of FIG. 32 permits algorithm of feedback to other signals.

The enable signal groups EN are input by the operator through the panel switch groups of the performance data generator 10. In this case, the enable signal groups EN that are input are written into the same table as the formant form table 212.

The aforementioned modifications, changes, uses, diversions, substitutions and additions for the formant form table 212 and for the assignment memory 213 of the above-mentioned embodiment quite hold true directly and exclusively for the modifications and the like of this embodiment. The modifications and the like, however, are not described here to avoid the specification from becoming lengthy.

Though not diagramed, OR gate groups, in practice, are provided at the input terminals of the latch 646 and the AND gate groups 643*a* and 643*b*. Moreover, though not diagramed, a selector is provided at the input terminal of the algorithm shift register 649. The selector usually selects the output of the algorithm shift register 649 and feeds it back, and the selection of the selector is switched by the controller 20 when the enable signal is written by the controller 20.

In this multiple synthesis, if it is presumed that the formant carrier signal Gj(t) itself has a line of formant, then, the formant carrier signal Gj(t) can be additionally or multiplicationally synthesized like the formant waveform signals Fj(t). By effecting the synthesis in a multiplexing manner, musical tones having more complex formant forms can be generated, and the number or combination of the formant waveform signals Fj(t) can be controlled.

It is further allowed to use the formant waveform signals Fj(t) in place of the formant carrier signals Gj(t), and a plurality of formant waveform signals Fj(t) can be multiplicationally synthesized. In this case, the form of the formant that is generated becomes the one that is obtained by modifying the form of formant of the formant waveform signals Fj(t), and the number or combination of the formant waveform signals Fj(t) can be controlled.

Moreover, if the level of any one of the signals input to the adders 631 . . . of the multiple synthesis devices 635 . . . is set to "0" or if the level of any one of the signals input to the multipliers 632 . . . is set to "1", then, the adders 631 . . . and the multipliers 632 . . . are placed in a through state, so that the synthesis is not carried out. With the levels being controlled as described above, the form of the synthesized formant is changed, and the number or combination of the formant waveform signals Fj(t) is controlled.

In this case, the data stored in the formant form table 212 and in the assignment memory 213, and corresponding to the formant signals Gj(t), Fj(t), become no-operations -0 and -1. The no-operation -0 is a command that instructs the reading of data "0" from the formant form memory 52 and the no-operation -1 is a command that instructs the reading of data "1" from the formant form memory 52.

Such no-operations -0 and -1 are determined in a multiplexing manner for each of the musical factors, lapse of times from the start of sounding, envelope levels and/or envelope phases like those of the formant form table 212, and are selected depending upon the musical factors or settings instructed by the operator, and are input by the operator through the panel switch groups of the performance data generator 10. Like the enable signal groups EN, the musical factors are synthesized with the formant control parameters Valj and time count data that vary depending upon the envelope data or upon the lapse of time in compliance with various operations (1) that will be described later, and the no-operations -0 and -1 are modification-synthesized with the lapse of times from the start of sounding or with the envelope level in compliance with various operations (1) that will be described later.

Furthermore, the data for determining to which one of the multiple synthesis devices 635 . . . the formant signals Gj(t), Fj(t) should be input, i.e., to which channel the musical tone that is sounded should be assigned, are determined in a multiplexing manner for each of the musical factors, lapse of times from the start of sounding, envelope levels and/or envelope phases like those of the formant form table 212, and are selected depending upon the musical factors or settings instructed by the operator, and are input by the operator through the panel switch groups of the performance data generator 10. In response thereto, the program/data storage unit 21 is provided with a table of correspondence between the musical factors, lapse of times from the start of sounding, envelope levels and/or envelope phases and the assigned channels, i.e., provided with a table similar to the formant form table 212. In this table are written the data input by the operator.

The musical factors are synthesized with formant control parameters Valj and time count data that vary depending upon the envelope data or upon the lapse of time in compliance with various operations (1) that will be described later, or the data for determining the above-mentioned matters are modification-synthesized with the lapse of time from the start of sounding or with the envelope level in compliance with various operations (1) that will be described later.

Here, some of the adders 631 . . . are replaced by the multipliers and some of the multipliers 632 . . . are replaced by the adders, so that the additional synthesis and multiplicational synthesis are replaced by each other, whereby the contents of synthesis are changed, the forms of synthesized formants are changed, and the number or combination of the formant waveform signals Fj(t) is controlled. The number of stages of the multiple synthesis devices 635 . . . of FIGS. 29 and 30 can be further increased by adding adders 631 . . . or multipliers 632 . . . .

25. Consonance control circuit 90

Figure 33:
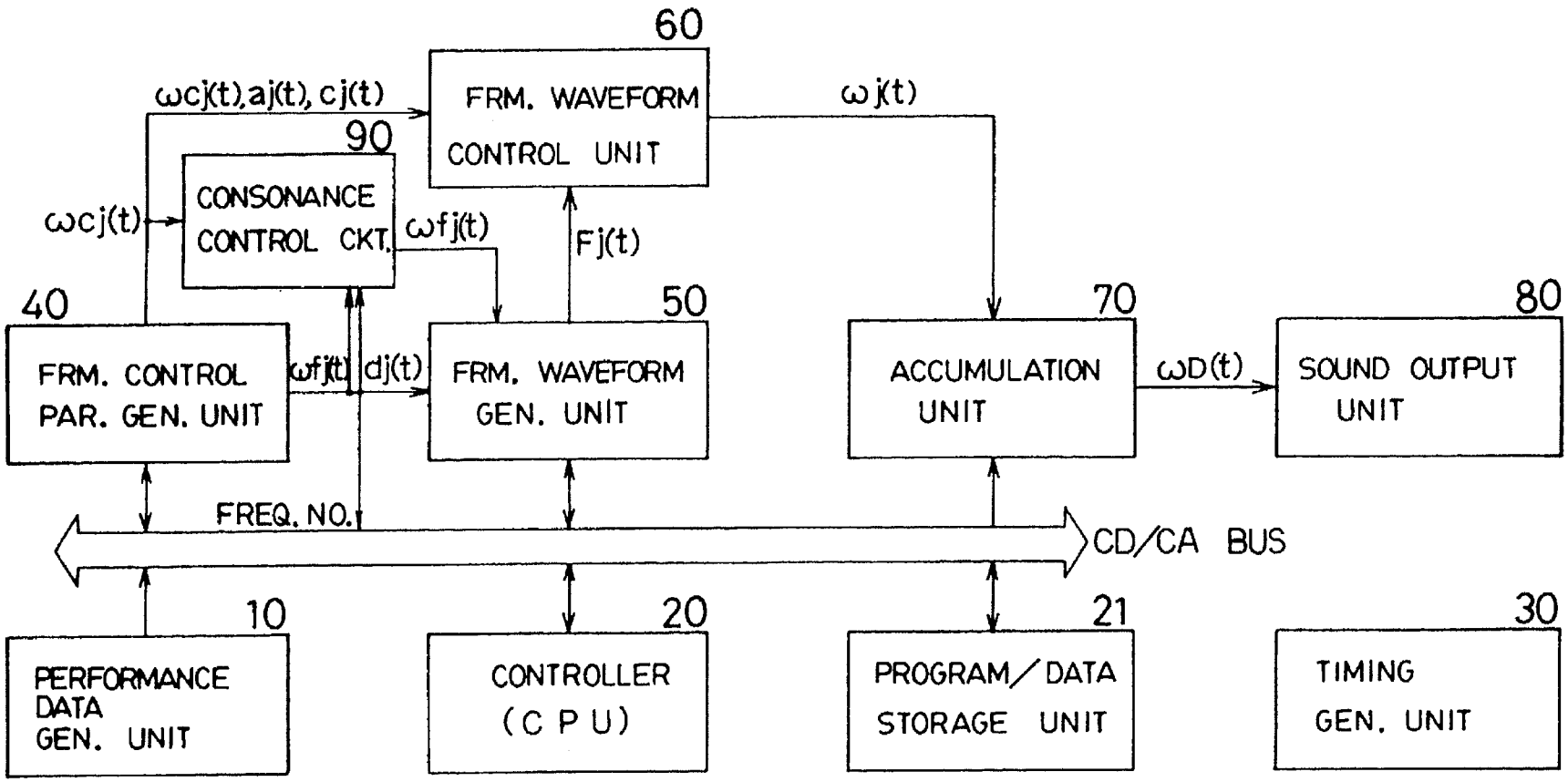
FIG. 33 is a diagram illustrating a whole circuit of a musical tone generating apparatus according to another embodiment.

FIG. 33 is a diagram illustrating the whole circuit according to another embodiment. The frequency number data IN (patch data) time-divisionally read out from an assignment memory 213 of the program/data storage unit 21 by a controller 20, or formant density parameters ω fj(t) or formant carrier parameters ω cj(t) from the formant control parameter generating unit 40, are sent to the consonance control circuit 90.

As for data. FN (ω fj(t), ω c3(t)), the consonance control circuit 90 synthesizes formant carrier parameters ω cj(t) from the formant control parameter generating unit 40 as well as sampling modification data Sfj(t) and synthesized formant consonance data Hj(t) from the controller 20. These data are sent as formant density parameters ω fj(t) to a parameter formant waveform generating unit 50.

The synthesis determines the ratios of frequencies of frequency components of formants of formant waveform signals Ffj(t) and Fj(t) to control the consonance of frequency components of the formants. In this case, the frequency number data FN are directly sent to the consonance control circuit 90 or are processed (subjected to various calculations (1) with other data as will be described later) and are sent to the consonance control circuit 90.

Figure 34:
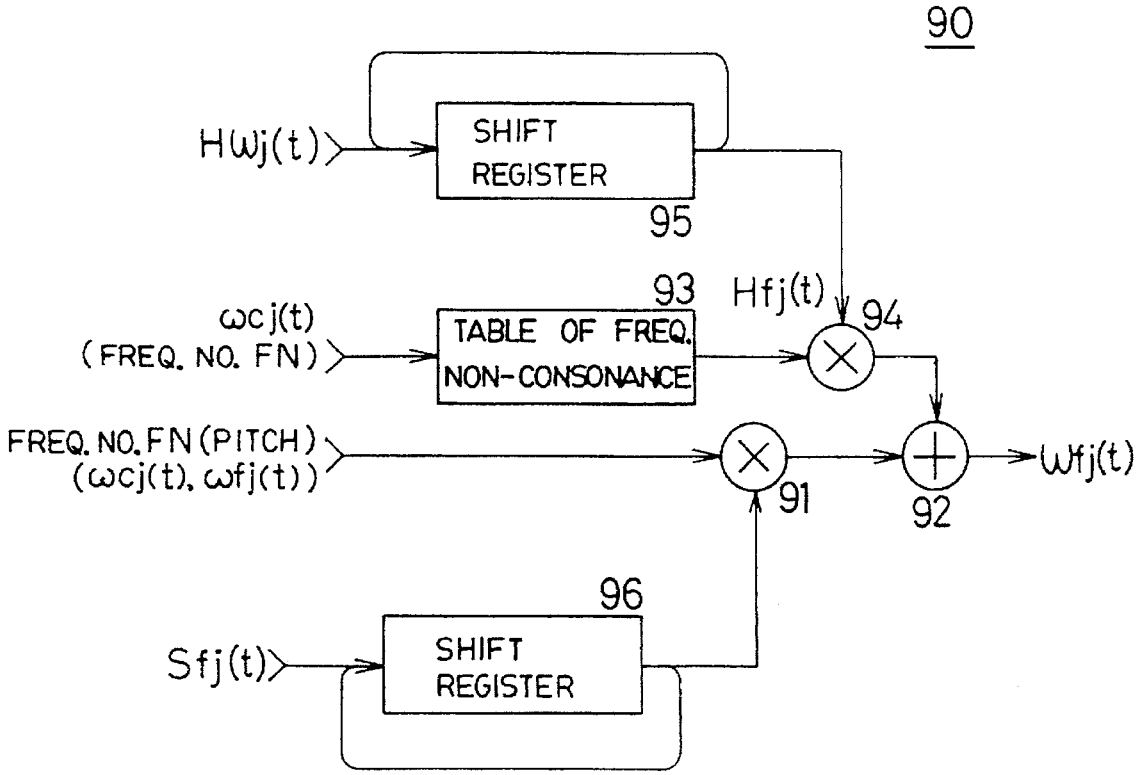
FIG. 34 is a diagram illustrating a consonance control circuit 90.

FIG. 34 is a diagram illustrating the consonance control circuit 90. The frequency number data FN (pitch data)(or formant density parameters ω fj(t) or formant carrier parameters ω ch(t)) are multiplied and synthesized by the sampling modification data Sfj(t) through the multiplier 91, added up with synthesized formant consonance data Hj(t) through the adder 92, and are sent as formant density parameters ω fj(t) to the formant waveform generating unit 50.

The frequency number data FN (pitch data)(or formant density parameters ω fj(t) or formant carrier parameters ω cj(t)) may be stored in a shift register at the start of sounding of musical tone and may then be sent to the multiplier 91 successively. This shift resister is the same as the shift registers 95 and 96 described below.

The formant carrier parameters ω cj(t) (or frequency number data FN) are fed to the table 93 of frequency non-consonance where the frequency formant consonance data Hfj(t) are read out. The frequency formant consonance data Hfj(t) are multiplied and synthesized by the whole formant consonance data Hwj(t) through the multiplier 94 and are sent as the synthesized formant consonance data Hj(t) to the adder 92. The frequency formant consonance data Hfj(t) are weighted by the whole formant consonance data Hwj(t).

The whole formant consonance data Hwj(t) and sampling modification data Sfj(t) that vary depending upon musical factors are read out by the controller 20 from the table 215 of formant consonance and from the table 216 of sampling modification, and are stored in the shift registers 95 and 96, respectively, at the start of sounding musical tone. In this case, the whole formant consonance data Hwj(t) and the sampling modification data Sfj(t) may be once written in the channel memory areas of the assignment memory 213, may be time-divisionally read out by the controller 20 or the like, and may be sent to the consonance control circuit 90.

The shift registers 95 and 96 have shift areas corresponding to the number of channels, the above data are stored at channel timings of channels to which are assigned musical tones synthesized by the formant waveform generating unit 60, and the whole formant consonance data Hwj(t) and sampling modification data Sfj(t) of the channels are output being shifted successively.

Though not diagramed, selectors are provided at the input terminals of the shift registers 95 and 96. The selectors usually select outputs of the shift registers 95 and 96 and feed them back. When the whole formant consonance data Hwj(t) and sampling modification data Sfj(t) are written by the controller 20, selection of the selectors is switched by the controller 20.

The formant density parameters ω fj(t) that are output determine the density of frequency components of formants, i.e., determine the formant width as shown in FIG. 3. When the formant consonance data ω Hj(t) are added to the formant density parameters ω fj(t), therefore, the density of frequency components of formants changes. By suitably selecting a value of the formant consonance data Hj(t) (frequency formant consonance data Hfj(t) or whole formant consonance data Hwj(t)), therefore, the frequency components of formants of the generated musical tone can be set to be an integer number of times or a non-integer number of times.

Figure 37A:
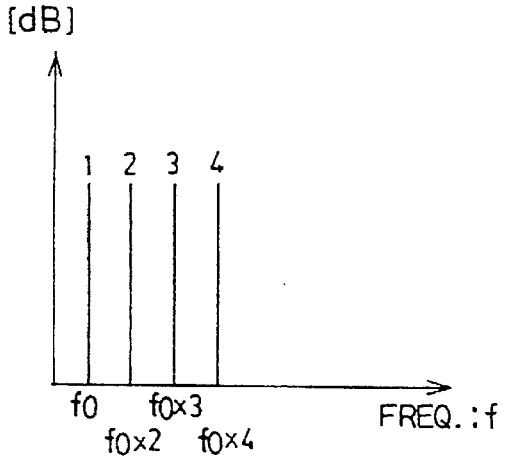
FIG. 37A–37D are diagrams illustrating the cases where the frequencies of frequency components are an integer number of times and a non-integer number of times.
Figure 37B:
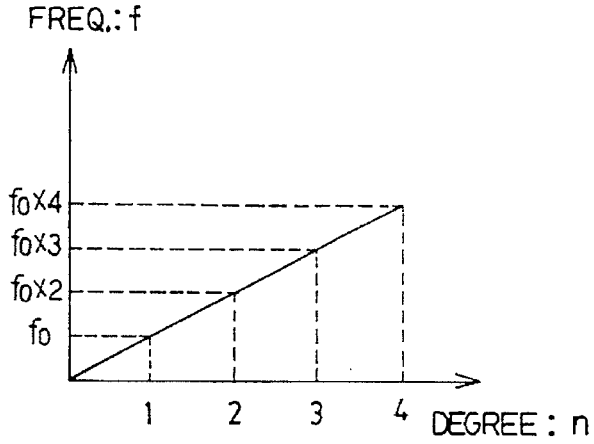
Figure 37C:
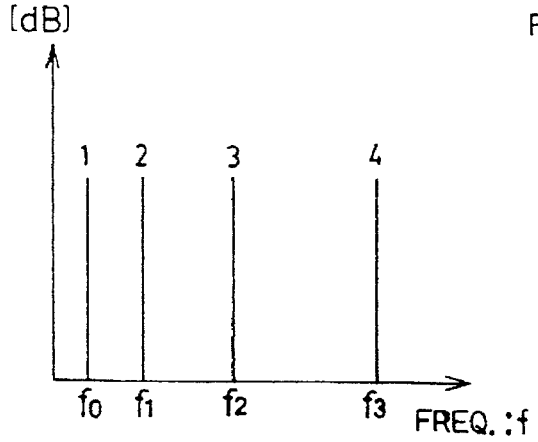
Figure 37D:
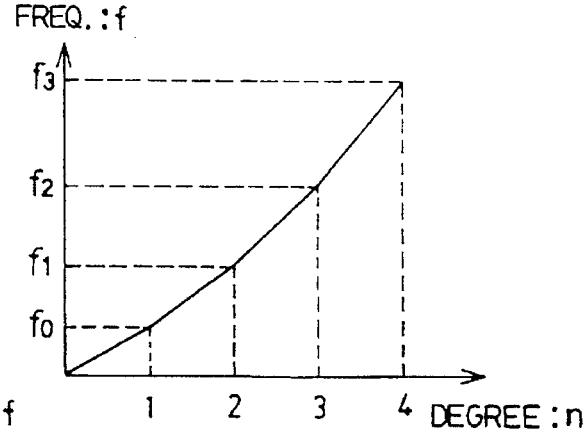

When the frequency values of frequency components are different by an integer number of times, then, the frequency values of frequency components become, for example, 1 time, 2 times, 3 times, 4 times, . . . from the lower side as shown in FIG. 37A and 37B. On the other hand, when the frequency values of frequency components are different by a non-integer number of times, the frequency values of the frequency components do not become 1 time, 2 times, 3 times, 4 times . . . from the lower side but may become, for example, 1 time, 2.2 times, 3.6 times, times, 7 times, 9 times as shown in FIG. 37C and 37D.

The frequency values of frequency components may vary by any other integer number of times or by a quasi-integer number of times as described below. When the frequency values of frequency components are different by a quasi-integer number of times, values of the frequency values of frequency components may vary at ratios of, for example, 1 time, 2 times, 3 times, 4 times, . . . (first formant), 5.1 times, 6.2 times, 7.3 times, 8.4 times, . . . (second formant), 9.6 times, 10.8 times, 12 times, 13.2 times, . . . (third formant).

Figure 35:
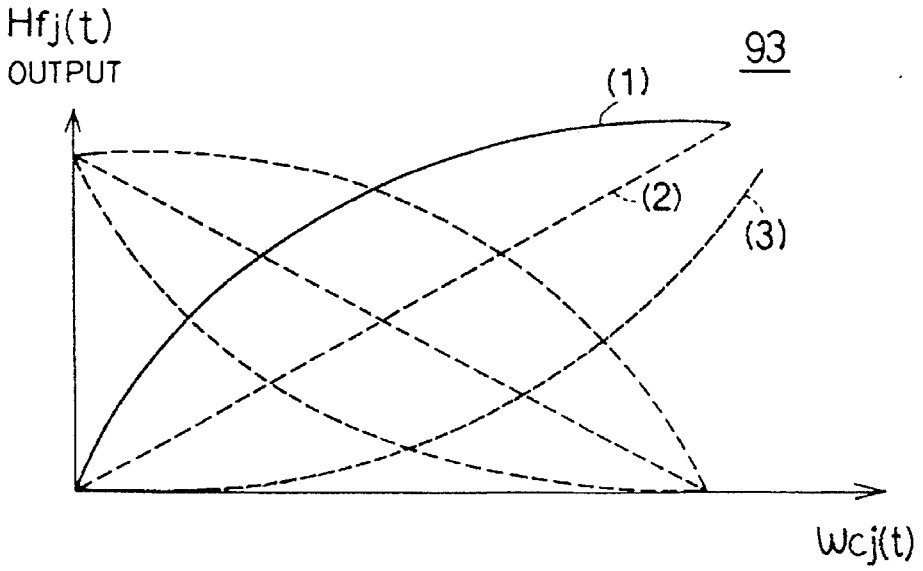
FIG. 35 is a diagram illustrating frequency formant consonance data Hfj(t) of a frequency consonance table 93.
Figure 36A:
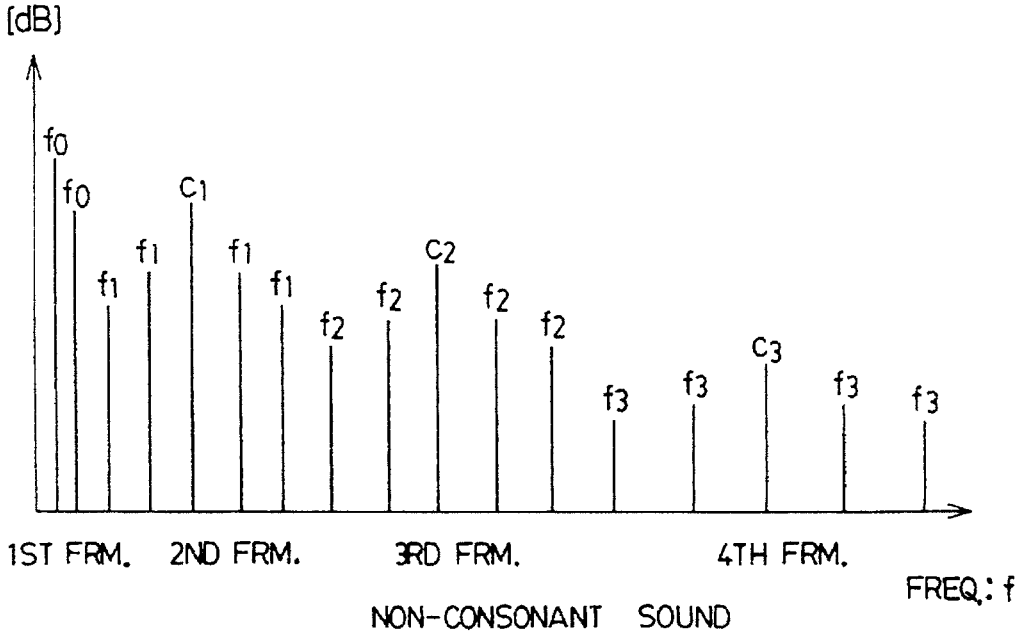
FIG. 36(*a*) and 36(*b*) are diagrams illustrating densities and consonance of frequency components of formants of a musical tone, as well as amplitudes, numbers and center frequencies of formants;.
Figure 36B:
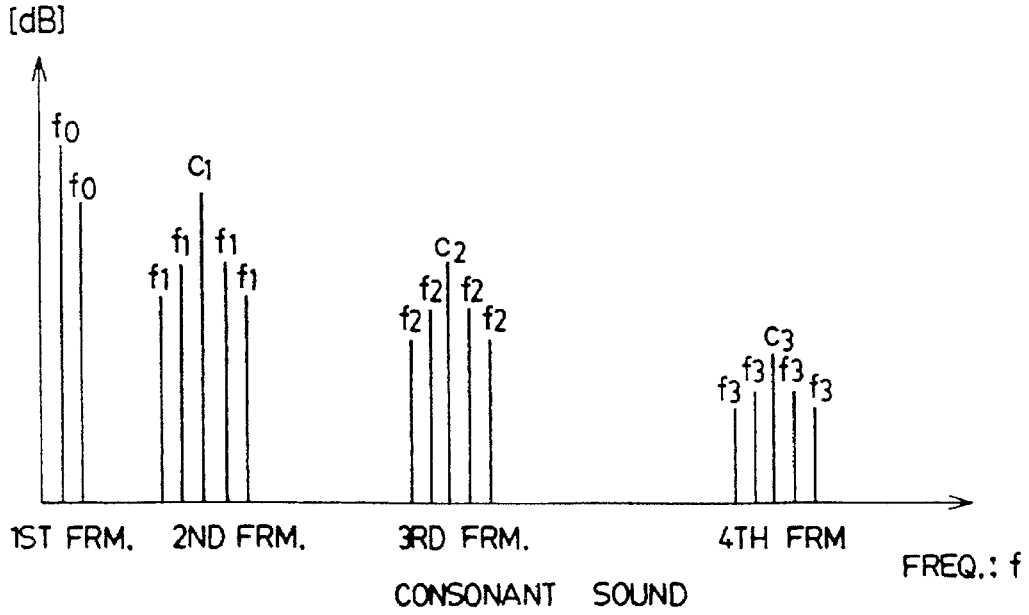

A curve (1) in FIG. 35 represents values of the frequency formant consonance data Hfj(t). The values of the frequency formant consonance data Hfj(t) increase with an increase in the values of the formant carrier parameters ω cj(t). As shown in FIG. 36(*a*), therefore, the densities of frequency components (f0, f1, f2, f3 . . . ) of harmonics of formants decrease and the formant widths increase with an increase in the formant carrier parameters ω cj(t), i.e., with an increase in the frequency values (c0, c1, c2, c3 . . . ) of formant carrier signals Gj(t) at the centers of the formants. In FIG. 36, the formants are those of particular partial frequency bands. The formants, however, may be those of the whole frequency band.

In this curve (1), changes in the frequency formant consonance data Hfj(t) are different from and smaller than changes in the formant carrier parameters cj(t). Referring to three formants of a musical tone, for instance, it is now simply presumed that formant center signals of the first formant has a frequency of 200 Hz, two harmonic frequencies of formant waveform signals of the first formant are 100 Hz and 300 Hz, formant center signals of the second formant has a frequency of 520 Hz, two harmonic frequencies of formant waveform signals of the second formant are 410 Hz and 630 Hz, formant center signals of the third formant has a frequency of 870 Hz, and two harmonic frequencies of formant waveform signals of the third formant are 750 Hz and 990 Hz.

Then, a ratio of frequency values of formant center signals of these formants become 1:2.6:4.35, and a ratio of differences (gaps) values among the frequencies of harmonics of formant waveform signals of the formants become 1:1.1:1.2. In this case, the pitch data, i.e., the frequency number data FN acquire a value that corresponds to 200 Hz. As the frequency number data FN (pitch data) undergo a change, the frequencies of formant center signals and harmonic frequencies of formant waveform signals undergo a change being interlocked thereto. In this case, the ratios 1:2.6:4.35 and 1:1.1:1.2 do not change. The above ratios, however, change accompanying a change in the frequency formant consonance data Hfj(t) or in the whole formant consonance data Hwj(t).

The frequencies of the above formant center signals and the two harmonic frequencies of the formant waveform signals are only a few examples and may assume other values or other ratios, and the number of harmonics of the formant waveform signals may be not smaller than 2.

On the other hand, when the values of the whole formant consonance data Hwj(t) become "0", the formant carrier parameters ω cj(t) assume the same value for all formants as shown in FIG. 36(*b*) and the densities of frequency components of harmonics become the same for all formants. Accordingly, ratios of frequencies of frequency components of the formants change, i.e., densities of frequency components of the formants change, enabling consonance of frequencies of the tone to be controlled. The frequency formant consonance data Hfj(t) may have such values that the values of the formant carrier parameters ω cj(t) are 1 time, 2 times, 3 times, 4 times, . . . .

Since the values of the formant density parameters ω fj(t) are determined depending upon the frequency number data =N (pitch data), densities of frequency components of the formants are shifted depending upon the pitch of the musical tone and the formants are controlled depending upon the pitch.

As described above, the frequency number data FN (pitch data) fed to the multiplier 91 can be substituted by the formant density parameters ω fj(t) or the carrier parameters ω c3(t). Values of the formant density parameters ω fj(t) are determined by the substituted formant carrier parameters ω cj(t), and densities of frequency components of the formants are shifted depending upon the pitch of the tone and the formants are controlled depending upon the frequency of formant carrier signals Gj(t). By being substituted by the formant density parameters ω fj(t), furthermore, the formant density parameters ω fj(t) themselves are controlled, modified and changed by various factors and are output.

As described above, furthermore, the formant density parameters ω fj(t) fed to the table 93 of frequency non-consonance can be substituted by the frequency number data FN (pitch data). Values of the frequency formant consonance data Hfj(t) are determined by the substituted frequency number data FN, and ratios of frequencies of frequency components of formants of the formant waveform signals Fj(t) are controlled by the pitch of the musical tone.

The processing and control of consonance in the consonance control circuit 90 are carried out time-divisionally for the frequency number data FN and for the formant carrier parameters ω cj(t) (formant density parameters ω fj(t)). The frequency number data FN, formant density parameters ω fj(t) and formant carrier parameters ω cj(t) are stored in the assignment memory 213 shown in FIG. 26.

In this case, the frequency number data FN, formant density parameters ω fj(t), formant carrier parameters ω cj(t), repeat top data Ta, repeat end data Ea, and data SP, O, Min, etc. stored in the assignment memory 213 of FIG. 26 exist in a plurality of sets or in one set for each musical tone. When these data exist in a plurality of sets, the data of a number equal to the plural number are simultaneously written in the channel memory areas.

When these data exist in a plurality of sets, some data in each set may have the same value. In this case, some of the kinds, amplitudes or formant densities of formant waveform signals Ffj(t), Fj(t), as well as frequencies or amplitudes of formant center signals Gj(t) of formants of a musical tone will become the same.

In the consonance control circuit 90 of FIG. 34, the multiplier 91 and the adder 92 may be omitted and the output from the multiplier 94 may be made to formant carrier parameter ω cj(t), or the adder 92 may be omitted and the output from the multiplier 91 may he made to formant carrier parameter ω cj(t). Furthermore, the shift register 96 and the multiplier 91 may be omitted and the frequency number data FN may be directly fed to the adder 92, or the shift register 95 and the multiplier 94 may be omitted and the frequency formant consonance data Hfj(t) may be directly fed to the adder 92 from the table 93 of frequency non-consonance, or the table 93 of frequency non-consonance and the multiplier 94 may be omitted and the whole formant consonance data Hwj(t) may be directly fed to the adder 92 from the shift register 95. Moreover, the data in the multipliers 91, 94 and in the adder 92 may be batchwisely synthesized by using a multi-input multiplier or a multi-input adder.

26. Table 214 of Formant Centers

FIG. 38 shows a table 214 of formant centers in the program/data storage unit 21. One of the table 214 of formant centers and the above-mentioned table 212 of formant forms are selectively used by an operator who selectively manipulates a group of panel switches on the performance data generating unit 10. In the table 214 of formant centers are stored ratio data of the formant carrier parameters ω cj(t) having various values for each of the musical factors, lapses of time from the start of sounding, envelope levels or envelope phases.

In addition to the formant carrier parameters ω cj(t), the table 214 of formant center stores the formant density parameters ω fj(t), repeat top data Ta, repeat end data Ea, target data O, and mini-data Min having various values each of the musical factors, lapses of time from the start of sounding, and envelope levels or envelope phases. These data can be input by the operator through the performance data generating unit 10.

The data are stored in a multiplexed manner for each of the musical factors, lapses of time from the start of sounding, envelope phases or envelope levels. For instance, the data are stored for each of a plurality of timbres. Among them, the data of a timbre are stored for each of the tone pitch ranges each part of musical instrument. Among them, the data of one tone pitch range or a part of musical instrument are stored for each of touches. Among them, the data of one touch are atered for the lapses of time from the start of sounding, for each of the envelope phases or for each of the envelope levels.

In this case, the above-mentioned musical factors may be synthesized with formant control parameters Valj and time data that change depending upon the envelope data or upon the lapses of time in compliance with various calculations (1) that will be described later.

The data may not be stored for each of the lapses of time from the start of sounding or for each of the envelope levels, lapses of time from the start of sounding or the envelope levels may be modified and synthesized for the ratio data of formant carrier parameters ω cj(t), formant density parameters ω fj(t), repeat top data Ta, repeat end data Ea, speed data SP, target data 0 and mini-data Min. The modification and synthesis are carried out in compliance with various calculations (1) that will be described later, and arithmetic units for modifying and synthesizing the lapses of sounding time or envelope levels are provided at the output the parameter storage unit 41 or at the output terminal of the function calculation unit 42 of FIG. 5, at the output terminal of the formant density storage unit 52 through up to terminal of the phase calculation unit 51 of FIGS. 10 and 28, at the input terminal of an exclusive OR gate group 512 and at the input terminal of the selector 513 of FIG. 13, at the input terminal of the adder 62 of FIG. 15, at the input terminal of the table 93 of frequency non-consonance of FIG. 34, and at the input terminal of the multiplier 91 of FIG. 34.

Based upon the ratio data of the formant carrier parameters ω cj(t), there are generated formant carrier signals Gj (t) of a plurality of formants that are simultaneously formed in one musical tone. Among the formants, a formant carrier parameter ω cj (t) of a formant carrier signal Gj (t)(c1) having the lowest frequency acquires a value equal to, or corresponding to, the frequency number data FN that correspond to a designated tone pitch. Therefore, the ratio data of formant carrier parameter ω cj(t) of a formant carrier signal Gj(t)(cl) having the lowest frequency of a musical tone acquires "1" or is not recorded.

Ratio data of formant carrier parameters ω cj(t) of other formant carrier signals Gj(t)(c2, c3, c4, . . . ) become the ratio data of other formant carrier signals Gj(t)(c2, c3, c4, . . . ) relative to the formant carrier signal Gj(t)(cl) having the lowest frequency. Accordingly, the frequency of formant carrier signals Gj(t) is determined depending upon the designated tone pitch.

Accordingly, the value (frequency) or number of ratio data of the formant carrier parameters ω cj(t) changes for each of the musical factors, lapses of time from the start of sounding, and for each of the envelope levels or envelope phases. Accordingly, the frequency or number of a plurality of carrier signals Gj(t) is controlled depending upon the musical factors. As the number of the formant carrier signals Gj(t) changes, the number of channels assigned to a musical tone changes corresponding thereto. In this case, only the value of ratio data of the formant carrier signal Gj(t)(c1) having the lowest frequency may be regarded to be constant or zero, therefore the above-mentioned value (frequency) or the number may be inhibited from changing.

Moreover, the values of speed data SP, target data O and mini-data Min change for each of the musical factors, for the lapses of time from the start of sounding, for each of the envelope levels or envelope phases. Accordingly, the amplitudes aj(t) of a plurality of formant carrier signals Gj(t) calculated relying upon these data SP, O and Min, are controlled depending upon the musical factors, etc. In this case, only the value of the formant carrier signal Gj(t)(cl) having the lowest frequency only may be regarded to be constant to inhibit the amplitudes aj(t) from changing.

The ratio data of these parameters ω cj(t), ω fj(t), and data Ta, Ea, SP, O and Min can be switched and selected by the operator, i.e., can be input and designated by the operator using a group of panel switches on the performance data generating unit 10. In this case, the corresponding parameters and data are written into the table 214 of formant centers depending upon the selective switching. The frequency or number of formant carrier signals Gj(t) of a musical tone also changes, the formant carrier signals Gj(t) of a musical tone being generated depending upon the musical factors, lapses of time from the start of sounding, and depending upon change in the envelope phase or envelope level.

As described above, the musical factors are input from the performance data generating unit 10, the lapses of time from the start of sounding are represented by formant control parameters Valj, accumulated formant density parameters Σω fj(t), accumulated formant carrier parameters Σω cj(t) or tame count data, the envelope level data are represented by the formant control parameters a3(t), and the envelope phase is based upon the number of counts of the request data Req.

Among the ratio data of formant carrier parameters cj(t), formant density parameters ω fj(t), repeat top data Ta, repeat end data Ra and data SP, O and Min, those data which are corresponding thereto are determined, read out and are written by the controller 20 into the channel memory area which are corresponding to the assigned channels of the assignment memory 213.

Among the data that are written, the data SP, O and Min are sent to the formant control parameter generating unit 40, the repeat top data Ta, formant density parameters ω fj(t) and repeat end data Ea are sent to the formant waveform generating unit 50, and the ratio data of formant carrier parameters ω cj(t) are multiplied by the frequency number data FN a designated tone pitch to find formant carrier parameters ω cj(t) which are then sent to the formant waveform control unit 60 to change the number and shape of the synthesized formants.

The data are sent by the controller 20 at each of the corresponding channel timings. The method of sending data has been described in the specifications and drawings of Japanese Patent Applications Nos. 01-42298 (U.S. Pat. No. 5,107,747), 01-305818 (U.S. Pat. No. 5,095,800), 01-312175, 02-208917 (U.S. Pat. No. 5,410,099), 02-409577 and 02-409578 (U.S. Pat. No. 5,315,059).

In the table 214 of formant centers can be further stored the aforementioned formant control parameters cj(t) and dj(t) of fixed values depending upon musical factors, lapses of time from the start of sounding, envelope phases or envelope levels or depending upon formant carrier parameters ω cj(t), formant density parameters ω fj(t), repeat top data Ta and repeat end data Ea. The formant carrier signals Gj(t) and formant waveform signals Fj(t) generated as described above by the formant control parameter generating unit 40 of FIG. 5 and by the formant waveform generating unit 50 of FIG. 10 or 28 depending upon the parameters ω cj(t), ω fj(t) and data Ta, Ea, SP, O, Min., are synthesized by the circuit of FIG. 15, 19, 20, 21, 24, 29, 30 or 32 as described earlier.

The formant density parameters ω f3(t) may be different or the same and single, the repeat top data Ta or the repeat end data Ea may be different or the same and single, or the data SP, O and Min may be different or the same and single, for the ratio data of the formant carrier parameters ω cj(t).

Thus, densities of frequency components of formants of FIG. 36, shapes of formant waveform signals Fj(t) of formants, amplitudes or biases of formant carrier signals Gj(t) and biases of formant waveform signals Fj(t), can be controlled differently from each other or in the same manner in synchronism. The formants of FIG. 36 are those of particular partial frequency bands. The formants, however, may be those of the whole frequency band.

Among the ratio data of formant carrier parameters cj(t), formant density parameters ω fj(t), repeat top data Ta, repeat end data Ea and data SP, O, Min that are stored for each of the musical factors, only those corresponding to the lapses of time from the start of sounding may be omitted.

Instead, in this case, the accumulated formant carrier parameters Σω cj(t) or formant carrier parameters ω cj(t), formant control parameters aj(t), cj(t) of the formant waveform generating unit 60 or weighting interpolation circuit 80 of FIGS. 15, 19, 21, 24 and 28, and accumulated formant density parameters Σω fj(t) or formant density parameters ω fj(t), formant control parameters dj(t) and speed data SP of FIG. 10, are calculated and synthesized with formant control parameters Valj representing the lapses of time from the start of sounding, accumulated formant density parameters Σω fj(t), accumulated formant carrier parameters Σω cj(t) or time count data. The calculation and synthesis are carried out in compliance with various calculations (1) that will be described later.

27. Frequency formant consonance data Bfj(t)

As described earlier, the curve (1) of FIG. 35 represents values of frequency formant consonance date Rfj(t) of the table 93 of frequency non-consonance. The frequency formant consonance data Bfj(t) are read out from the table 93 of frequency non-consonance with the formant carrier parameter ω cj(t) serving as the low-order read address data. The frequency formant consonance data Hfj(t) increase cumulatively with an increase in the formant carrier parameters ω cj(t). Besides, changes in the values of frequency formant consonance data Hfj(t) are smaller than, and are different from, changes in the values of the formant carrier parameters ω cj(t), and are given, for example, as follows:

$$Hfj(t)=a\times\omega\times cj(t)<b\times n>$$

(n=1, 2, . . . , a, b: constants)

$$Hfj(t)=a\times\{exp(b\times\omega\times cj(t))-1\}$$

(a, b: constants)

where <b×n> represents that b×n is an exponent of a×ω×cj(t).

The frequency formant consonance data Hfj(t) may have characteristics as represented by broken lines in FIG. 35 for the formant carrier parameters ω cj(t). Referring to a straight line (2), the frequency formant consonance data Bfj(t) increase with an increase in the formant carrier parameters ω cj(t), and the values of frequency formant consonance data Hfj(t) are larger than, and are different from, changes in the values of the formant carrier parameters ω cj(t).

Referring to a curve line (3), the frequency formant consonance data Hfj(t) increases with an increase in the formant carrier parameters ω cj(t), and changes in the values of the frequency formant consonance data Hfj(t) are the same as the changes in the values of the formant carrier parameters ω cj(t). Referring to other curves, the frequency formant consonance data Hfj(t) decrease with an increase in the formant carrier parameters ω cj(t). In these cases, ratios of changes in the frequency formant consonance data Hfj(t) increase, decrease, or remain unchanged.

The frequency formant consonance data Hfj(t) have been stored in an multiplexed manner in the table 93 of frequency non-consonance for each of the musical factors, lapses of time from-the-start of sounding, envelope levels or envelope phases like the aforementioned data SP, O, Min, Ta, Ea, formant waveform signals Ffj(t), formant density parameters ω fj(t), formant carrier parameters ω cj(t), n sets of parameters ω cjk(t), ajk(t), cj(t), the data stored in the table 212 of formant forms or the data stored in the table 214 of formant centers.

As described above, musical factors are output from the performance data generating unit 10, lapses of time from the start of sounding are represented by formant control parameters Valj (depending upon the cases, accumulated formant density parameters Σω fj(t) or accumulated formant carrier parameters Σω cj(t)) or time count data, the envelope data are represented by the formant control parameters aj(t) (Valj(t)) and the envelope phase is based upon the number of counts of the request data Req.

The data of these musical factors are fed to the table 93 of frequency non-consonance as high-order read address data. Moreover, the frequency formant consonance data Hfj(t) for each of the musical factors can be selectively read out by the operator using selection data (high-order read address data) input through the group of panel switches on the performance data generating unit 10. The frequency formant consonance data Hfj(t) are input by the operator through the performance data generating unit 10.

In this case, the musical factors may be synthesized with formant control parameters Valj(t) or time count data that change depending upon the envelope data or the lapses of time in compliance with various calculations (1) that will be described later.

The data may not be stored for each of the lapses of time from the start of sounding or for each of the envelope levels, and the lapses of time from the start of sounding or the envelope levels may be modified and synthesized for the frequency formant consonance data Hfj(t). The modification and synthesis are carried out in compliance with various calculations (1) that will be described later. An arithmetic unit for modifying and synthesizing the lapses of sounding time or the envelope levels is provided at the output terminal of the table 93 of frequency non-consonance of FIG. 34.

28. Whole formant consonance data Hwj(t)

FIG. 39 illustrates the whole formant consonance data Hwj(t) in the table 215 of formant consonance stored in the program/data storage unit 21. The whole formant consonance data Hwj(t) have values of between, for example, "0" and "1" and are multiplied by the frequency formant consonance data Hfj(t) through the multiplier 94. Therefore, the values of frequency formant consonance data Hfj(t) are weighted and the frequency formant consonance data Hfj(t) become "0" when the whole formant consonance data Hwj(t) are "0".

The whole formant consonance data Hwj(t) are stored in a multiplexed manner in the table 215 of formant consonance for each of the musical factors, for the lapses of tame from the start of sounding and for each of the envelope levels or envelope phases like the aforementioned data SP, O, Min, Ta, Ea, formant waveform signals Ffj(t), formant density parameters ω fj(t), formant carrier parameters ω cj(t), n sets of parameters ω cjk(t), ajk(t), cj(t) and frequency formant consonance Hfj(t), the data stored in the table 212 of formant forms or the data stored in the table 214 of formant centers.

As described above, the musical factors are output from the performance data generating unit 10, the lapses of time from the start of sounding are represented by formant control parameters Valj (or depending upon the cases, accumulated formant density parameters Σω fj(t) or accumulated formant carrier parameters Σω cj(t)) or time count data, the envelope level data is represented by the formant control parameters aj(t) (Valj(t)), and the envelope phase is based upon the counted number of the request data Req.

The data such as the musical factors are fed as read address data to the table 215 of formant consonance. The whole formant consonance data Hwj(t) for each of the musical factors can be selectively read out by the operator using selection data (read address data) input through the group of panel switches on the performance data generating unit 10. Moreover, the whole formant consonance data Hwj(t) can be input by the operator through the performance data generating unit 10.

In this case, the musical factors are synthesized with the formant control parameters Valj and time count data that change depending upon the envelope data or the lapses of time in compliance with various calculations (1) that will be described later. The data may not be stored for each of the lapses of time from the start of sounding or for each of the envelope levels and, instead, the lapses of time from the start of sounding or the envelope levels may be Edified and synthesized for the whole formant consonance data Hwj(t). The modification and synthesis are carried out in compliance with various calculations (1) that will be described later, and a calculation circuit for modifying and synthesizing the lapses of sounding time or the envelope levels is provided at the input terminal of the shift register 95 of FIG. 34.

The whole formant consonance data Hwj(t) may have values other than "0" to "1", such as "0" to "2", "0" to "10", "0" to "1/10, "0" to −1", "0" to "−10", etc.

29. Sampling modification data Sfj(t)

The sampling modification data Sfj(t) modifies densities of frequency components of formants of formant waveform signals Ffj(t) sampled and stored in the formant waveform memory 53. For instance, the formant waveform signals Ffj(t) are sampled and stored in response to sampling signals had frequency fs. As the formant waveform signals Ffj(t) that are sampled and stored are read out with address data that increases at a frequency fa (fs, ½fs, 3fs . . . ), differences among the frequency components of formants of the formant waveform signals Ffj(t) that are read out become fs, ½fs, 3fs, . . . .

Conversely, as the rate of increase of the reading address data—had a frequency fa=fs and the frequencies of write sampling signals of formant waveform signals Ffj(t) are fs, 2fs, ⅓fs, . . . , differences among the frequency components of formants of the formant waveform signals Ffj(t) that are read out become fs, ½fs, 3fs, . . . . The rate of increase of reading address data is determined by the values of formant density parameters ω fj(t) and by the accumulating rate of formant density parameters ω fj(t), i.e., by a frequency value of the system clock of the apparatus. Therefore, when the frequency fs of write sampling signals of the formant waveform signals Ffj(t) changes, the values of the formant density parameters fj(t) must be modified correspondingly.

This is the sampling modification data Sfj(t). When the values of the formant density parameters ω fj(t) are determined based upon a stored sampling frequency fs1 that serves as a reference and the formant waveform signals Pfj(t) are stored corresponding thereto, the sampling modification data Sfj(t) becomes ratio data fs1/fs2 when the practically stored sampling frequency is "fs2".

Thus, the formant waveform signals Ffj(t) can be sampled by sampling signals of any frequency and are stored. The formant waveform signals Ffj(t) are sampled and stored in the formant waveform memory 53 by using a widely known sampling/storing system.

Among the sampling modification data Sfj(t), those corresponding to formant waveform signals Ffj(t) read out from the formant waveform memory 53 are read out from the table 216 of sampling modification by the controller 20 and are stored in the shift register 96.

When the stored sampling frequency fs of the formant waveform signals Ffj(t) differs for each of the musical factors, lapses of time from the start of sounding, envelope levels or envelope phases, the sampling modification data Sfj(t) may have (assume) values that change corresponding thereto. When the stored sampling frequency fs of the whole formant waveform signals Ffj(t) remains constant, the sampling modification data Sfj(t) and the multiplier 92 may be omitted.

The sampling modification data Sfj(t) may be stored in a multiplexer manner, as shown in FIG. 40, in the table 216 of sampling modification in the program/data storage unit 21 for each of the musical factors, lapses of time from the start of sounding, envelope levels or envelope phases. The storage of data is the same as the storage of the aforementioned data SP, O, Min, Ta, Ea, formant waveform signals Ffj(t), formant density parameters ω fj(t), formant carrier parameters ω Cj(t), n sets of parameters ω cjk(t), ajk(t), cj(t), frequency formant consonance data Hfj(t), the data stored in the table 212 of formant forms, the data stored in the table 214 of formant centers and the data stored in the table 215 of formant consonance.

As described above, the musical factors are output from the performance data generating unit 10, the lapses of time from the start of sounding are represented by formant control parameters Valj (depending upon the cases, accumulated formant density parameters Σω fj(t) or accumulated formant carrier parameters Σω cj(t)) or time count data, the envelope level is represented by the formant control parameters aj(t) (valj(t)), and the envelope phase is based upon the counted number of the request data Req.

The data such as those musical factors are fed as reading address data to the table 216 of Sampling modification. The sampling modification data Sfj(t) at every musical factors can be selectively read out by the operator even by using selection data (read address data) input through the group of panel switches on the performance data generating unit 10. Moreover, the sampling modification data Sfj(t) can be input by the operator through the performance data generating unit 10.

In this case, the musical factors are synthesized with the formant control parameters Valj and time count data that change depending upon the envelope data or the lapses of time in compliance with various calculations (1) that will be described later. Here, the data may not be stored for the lapses of time from the start of sounding or for the envelope levels and, instead, the lapses of time from the start of sounding or the envelope levels may be modified and synthesized for the sampling modification data Sfj(t). The modification and synthesis are carried out in compliance with various calculations (1) that will be described later, and an arithmetic unit for modifying and synthesizing the lapses of sounding time of the envelope levels is provided at the input terminal of the shift register 96 of FIG. 34.

The above sampling modification data Sfj(t) may be a difference data (fs1 - fs2), and the formant density parameters ω fj(t) may be added up and synthesized with the sampling modification data Sfj(t) instead of being multiplied and synthesized thereby. In this case, the multiplier 91 becomes the adder. The formant carrier parameters ω cj(t) (frequency number data FN) may be modified with the sampling modification data Sfj(t) and may then be fed to the table 93 of frequency nonconsonance. In this case, the multiplier 91 or the adder is provided in front of the table 93 of frequency nonconsonance, and the values of sampling modification data Sfj(t) may vary.

Moreover, the formant consonance data Hj(t) and the frequency number data FN (formant carrier parameters ω cj(t), formant density parameters ω fj(t)) may be synthesized through the adder 92 in compliance with various calculations (1) that will be described later.

The frequency formant consonance data Hfj(t) or the whole formant consonance data Hwj(t) is worked out from the formant control parameters Valj representing musical factors, lapses of time from the start of sounding, etc. in compliance with various calculations (2) that will be described later. The frequency formant consonance data Mfj(t) and the whole formant consonance data Hwj(t) may be synthesized together in compliance with various calculations (1) that will be described later.

Moreover, either the frequency formant consonance data Hfj(t) or the whole formant consonance data Hwj(t) may be omitted, and the read address data in the table 93 of frequency non-consonance may be either the formant carrier parameters cj(t) or the parameters Valj based on the musical factors.

Moreover, the data obtained by synthesizing the frequency formant consonance data Hfj(t), whole formant consonance data Hwj(t) and sampling modification data Sfj(t) may be stored in the table. In this case, the parameters Valj representing musical factors, formant density parameters ω fj(t) and formant carrier parameters ω cj(t) are used as read address data.

Furthermore, the frequency formant consonance data Hfj (t) and the whole formant consonance data Hwj(t) may be stored individually instead of in a multiplexed manner for each of the musical factors, for the lapses of time from the start of sounding or for each of the envelope levels or envelope phases, and the frequency formant consonance data Hfj(t) and the whole formant consonance data Hwj(t) may be read out depending upon the musical factors and may further be synthesized in compliance with various calculations (1) that will be described later.

30. Formant waveform generating unit 60

Figure 41:
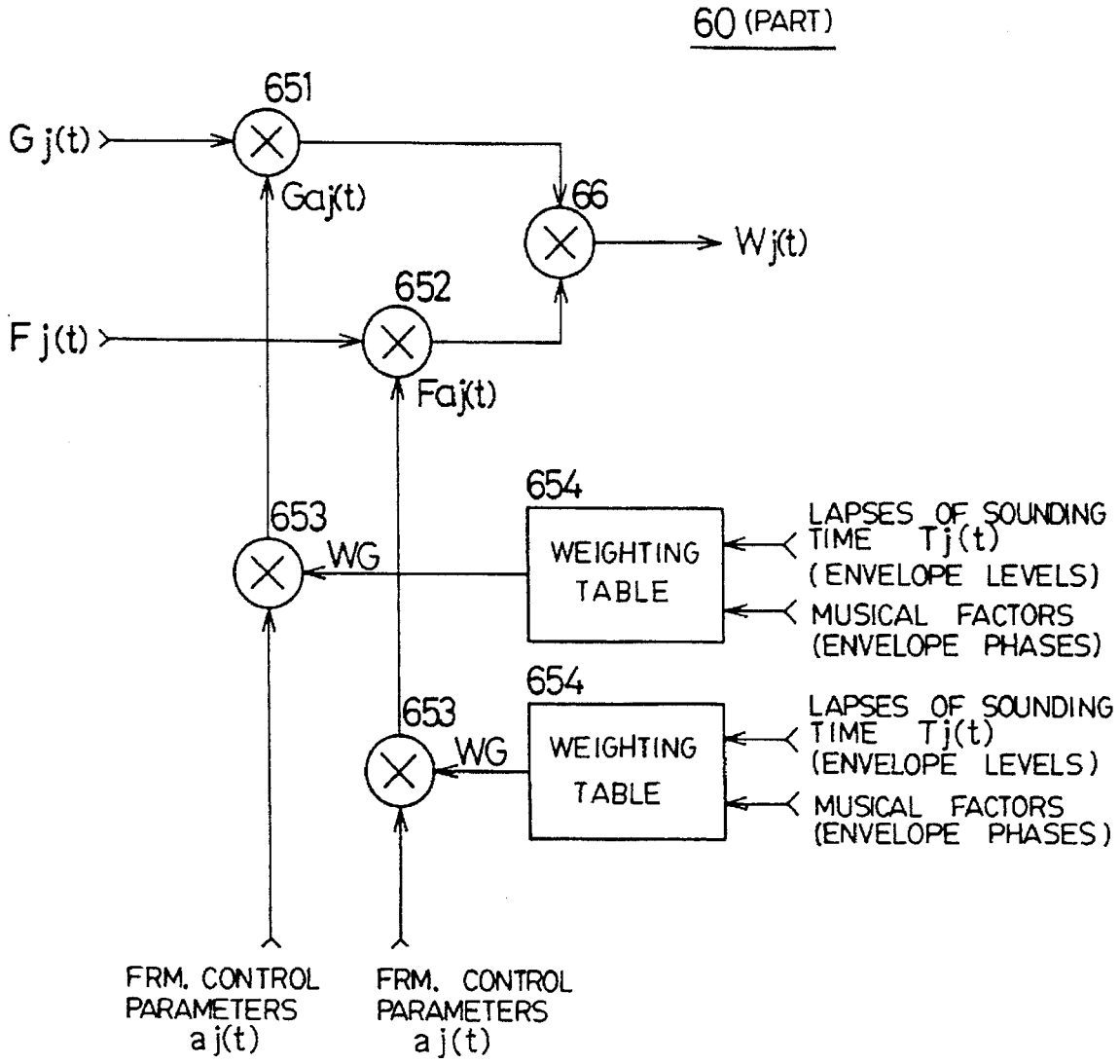
FIG. 41 is a diagram of a formant waveform-generating unit 60 according to a fifth embodiment.
Figures 42A, 42B, 42C, 42D, 42E, 42F:
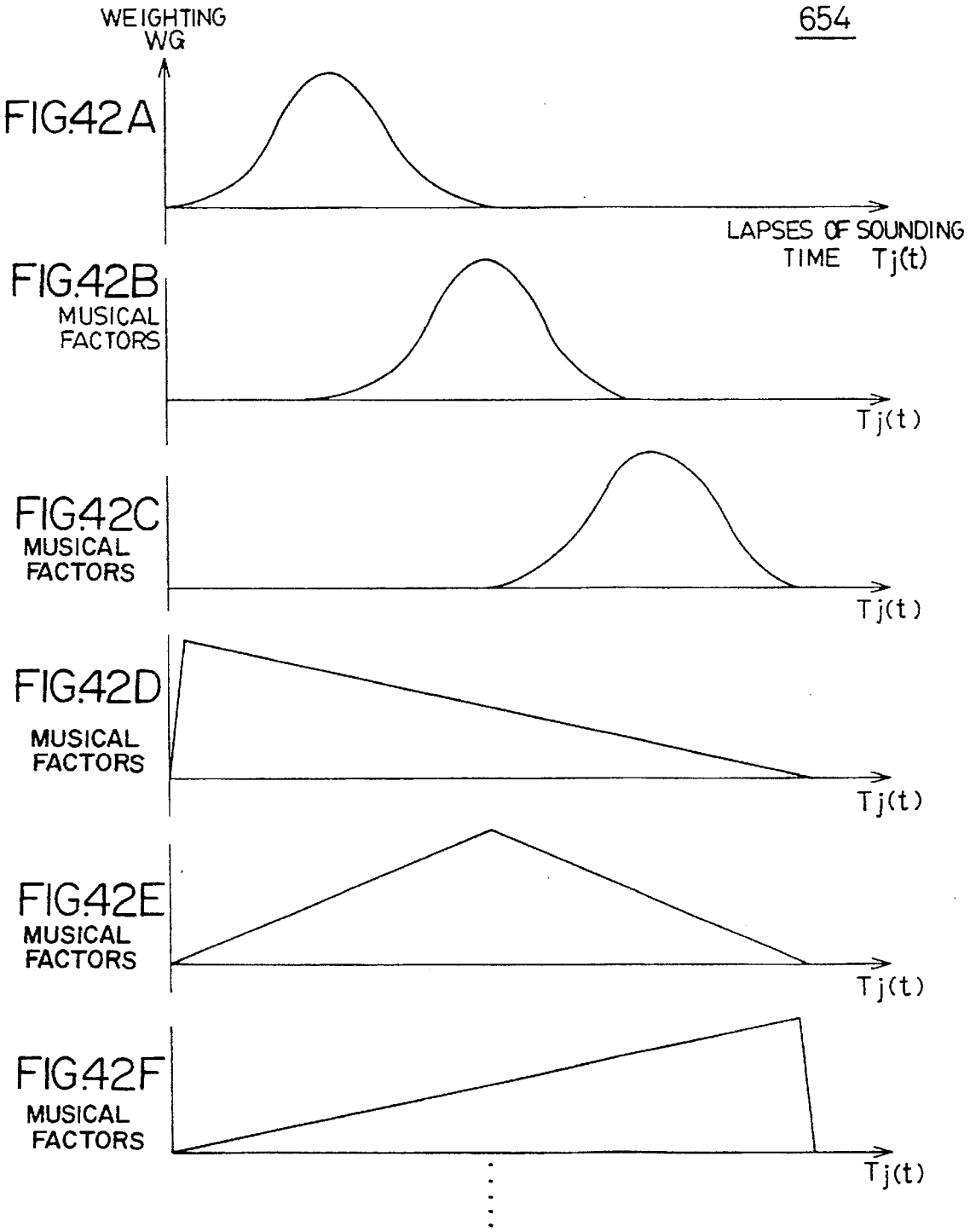
FIG. 42A–42F are diagrams illustrating weighting data WG in a weighting table 654.

FIG. 41 illustrates the formant waveform generating unit 60 according to another embodiment. Formant carrier signals Gj(t) generated by the above-mentioned various methods are sent to a multiplier 651 where carrier amplification data Gaj(t) are multiplied and synthesized in a time-divisional manner, controlled for their amplitude and are sent to a multiplier 66. Formant waveform signals Fj(t) generated by the above-mentioned various methods are sent to a multiplier 652 where waveform amplification data Faj(t) are multiplied and synthesized in a time-divisional manner, controlled in amplitude and are sent to the multiplier 66. In the multiplier 66, the formant carrier signals Gj(t) and formant waveform signals Fj(t) of which the amplitudes are controlled are multiplied and synthesized in a time-divisional manner and are output.

The time-divisional processing of the formant waveform generating unit 60 is carried out for each formant or for each musical tone. When the formant waveform signals Pj(t) and formant carrier signals Gj(t) are generated in parallel for each formant or for each musical tone, the multipliers 651, 652 and 66 are provided in many number, and outputs of the multipliers 66 . . . are added up together through the adder. The multipliers 651 . . . , 652 . . . may be replaced by adders, data shifters, calculation circuits or memories to control amplitudes in compliance with various calculations (1) that will be described later.

The formant waveform signals Fj(t) and the formant carrier signals Gj(t) may be synthesized in a manner other than the above-mentioned multiplication. Moreover, either the multipliers 651 . . . or the multipliers 62 . . . may be omitted, and the control of amplitude may be limited to either the formant waveform signals Fj(t) or the formant carrier signals Gj(t).

The formant control Datameters aj(t) (envelope level data) may be multiplied and synthesized by the weighting data WG through a multiplier 653, and may be sent to the multipliers 651 and 652 as waveform amplitude data Faj(t) and carrier amplitude data Gaj(t).

As shown in FIG. 42A–42F, the weighting data WG are stored in a multiplexed manner having various values in the weighting table 654 for each of the musical factors or envelope phases. The musical factors and envelope phases are used as high-order read addresses, the lapses of sounding time or the envelope levels aj(t) are used as the low-order read address data, and the weighting data WG are read out time-divisionally for each of the formants. The weighting data WG remain constant, undergo changes, or assume positive or negative values. The weighting data WG or the formant control parameters aj(t) (envelope level data) may partly assume a value "0" causing a change in the number of formants and in the numbers of formant waveform signals Fj(t) and formant carrier signals Gj(t) that are formed at this moment. The weighting data WG or the formant control parameters aj(t) can also be generated by calculation using a digital signal processor or the like.

The lapses of sounding time are represented by formant control parameters Valj(t) that are time-divisionally generated as mentioned above or time count data, and the musical factors are input through a group of panel switches of the performance data generating unit 10 or through a MIDI system, or are supplied time-divisionally from the assignment memory 313 using the controller 20. When the weighting data WG are generated in parallel, the multipliers 653 are provided in many number.

The lapses of sounding time may be converted to the weighting data WG. In this case, the lapses of sounding time are subjected to various calculations (2) that will be described later, or the low-order data are shifted (shifted down) by the data shifter in response to high-order data of the lapses of sounding time, or the high-order data of the lapses of sounding time are subtracted from the low-order data through the adder.

Moreover, the formant control parameters aj(t) only or the weighting data WG only may be fed to the multipliers 651, 652. Like in the weighting table 654, the formant control parameters aj(t) may be stored in a multiplexed manner for each of the musical factors or the envelope phases. In this case, the lapses of sounding time or the envelope level is used as read address data. Like in the tables 212, 214, . . . , furthermore, the formant control parameters aj(t) may be stored as data SP, O and Min for each of the musical factors, lapses of sounding time, envelope levels or envelope phases. Moreover, the formant control parameters aj(t) or data SP, O and Min are selected upon instruction by the operator, or are input by the operator through the performence data generating unit 10.

Figure 43:
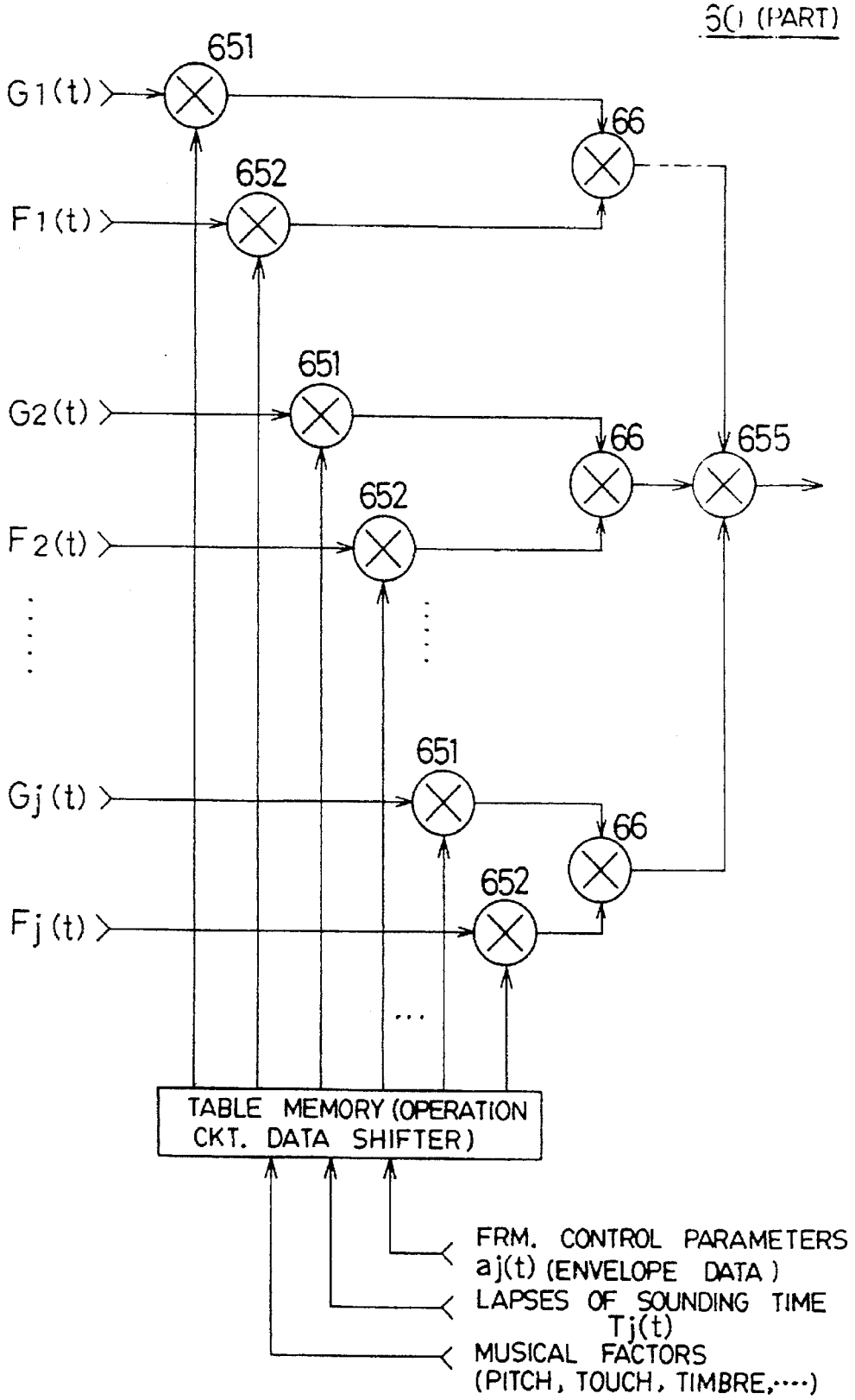
FIG. 43 is a diagram of the formant waveform-generating unit 60 according to a sixth embodiment.

The multipliers 653 . . . , may be substituted by the adders, data shifters, calculation circuits or table memories, and the amplitudes can be controlled as shown in FIG. 43 in compliance with various calculations (1) that will be described later. The input data in this case include formant control parameters aj(t), lapses of sounding time, musical factors input through the performance data generating unit 10, etc. The formant waveform signals Fj(t) or formant carrier signals Gj(t) of which the amplitudes are controlled as described above, are subjected to the multiplication or division and synthesis through the multiplier 66, and are subjected to the addition or subtraction and synthesis through the As described above, the formant control parameters aj(t) and weighting data WG can be subjected to synthesis other than multiplication and division.

Figure 44:
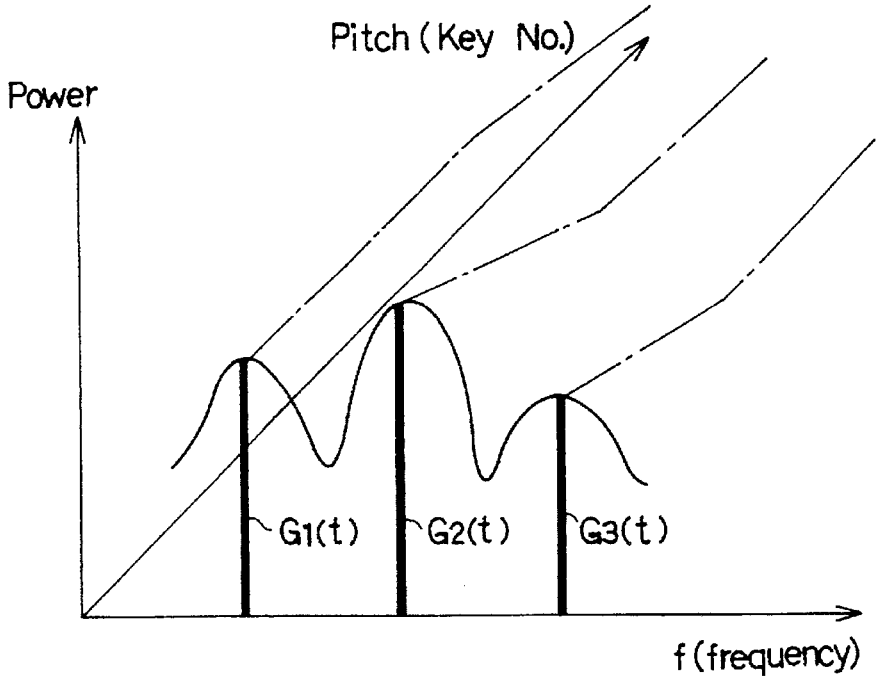
FIG. 44(*a*) and 44(*b*) are diagrams illustrating changes in the amplitude of formant carrier signals Gj(t) or formant waveform signals Fj(t) of formants.
Figure 44:
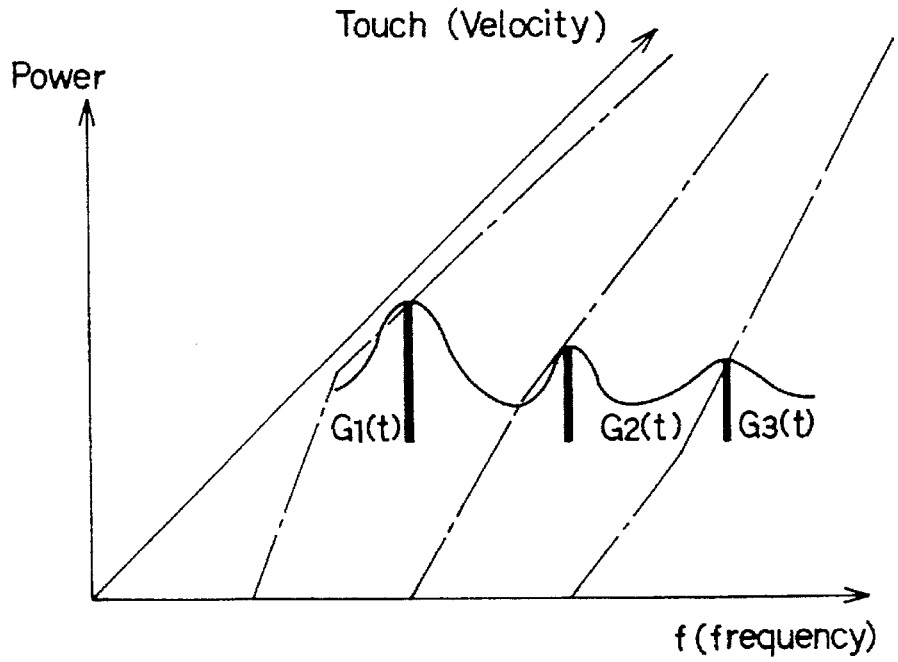

FIG. 44 illustrates amplitude changes in the formant waveform signals Pj(t) or in the formant carrier signals the formant control parameters aj(t) or weighting data WG, wherein the diagram (a) illustrates a change in the amplitude depending upon the key number (tone pitch) in the musical factors and the diagram (b) illustrates a change in the amplitude depending upon the touch (velocity) in the musical factors. The axes of key number (tone pitch) and touch (velocity) may be substituted by the axes of tone number (timbre), effect. numbers, lapses of sounding time, envelope levels and envelope phases.

Figure 45:
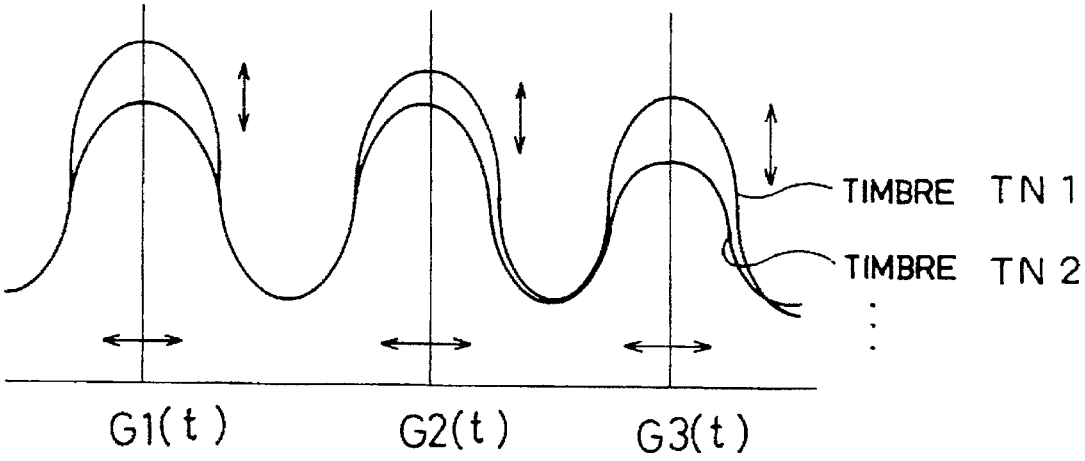
FIG. 45 is a diagram illustrating changes in the amplitude of formant carrier signals Gj(t) or formant waveform signals Fj(t) of formants.

As shown in FIG. 45, furthermore, changes in the formants are switched for each of the tone numbers (timbres) and effect numbers. This is because, the formant control parameters aj(t) or the weighting data WG undergo a change for each of the musical factors, lapses of sounding time, envelope levels or envelope phases as described earlier.

The three formants shown in FIGS. 44 and 45 are those of a musical tone. Among these formants, the one having the largest amplitude is usually the first formant having the lowest frequency. However, the amplitude of the second formant, third formant, . . . may become the greatest in the whole or part of the sounding time. Constitution, change, etc. in other respects are the same as those of the aforementioned formant waveform generating unit 60 of another embodiment.

31. Formant waveform generating unit 60

Figure 46:
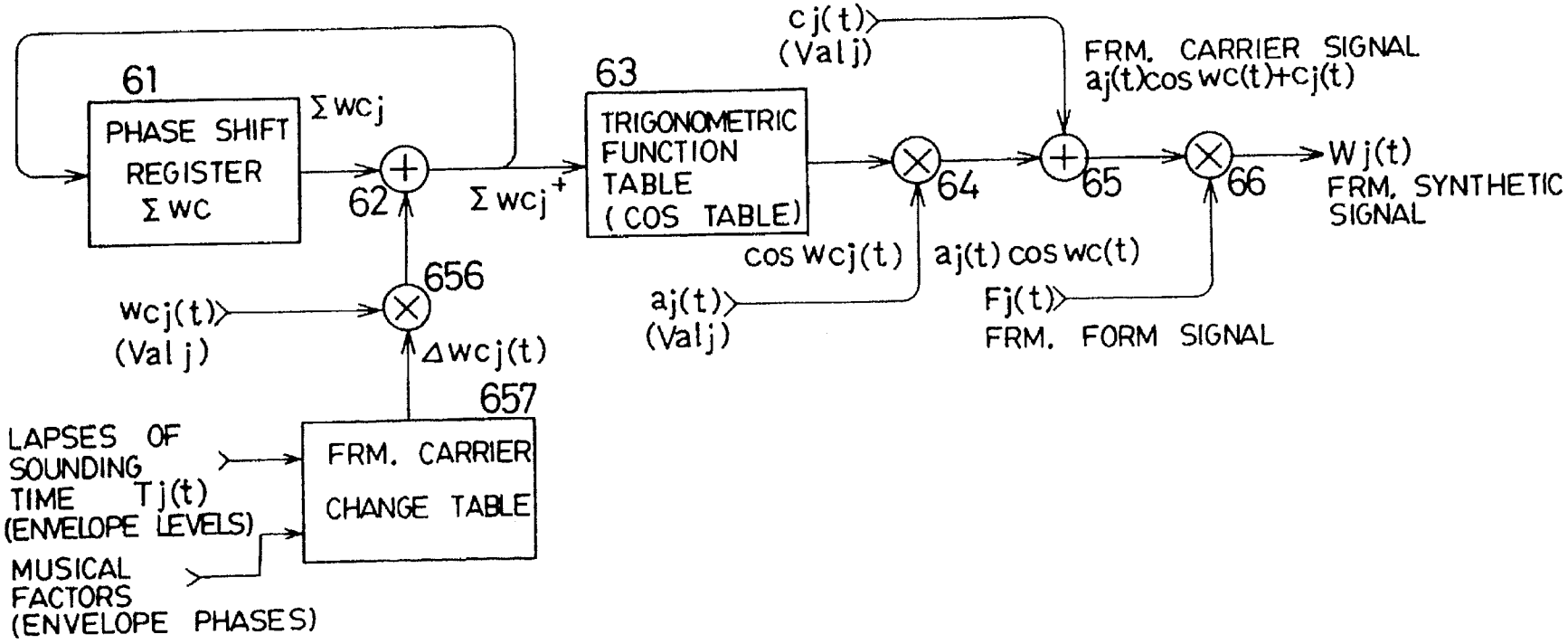
FIG. 46 is a diagram of the formant waveform-generating unit 60 according to a seventh embodiment.
Figures 47A, 47B, 47C, 47D, 47E, 47F:
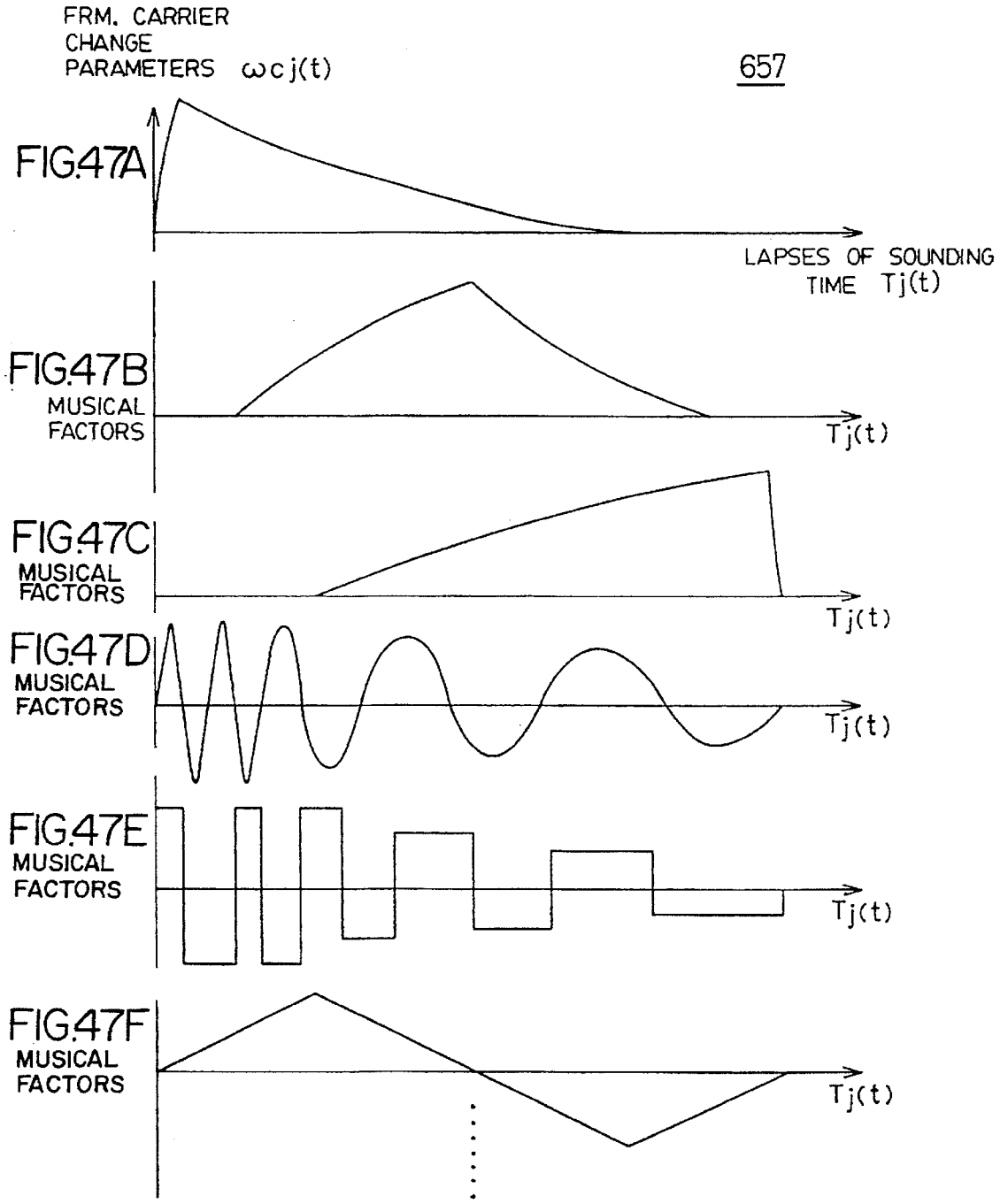
FIGS. 47A–47F are diagrams illustrating formant carrier change parameters cj(t) of a table 657 of formant carrier changes.

FIG. 46 is a diagram of the formant waveform generating unit 60 according to a further embodiment. The formant waveform generating unit 60 of FIG. 46 has a multiplier 656 that is not possessed by the formant waveform generating unit 60 of FIG. 15. Formant carrier change parameters $\Delta\omega$ cj(t) are time-divisionally fed to the multiplier 656 for each of the formants to multiply the formant carrier parameters $\omega$ cj(t). The formant carrier change parameters $\Delta\omega$ cj(t) are read out from the formant carrier change table 657. The formant carrier change parameters $\Delta\omega$ cj(t) can also be generated (formed) by calculation by using a digital signal processor or the like.

The formant carrier change parameters Δω cj(t) are stored in a multiplexed manner having various values in a table 657 of formant carrier changes in the same manner as described above, or in the same manner as in the above-mentioned weighting table 654 as shown in FIGS. 47A–47F for each of the musical factors or envelope phases. The musical factors and envelope phases are used as high-order read address data, the lapses of sounding time or the envelope levels are used as the low-order read address data, and the formant carrier change parameters Δω cj(t) are time-divisionally read out for each of the formants. Moreover, the formant carrier change parameters Δω cj(t) are selected upon instruction by the operator or are input by the operator through the performance data generating unit 10.

The above-mentioned musical factors are synthesized with formant control parameters valj and time count data that change depending upon the envelope data or the lapses of time in compliance with various calculations (1) that will be described later. Moreover, the formant carrier change parameters Δω cj(t) are modified and synthesized with the lapses of time from the start of sounding or with the envelope levels in compliance with various calculations (1) that will be described later.

As the formant carrier change parameters Δω cj(t), furthermore, there may be used fluctuation data SW from the fluctuation data memory 21 described in the specification and drawings of Japanese Patent Application No. 04-230136, frequency modulation data FM1-3, SFM or amplitude modulation data AM1-3, SAM disclosed in the specification and drawings of Japanese Patent Application No. 04-346063 (U.S. Ser. No. 08/172,146). The lapses of sounding time may be converted to the formant carrier change parameters Δω cj(t). In this case, the lapses of sounding time are subjected to various calculations (2) that will be described later, and the low-order data are shifted (shifted down) by a data shifter depending upon the high-order data of the lapses or sounding time, or the high-order data or the lapses of sounding time are subtracted from the low-order data through the adder.

The formant carrier change parameters Δω cj (t) remain constant, undergo changes, or assume positive or negative values. Therefore, the frequency of the generated formant carrier signals Gj(t) undergoes a change. Due to the multiplication by formant carrier change parameters Δω cj(t), the formants swing toward the right and left along the axis of frequency as shown in FIGS. 44 and 45. Multiplication and synthesis by the formant carrier change parameters Δω cj(t) may be effected in compliance with various calculations (1) that will be described later. In this case, the multiplier 656 may be an adder or may be provided in front of, and at the back of, the adder 62. Constitution, change, etc. in other respects are the same as those of the aforementioned formant waveform generating unit 60 of the another embodiment.

The frequency of formant carrier signals Gj(t) and change in the number were described already with reference to the table 214 of formant centers and will, further, be described later with reference to frequency modulation. In the table 214 of formant centers, the numbers of formant carrier signals Gj(t) and formant waveform signals Fj(t) that are written in the assignment memory 213 and are assigned to the channels, undergo a change depending upon the musical factors, envelope levels, envelope phases or lapses of time from the start of sounding. Moreover, part or whole of the formant control parameters aj(t) or the weighting data WG may assume "0" and, as a result, the numbers of formant carrier signals Gj(t) and formant waveform signals Fj(t) can be controlled.

Controlling the amplitudes of formants, frequency and numbers makes it possible to simulate changes in the formants of practical musical tones of a natural musical instrument such as acoustic piano or the like. In response thereto, values of the weighting data WG and formant carrier change parameters Δω cj(t) can be determined.

Moreover, multipliers are provided at the input terminal of the multiplier 621 of FIG. 20, at the output terminal of the adder 54 of FIG. 10 or 28, at the output terminals of multipliers 64, 66 of FIG. 15 or 19, at the output terminal of the multiplier 67 of FIG. 21 or 24, at the input terminals or output terminals of the adders 631 . . . and multipliers 632 . . . of FIG. 29, and at the input terminals or output terminals of the adder 631 and multiplier 632 of FIG. 32, so that the formant control parameters aj(t) or the carrier amplitude data Gaj(t) can be multiplied and synthesized and that the formant waveform signals Fj (t) or the formant carrier signals Gj (t) are controlled for their amplitudes.

32. Formant waveform generating unit 60 and accumulating unit 70

Figure 48:
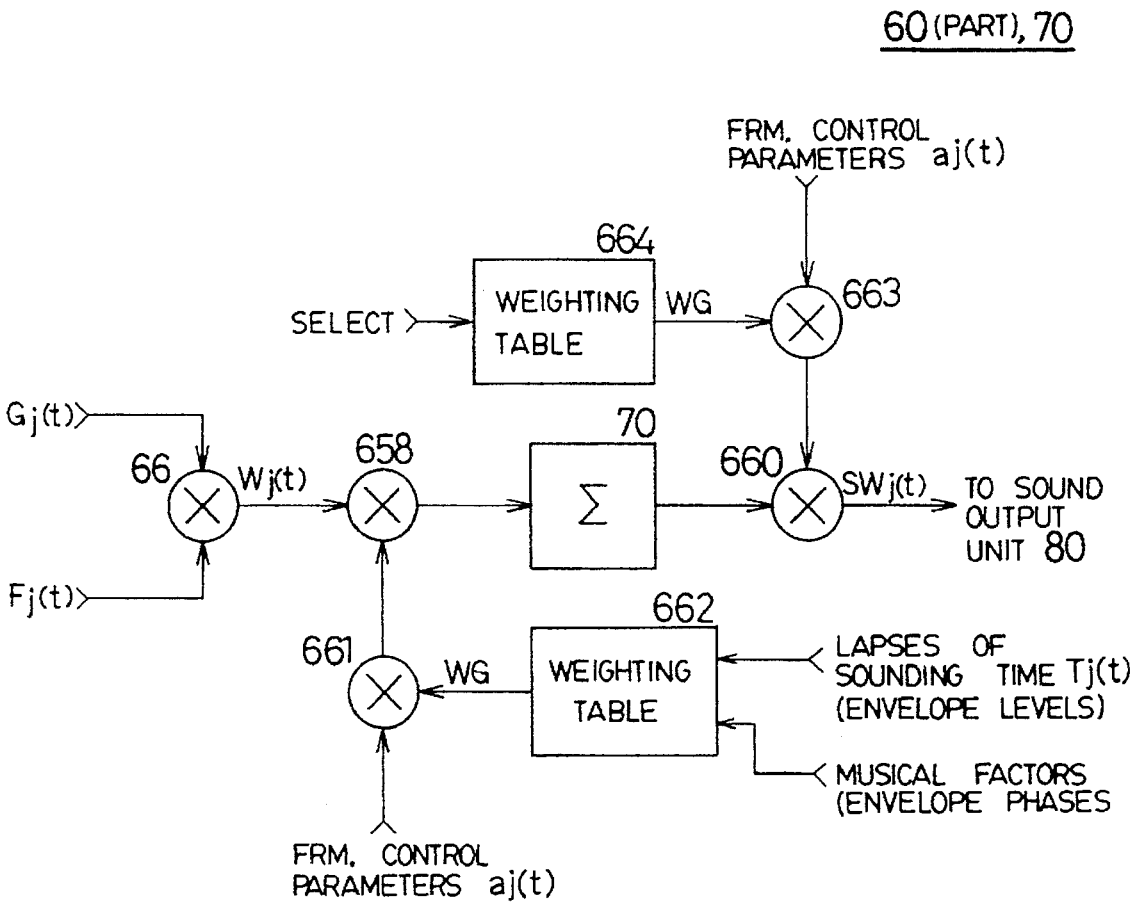
FIG. 48 is a diagram of the formant waveform-generating unit 60 and an accumulation unit 70 according to an eighth embodiment.

FIG. 48 illustrates the formant waveform generating unit 60 and the accumulating unit 70 according to a further embodiment. The formant carrier signals Gj(t) that are time-divisionally generated according to the above-mentioned various methods are multiplied or divided and synthesized through the multiplier 66 by the formant waveform signals F3(t) that are time-divisionally generated by the above-mentioned various methods, and the formant synthesized signals W3(t) are time-divisionally output.

The formant synthesized signals Wj(t) are multiplied or divided and synthesized through the multiplier 658 by the synthesized amplitude data Waj(t) for each of the formants, and the whole formant synthesized signals Wj(t) are accumulated (added or subtracted) and synthesized for each of the groups through the accumulating unit 70, and the whole synthesized signal data SWj(t) are output. The whole synthesized signal data SWj(t) are multiplied by, or divided by, the whole amplitude data SWaj(t) through the multiplier 660 for each of the groups of musical tone.

The formant control parameters aj(t) (envelope level data) are multiplied by, or divided by, the weighting data WG time-divisionally through the multipliers 661 and 663, and are sent as the synthesized amplitude data Waj(t) and the whole synthesized signal data SWj(t) to the multipliers 658 and 660. Like the data described above, the synthesized amplitude data Waj(t) and whole synthesized signal data SWj(t) are stored, as shown in FIG. 42, in a multiplexed manner having various values in the weighting tables 662 and 664 for each of the musical factors, envelope phases or for each of the data input by the operator through the performance data generating unit 10.

The musical factors, envelope phases or data input by the operator through the performance data generating unit 10 are used as high-order read address data, and the lapse of sounding time Tj(t) Or the envelope level (formant control parameter aj(t)) is used as low-order read address data, and the weighting data WG are time-divisionally read out for each of the formants.

Moreover, the weighting data WG remain constant in the weighting table 664 that is related to amplitude control for each of the groups of musical tone, and values are read out depending upon the selection operation by the operator. The weighting data WG may be read out depending upon the musical factors, envelope phases, lapses of sounding time Tj(t) or envelope levels (formant control parameters aj(t)).

The weighting data WG remain constant, undergo a change, or assume positive or negative values. The weighting data WG or the formant control parameters aj(t) (envelope level data) may partly assume "0" causing a change in the number of the whole formant synthesized signals Wj(t) or whole synthesized signal data SWj(t) that are generated. The weighting data WG or the formant control parameters aj(t) (envelope level data) can also be generated by calculation using a digital signal processor or the like.

The lapses of sounding time are represented by the above-mentioned formant control parameters Valj(t) that are time-divisionally generated or by the time count data, and the musical factors are input through the group of panel switches of the performance data generating unit 10 or through the MIDI system, or are fed time-divisionally from the assignment memory 213 using the controller 20. When the weighting data WG are generated in parallel, the multipliers 653 are provided in many number.

As for the weighting data WG, the lapses of sounding time, musical factors or the envelope level data may be converted. In this case, the lapses of sounding time, musical factors or envelope level data are subjected to various calculations (2) that will be described later, and the low-order data are shifted (shifted down) by the data shifter in response to the high-order data of the lapses of sounding time, or the high-order data in the lapses of sounding time are subtracted from the low-order data through the adder.

The formant control parameters aj(t) sent to the multiplier 661 are time-divisionally generated by the formant control parameter generating unit 40 for each of the formants- On the other hand, the formant control parameters aj(t) sent to the multiplier 660 are time-divisionally generated by another circuit in the same formant control parameter generating unit 40 for each of the groups of musical tones.

The formant control parameters aj(t) sent to the multiplier 661 have properties of, for example, envelope level data of formants and the formant control parameters aj(t) sent to the multiplier 660 have properties of, for example, effect data such as vibrato. The formant control parameters aj(t) sent to the multiplier 661 may, of course, possess properties of effect data such as vibrato.

The formant control parameters aj(t) only or the weighting data WG only may be fed to the multipliers 658 and 660. Like in the weighting tables 662 and 664, the formant control parameters aj(t) may be stored in a multiplexed manner having various values for each of the musical factors or envelope phases. In this case, the lapses of sounding time or the envelope levels are used as read address data. Like in the tables 212, 214, . . . , furthermore, the formant control parameters aj(t) may be stored as data SP, O and Min for each of the musical factors, lapses of sounding time, envelope levels or envelope phases.

The multipliers 661, 663, 658 and 660 may be substituted by adders, data shifters, calculating circuits or memories to control amplitudes in compliance with various calculations (1) that will be described later. The input data in thin case are formant synthesized signals Wj(t), formant control parameters aj(t), weighting data WG, lapses of sounding time, and musical factor data input through the performance data generating unit 10. The formant waveform signals Fj(t) or the formant carrier signals Gj(t) of which the amplitudes are thus controlled are multiplied or divided and synthesized through the multiplier 66, and are added up together or subtracted from each other and synthesized through the adder 655. Thus, the formant control parameters aj(t) and the weighting data WG can be synthesized together in addition to being multiplied or divided.

In the formant waveform generating unit 60, the formant carrier signals Gj(t) and formant waveform signals Fj(t) may be processed not only time-divisionally and serially for each of the formants or for each musical tone but also in parallel. In this case, the multipliers 66, 658, 661, 663 and weighting tables 662, 664 are provided in many numbers, and the accumulating unit 70 becomes an adder. The formant carrier signals Gj(t) end formant waveform signals Fj(t) accumulated (added or subtracted) in the accumulating unit 70 for each of the groups, are corresponded to formants in a musical tone but may also be corresponded to formants of the whole musical tone.

The multipliers 66, 658, 660, 661, 663, accumulating unit 70, and table memories 662, 664 can be substituted by adders, multipliers, data shifters, calculating circuits or memories to control the amplitudes in compliance with various calculations (1) that will be described later. The formant carrier signals Gj(t) and formant waveform signals Fj(t) can be synthesized in a variety of ways as described above.

As for a musical tone of a formant, the multiplier 658 controls the amplitude for each musical tone. When there exists only one group of the accumulating unit 70, the amplitude is controlled by the multiplier 660 uniformly for all musical tones. 33. Formant waveform generating unit 60 and accumulating unit 70.

Figure 49:
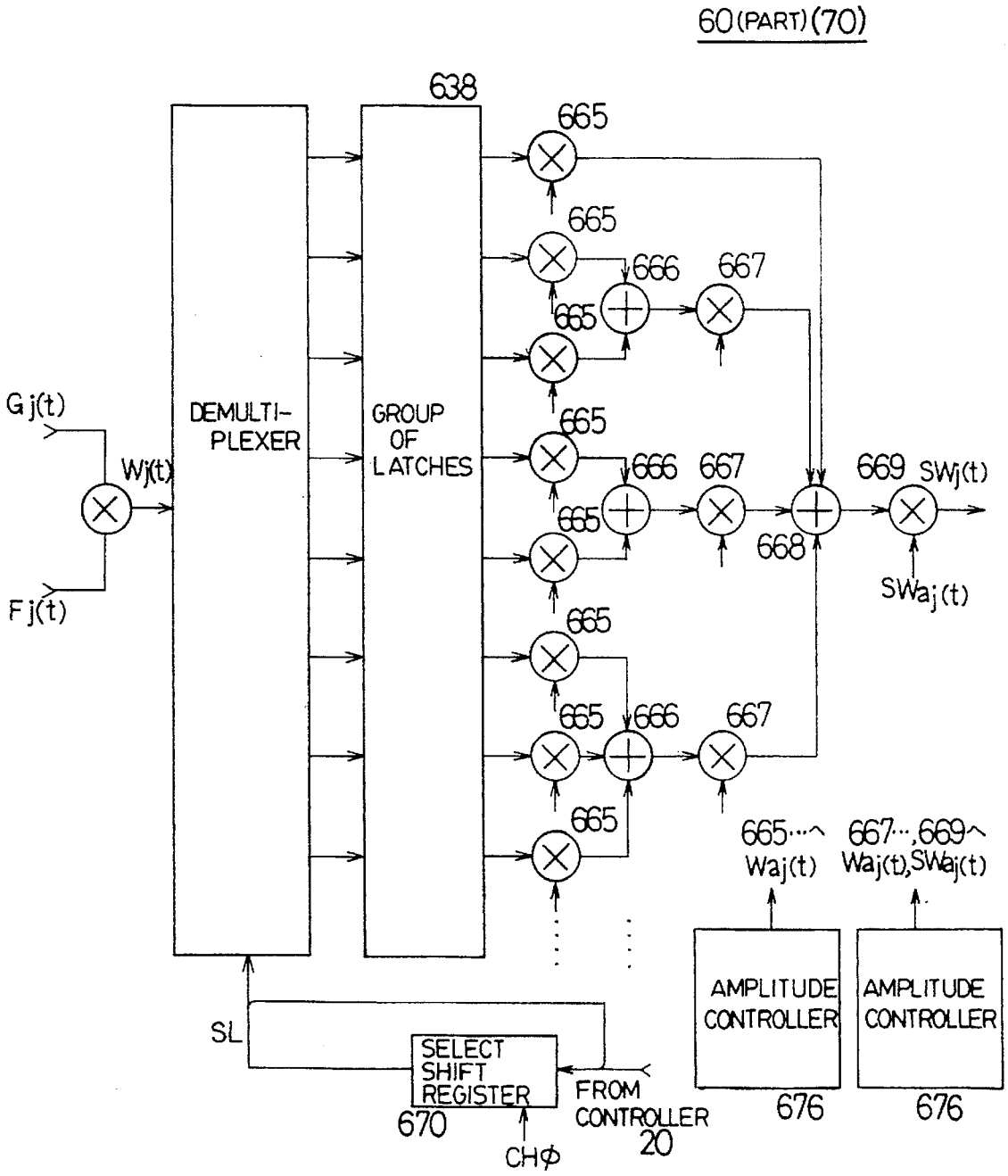
FIG. 49 is a diagram of the formant waveform-generating unit 60 and the accumulation unit 70 according to a ninth embodiment.

FIG. 49 illustrates the formant waveform generating unit 60 and the accumulating unit 70 according to a still further embodiment. The formant carrier signals Gj(t) that are time-divisionally generated by the above-mentioned various methods are multiplied or divided and synthesized through the multiplier 66 by the formant waveform signals Fj(t) that are time-divisionally generated by the above-mentioned various methods, and the formant synthesized signals Wj(t) are time-divisionally output.

The formant synthesized signals Wj(t) are stored in parallel in a group of latches 638 via a demultiplexer 637. The demultiplexer 637 and the group of latches 638 are the same as the aforementioned demultiplexer 637 and the group of latches 638 of FIG. 29. The formant synthesized signals Wj(t) stored in the group of latches 638 are multiplied or divided and synthesized by the first synthesized amplitude data Waj(t) for each formant through first multipliers 665 . . . . Some of the formant synthesized signals Wj(t) of which the first synthesized amplitude data Waj(t) are synthesized, are subjected in a number of two or three to the addition or subtraction and synthesis through adders 666. The formant synthesized signals Wj(t) in a number of four or more may be added or subtracted and synthesized. The number of outputs of the demultiplexer 637 may be nine or more.

The thus synthesized formant synthesized signals Wj(t) are fed to second multipliers 667 . . . , where the second synthesized amplitude data Waj(t) are further multiplied or divided and synthesized for each musical tone. The whole formant synthesized signals Wj(t) of which the second synthesized amplitude data Waj(t) are synthesized, are further added or subtracted and synthesized through the adder 668, and the whole synthesized signals SWj(t) are output. The whole synthesized signals SWj(t) are fed to a multiplier 669 where the whole amplitude data SWaj(t) are multiplied or divided and are output.

Eight output lines of the demultiplexer 637 are selectively assigned based upon select data SL from a select shift register 670. The select data SL determine to which synthesizing lines of the formant waveform generating unit 60 and the accumulating unit 70 of FIG. 49 be assigned the formant synthesized signals Wj(t), i.e., be assigned the formant that are output and assigned to the respective channels. The content of the select data SL is determined depending upon the number of formant synthesized signals Wj(t) of musical tones, i.e., depending upon the number of formants.

For instance, one formant of a musical tone is assigned to the uppermost output line of FIG. 49, two formants of the musical tone are assigned to the second and third output lines or to the fourth and fifth output lines from top of FIG. 49, and three formants of the musical tone are assigned to the sixth to eighth output lines from top of FIG. 49. In response thereto, the contents to be written into the assignment memory 213 of FIG. 26 and the contents of formants to be assigned to the channels are determined.

Here, it may be so considered that all musical tones are made up of three formants, i.e., three formant synthesized signals Wj(t). In this case, when the number of channels is 64, a 21-sound polyphonic and a spare channel are constituted and when the number of channels is 32, a 10-sound polyphonic and two spare channels are constituted. In this case, the circuit of FIG. 49 is constituted by only a group of lines for synthesizing three outputs, such as the sixth to eighth output lines.

The select shift register 670 has shift areas corresponding to the number of channels, and the select data SL are stored by the controller 20, successively shifted and output in a time-divisional manner, and are fed back and input. The moment when the select data SL are stored is a channel timing at which the corresponding formant synthesized signals Wj(t) are output to the demultiplexer 637. In practice, a data selector is provided at the input terminal of the select shift register 670, selection is switched by the controller 20, and the select data SL are fed back and input except when the select data SL are being stored by the controller 20.

The select data SL vary depending upon the timbre input through the performance data generating unit 10, touch, musical factor data such as tone pitch range, lapses of time from the start of sounding, envelope levels, envelope phases, instruction by the operator, and data input by the operator. Corresponding thereto, the program/data storage unit 21 is provided with a correspondence table between the musical factor data and the select data SL. The data for each of the musical factors are stored in a multiplexed manner like the storage of the data SP, O, Min, Ta, Ea, formant waveform signals Ffj(t) and formant density parameters ω fj(t).

In this case, the musical factors may be synthesized with formant control parameters Valj and time count data that vary depending upon the envelope data or depending upon the lapses of time in compliance with various calculations (1) that will be described later.

The data may not be stored for the lapses of time from the start of sounding or for each of the envelope levels, and the select data SL may be modified and synthesized with the lapses of time from the start of sounding or with the envelope levels. The modification and synthesis are effected in compliance with various calculations (1) that will be described later, and an arithmetic unit for modifying and synthesized the lapses of sounding time or the envelope levels is provided at the input terminal of the select shift register 670 of FIG. 45.

Figure 50:
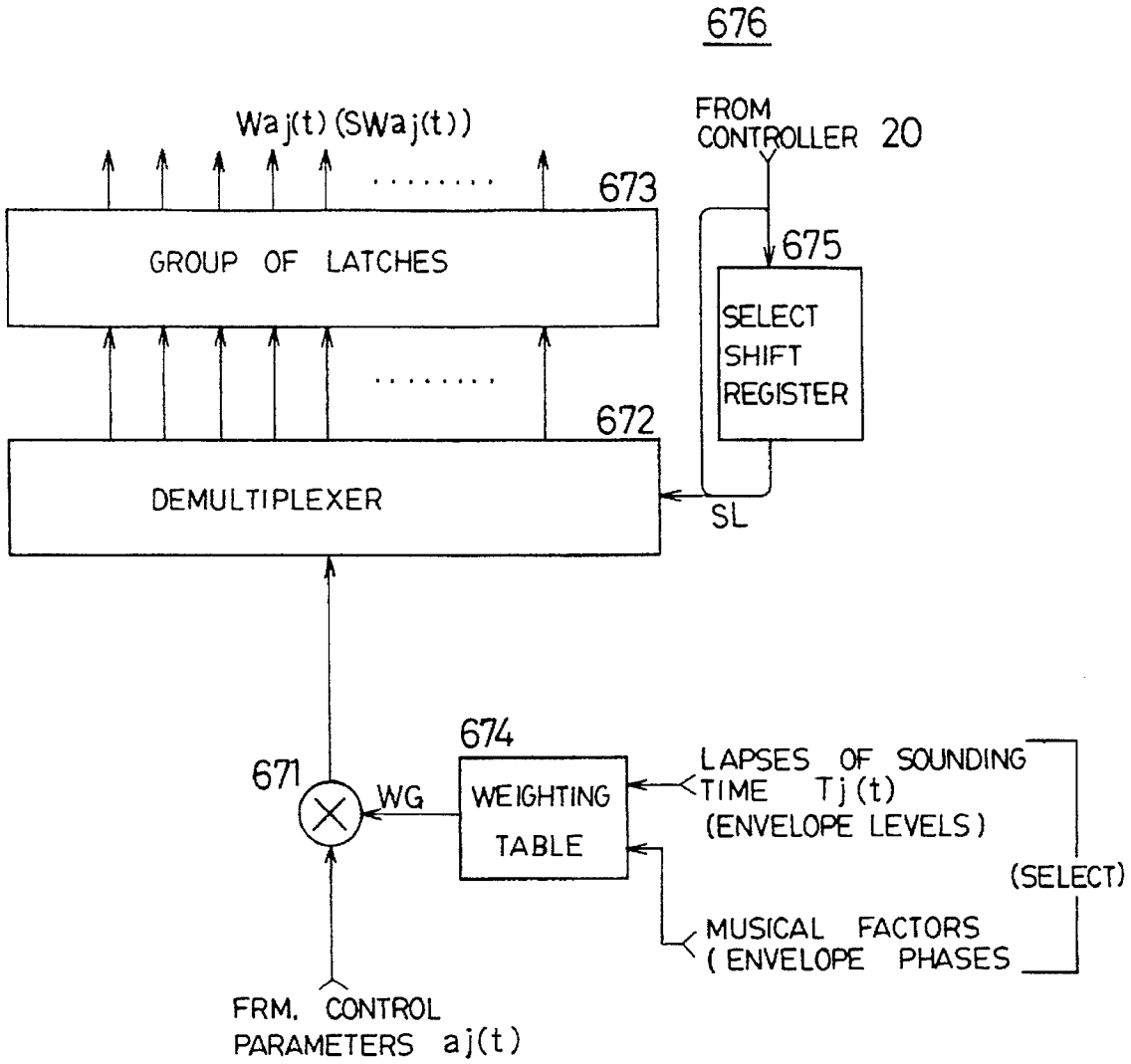
FIG. 50 is a diagram illustrating an amplitude controller 676.

The synthesized amplitude data Waj(t) and the whole amplitude data SWaj(t) are output from the amplitude controllers 676, 676 shown in FIG. 50. The formant control parameters aj(t)(envelope level data) are time-divisionally multiplied or divided and synthesized by the weighting data WG through multipliers 671, 671, and are sent as the synthesized amplitude data Waj(t) and the whole amplitude data SWaj(t) to the multipliers 665 . . . , 667 . . . , 669 via demultiplexers 672, 672 and groups of latches 673, 673. In the same manner as described above, the synthesized amplitude data Waj(t) and whole amplitude data SWaj(t) are stored in the weighting tables 674, 674 as shown in FIG. 42 in a multiplied manner assuming various values for each of the musical factors, envelope phases or data input by the operator through the performance data generating unit 10.

Musical factors, envelope phases and data input by the operator using the performance data generating unit 10 are used as high-order read address data, and lapses of sounding time Tj(t) or the envelope levels (formant control parameters aj(t)) are used as low-order read address data, and weighting data WG are time-divisionally read out for each of the formants.

The weighting data WG remain constant, undergo changes, or assume positive or negative values. The weighting data WG or the formant control parameters aj(t) (envelope level data) may partly assume a value "0", resulting in a change in the number of the whole formant synthesized signal Wj(t) or the whole synthesized signal data Swj(t) that are generated at this moment. The weighting data WG or the formant control parameters aj(t) can also be generated through calculation by using a digital signal processor or the like.

As the lapses of sounding time, there are used formant control parameters Valj(t) that are time-divisionally generated and time count data, and the musical factors are input through the group of panel switches of the performance data generating unit 10 and the MIDI system or are time-divisionally sent from the assignment memory 213 by the controller 20. When the weighting data WG are generated in parallel, the multipliers 653 are provided in many number.

As for the weighting data WG, the lapses of sounding time, musical factors or envelope level data may be converted. In this case, the lapses of sounding time, musical factors or envelope level data are subjected to a variety of calculations (2) that will be described later, or the low-order data are shifted (shifted down) by the data shifter depending upon the high-order data such as lapses of sounding time, etc. or the high-order data such as lapses of sounding time, etc. are subtracted from the low-order data through the adder.

The formant control parameters aj(t) only or the weighting data WG only may be fed to the multipliers 665 . . . , 667 . . . , 669. Like in the weighting tables 674, 674, the formant control parameters aj(t) may be stored in a multiplexed manner having various values for each of the musical factors or envelope phases. In this case, the lapses of sounding time or envelope levels are used as read address data. Like in the tables 212, 214 . . . , the formant control parameters aj(t) may be stored as the data SP, O, Min for each of the musical factors, lapses of sounding time, envelope levels or envelope phases.

The multipliers 671, 671, 665 . . . , 667 . . . , 669 may be substituted by adders, data shifters, calculation circuits or memories to control the amplitudes in compliance with rations calculations (1) that will be described later. The input data in this case include formant synthesized signals Wj(t), formant control parameters aj(t), lapses of sounding time, weighting data WG, musical factor data that are input through the performance data generating unit 10, etc.

The demultiplexers 672, 672 and groups of latches 673, 673 are the same as the aforementioned demultiplexer 637 and the group of latches 638. The output lines, however, are corresponding to the number of the multipliers 665 . . . , 667 . . . , 669, and are "8" and "4" in the case of FIG. 49. The numbers of the multipliers 665 . . . , 667 . . . , 669 may be increased or decreased to be brought into agreement with the number of the time-dividing channels, or may be selected to be an integer number of times such as 2 times, 3 times, . . . .

When the numbers are not in agreement, the time for dividing the whole lines of the demultiplexer 672 may be brought into agreement with the whole divisional time of the demultiplexer 637, so that the switching speed is increased or decreased. In either case, though the numbers of output lines of the two groups of latches 638 and 672 may be different, matching is accomplished between the two by the groups of latches 673. However, the above-mentioned integer number of times is most desirable. The divisional times of the demultiplexer 672 for generating the synthesized amplitude data Waj(t) that will be sent to the multipliers 665 . . . are in agreement with the divisional times of the demultiplexer 637, and matching is accomplished between them.

The formant control parameters aj(t) sent to the multipliers 665 . . . are time-divisionally generated by the formant control perimeter generating unit 40 for each of the formants. On the other hand, the formant control parameters aj(t) sent to the multipliers 667 . . . , 669 are time-divisionally generated by an another circuit same as the above-mentioned formant control parameter generating unit 40 for each of the whole musical tones and groups.

The formant control parameters aj(t) that are sent to the multipliers 665 . . . , 667 . . . may have properties of, for example, formants and envelope level data of musical tones, and the formant control parameters aj(t) that are sent to the multipliers 660 may have properties of effect data such as vibrato. It is, of course, allowable that the formant control parameters aj(t) sent to the multipliers 665 . . . , 667 . . . have properties of effect data such as vibrato.

Adders and multipliers may be provided between the multipliers 667 . . . and the adders 668 in order to control the amplitudes of the formant synthesized signals Wj(t) for each of the groups of musical tones. In this case, provision is made of another set of the demultiplexer 672, group of latches 673, multiplier 671, weighting table 674, select shift register 675 and formant control parameter generating unit 40.

Moreover, a constant value is assumed by the weighting data WG in the weighting table 674 related to controlling the amplitude for each of the groups of musical tones and controlling the amplitude of the whole musical tones, and values corresponding to selection operation by the operator are read out. It is of course allowable to read the values that vary depending upon the musical factors, envelope phases, lapses of sounding time Tj(t), envelope levels (formant control parameters aj(t)) or data input by the operator.

Here, the demultiplexer 672 for generating the whole amplitude data SWaj(t) sent to the multiplier 669, group of latches 673, multiplier 671, weighting table 674, select shift register 675 and formant control parameter generating unit 40 may be different from the demultiplexers 672 . . . that control amplitude for each musical tone or that control amplitude for each group of musical tones.

Eight output lines and four output lines of the demultiplexers 672, 672 are selectively assigned based upon the select data SL from the select shirt registers 675, 675. The select data SL determine to which multipliers 665 . . . , 667 . . . , 669 of FIG. 49 the synthesized amplitude data Waj(t) and the whole amplitude data SWaj(t) be output and assigned.

The select shift registers 675, 675 have shift areas corresponding to the number of channels, and the select data SL are stored by the controller 20, successively shafted and output for each of the divisional times, and are fed back and input. The moment when the select data SL are stored is a channel timing at which the corresponding formant synthesized signals Wj(t) are output to the demultiplexers 637. In practice, a data selector is provided at the input terminal of the select shift register 675, and the select data SL are fed back and input except when the select data SL are being stored by the controller 20.

The select data SL vary depending upon the musical factors data such as timbre, touch, tone pitch range, etc. that are input through the performance data generating unit 10, lapses of time from the start of sounding, envelope levels, envelope phases and instructions set by the operator. Corresponding thereto, the program/data storage unit 21 is provided with a correspondence table between the musical factor data, etc. and the select data SL. The data are stored for each of the musical factors in a multiplexed manner like the storage of the above-mentioned data SP, O, Min, Ta, Ea, formant waveform signals Ffj(t) or formant density parameters fj(t).

In this case, the musical factors may be synthesized with the formant control parameters Valj and time count data that vary depending upon the envelope data or the lapses of time in compliance with various calculations (1) that will be described later.

The data may not be stored for each of the lapses of time from the start of sounding or for each of the envelope levels, and the select data SL may be modified and synthesized with the lapses of time from the start of sounding or with the envelope levels. The modification and synthesis are effected in compliance with various calculations (1) that will be described later, and an arithmetic unit for modifying the lapses of sounding time or the envelope levels is provided at the input terminal of the select shift register 675 of FIG. 45.

34. Accumulating unit 70

Figure 51:
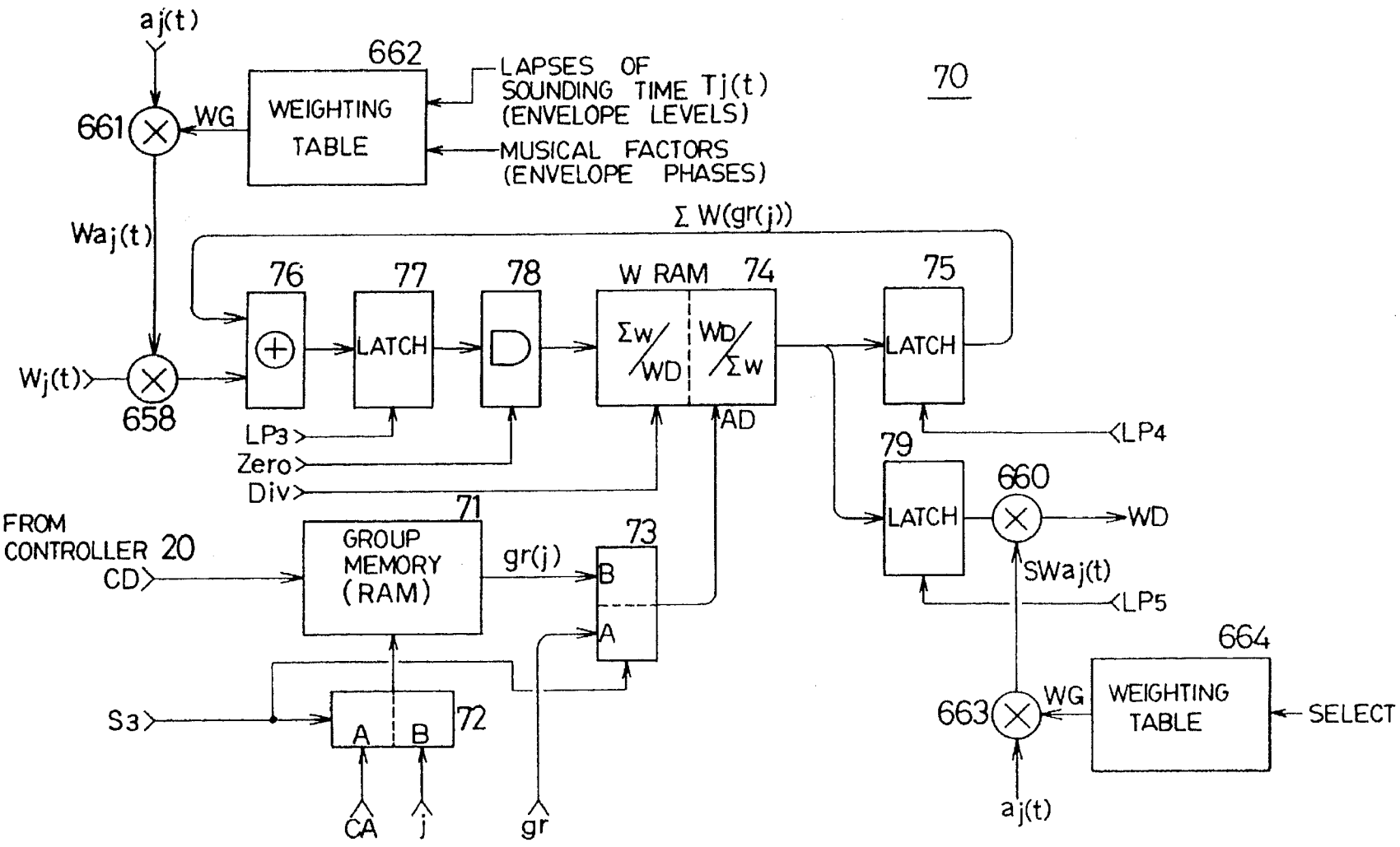
FIG. 51 is a diagram illustrating the accumulation unit 70 according to a tenth embodiment.

FIG. 51 illustrates the accumulating unit 70 according to a yet further embodiment. The circuits same as the multipliers 658, 661, weighting table 662 and formant control parameter generating unit 40 are provided at the input terminal of the adder 76 that receives formant synthesized signals Wj(t), and the amplitude is controlled for each of the formants.

The circuits same as the multipliers 660, 663, weighting table 664 and formant control parameter generating unit 40 are provided at the output terminal of the latch 79 that outputs accumulated formant synthesized signals $\Sigma W(gr(j))$ (WD) that are accumulated for each of the groups, and the amplitude is controlled for each group of musical tones.

The frequency of the formant synthesized signals wj(t) or the whole synthesized signals SWj(t) is controlled based upon a change in the frequency of the formant carrier signals Gj(t). That is, the frequency of the formant carrier signals Gj(t) is changed by calculating the formant carrier parameters $\omega$ cj(t) for the formant carrier change parameters $\Delta\omega$ cj(t) of FIG. 46.

The number of the formant synthesized signals Wj(t) or the whole synthesized signals SWj(t) is controlled depending upon a change in the number of the formant carrier signals Gj(t) or the formant waveform signals Fj(t). That is, in the table 214 of formant centers, the numbers of formant carrier signals Gj(t) and formant waveform signals Fj(t) that are written in the assignment memory 213 and assigned to the channels, vary depending upon the musical factors, envelope levels, envelope phases, or lapses of sounding time. Moreover, the formant control parameters aj(t) or the weighting data WG may partly or entirely assume the value "0" and, as a result, the number of the formant synthesized signals Wj(t) or the whole synthesized signals SWj(t) is controlled.

Controlling the amplitude, frequency and number of the formants makes it possible to simulate a change in the formants of practical tones of natural musical instruments such as acoustic piano and the like. Responsive thereto, values of the weighting data WG and formant carrier change parameters Δω cj(t) can be determined.

The multipliers 658, 660, 661 and 663 may be substituted by adders, data shifters, calculation circuits or memories to control the amplitude in compliance with various calculations (1) that will be described later. In this case, the input data include formant synthesized signals Wj(t), formant control parameters aj(t), lapses of sounding time, weighting data WG, musical factor data input through the performance data generating unit 10, etc.

Moreover, multipliers, calculation circuits, data shifters, memories, etc. may be provided at the output. terminal of the adder 54 of FIG. 10 or 28, at the output terminal of the multiplier 66 of FIG. 15 or 19, at the output terminal of the multiplier 621 of FIG. 20, at the output terminal of the multiplier 67 of FIG. 21 or 24, at the output terminals of the adders 631 . . . , multipliers 632 . . . , multiple synthesis devices 635 . . . and adder 634 of FIG. 29, at the output terminals of the adder 631, multiplier 632 and group of AND gates 647 of FIG. 32, at the output terminal of the multiplier 66 of FIG. 41, and at the output terminal of the multiplier 666 or 655 of FIG. 43, so that the formant control parameters aj(t) and/or the weighting data WG are multiplied or are subjected to various calculations (1) that will be described later and are synthesized, in order to control the amplitude of the formant synthesized signals wj(t) or the whole synthesized signals SWj(t).

A variety of modifications, changes, uses, diversions, substitutions and additions mentioned for the formant carrier signals Gj(t), formant waveform signals Fj(t), parameters Valj (ω fj(t), ω cj(t), aj(t), cj(t), dj(t), ω fjk(t), ω cjk(t), ajk(t) , cjk(t), djk(t), WAD/RAD, etc.), data TD, SP, O, Min, Req, End, Ea, Ta, tables 212, 214, 215, 216, and assignment memory 213 that are described above or will be described later, quite hold true directly and exclusively for the modifications, etc. of the formant carrier signals Gj(t), formant waveform signals Fj(t), parameters, tables 212, 214 to 216, and memory 213 that are described with reference to FIGS. 18 to 51 or will be described later. This is because, the signals, parameters, data, tables and memories have the same natures and the same constitutions. The above modifications and the like are not described here in order to avoid the specification from becoming lengthy.

While the invention has been described in connection with the above embodiment, various changes and modifications of the embodiment may be made without departing from the scope and spirit of the invention. For example, it is possible to permit frequency modulation. In this case, a certain formant control parameter Valj is operated with respect to the cumulative formant carrier parameter ω cj(t) (Σω cj(t)) in the formant waveform generator 60. This operations may be all kinds of calculations (1) will be described later in detail.

Thus, frequency modulation is possible not only on the entire formant carrier signal cosω cj(t) or Gj(t) but also on each waveform component cosω cj(t) thereof. In this case, the formant control parameter Va13 may be multiplied on or added to the cumulative formant control parameter Σω fj(t) in the formant waveform generator 50. By so doing, according to the frequency modulation the formant density can be subtly changed to change the timbre.

Further, the cumulative formant density parameter Σω fj(t) for reading the formant waveform signal Ffj(t) in the formant waveform memory 53 may be replaced with cumulative formant carrier parameter Σω cj(t) corresponding to a tone pitch or the like. In this case, the formant carrier parameter ω cj(t) is supplied instead of the formant density parameter ω fj(t) to the phase operation unit 51.

Further, with respect to a single sounding operation or a single tone pitch a plurality of time division channels may be assigned simultaneously to a plurality of musical tones. Among such plurality of musical tones are left and right tone waveform data tones forming stereo positions, fundamental wave part tones and harmonic part tones, rising, intermediate and attenuating part tones from the start till the end of tone sounding, tones corresponding to the first, second and so forth formants, and so forth. In this case, the combination of formant waveform signals Ffj(t) which are of the tones with the assigned channels thereto and are read out from the formant waveform memory 53, is selected by switching according to the musical factors such as the timbre, touch, tone pitch range, etc., elapsed time from the sounding start, envelope level or envelope phase. Further, instead of multiplification synthesizing the formant waveform signal Fj(t) on the formant carrier signal Gfj(t) and cosω cj(t), it is possible to permit formant density parameter ω fj(t) corresponding to a designated pitch to be provided for directly outputting the formant waveform signal Fj(t) as musical tone.

It is possible to use fluctuations (wavering, swings, sways) data FL from a fluctuation data memory 321 or frequency or amplitude modulation data FM1 to FM3, SFM, AM1 to AM3 or SAM described in specification U.S. patent application Ser. No. 08/172,146 (Japan Patent Application Serial No. 04-230136 and 04-346063) as the parameter values Valj (ω fj(t), ω cj(t), aj(t), c3(t), ω cjk(t), ajk(t), dj (t)), ω cjk(t), ajk(t) and cj(t).

The above parameter storage 41 (i.e., parameter memory 411), formant density storage unit 52 (i.e., formant density memory 523) and formant waveform memory 53, may be combined into a single memory or two memories, for time division reading and writing of each data. Such combined memory may include the phase shift register 61, cos table 63, accumulation memory 74, group memory 71, program/data storage 21, etc. All the processes of addition and subtraction and additive synthesis described above mean biasing, and all the processes of multiplification and division and multiplific synthesis mean weighting.

The formant waveform signal Ffj(t) stored in the formant waveform memory 53 or the formant carrier signal Gj(t) stored in the formant waveform control unit 60 may represent time-wise part sound, envelope part sound or band-wise part sound. The time-wise part sound is one of sounds corresponding to a rising (attack), a subsequent-to-rising and an attenuating (release) part of a musical tone. The envelope part sound is one of attack, decay, sustain and release parts of a musical tone. The bandwise part sound is one of a low, an intermediate and a high pitch range pans of a musical tone, and these part sounds may be overlapped each other.

For the time-wise part sound, the read start moment is determined according to the elapsed time from the start of sounding. For the envelope part sound, it is determined according to the envelope phase. For the band-wise part sound, it is determined according to the envelope level or musical factor.

Further, the multiplification or division process or multiplific process by the multiplier may be replaced with an addition or subtraction process or an additive processes. In this case, the signal, data or parameter to be multiplied or divided is converted by a logarithmic converter or into a logarithmic value from the instant of generation, then added in an added and then inversely converted in an exponential converter.

It is possible to process the formant control parameter Valj indicative of the elapsed time from the sounding start, cumulative formant density parameter Σω fj(t), cumulative formant carrier parameter Σω cj(t) or time count data for synthesis with the cumulative formant carrier parameter Σω cj(t) (Σω cjk(t)) in the formant waveform generator 60 or weighting interpolation circuit 88 in FIG. 15, 19, 21 and 24 formant carrier parameter ω cj(t) (ω cjk(t)) (comparative data), formant control parameter aj(t) or cj(t) (ajk(t) or cjk(t)), cumulative formant density parameter Σω fj(t) (Σ fjk(t)) shown in FIG. 10, formant density parameter Σω fj(t) (ω fjk(t)), formant control parameter dj(t) (djk(t)) or speed data SP.

Further, the values of the parameters ω cj(t), ω fj(t), aj(t), cj(t) (ω cjk(t), ajk(t), dj(t)), ω cjk(t), ajk(t) and cj(t), data Ta, Ea, SP, O and Min, etc. in the moment of sound starting, may be stored, and after the lapse of a certain time from the start of sounding the data indicative of the elapsed time from the sounding start or envelope data may be synthesized with the value of the parameter ω cj(t) or the like. This operation and synthesis may be synthesis in all kinds of calculations (1) will be described later in detail.

In this case, the data indicative of the elapsed time from the start of sounding or envelope level data may be convened to weighted data and the weighted data may be synthesized in the above operation and synthesis. Alternatively, weighted data stored in a table may be read out according to the elapsed time data or envelope data as address data, and the elapsed time from the start of sounding or envelope level data is converted and operated to weighted data. The weighted data may be fixed or variable and may take either positive or negative values.

Further, of each parameter ω cj(t) or the like that is stored for each musical factor, only a typical value may be stored while other values are stored as comparative data or differential data with respect to the typical value, and at the time of reading the comparative or differential data may be operated on the typical value.

In the channel memory areas of the assignment memory 213 can be stored all of the aforementioned data, parameters, various musical factors, and elapsed time of sounding except the data shown in FIG. 26. These data are read out and are sent by the controller 20 and the like for each of the channel timings. In this case, the musical factors and the elapsed time of sounding are converted through the tables 212, 214, 215, 216 . . . and are output. The above-mentioned tone pitch data further include data Which indicate whether the sounding is instructed by the upper keyboard, lower keyboard or foot keyboard.

Moreover, the data generated from each of the portions of the above-mentioned circuits may be once stored in a memory for each of the musical factors, lapse of times from the start of sounding, envelope levels, envelope phases and/or settings instructed by the operator. The data that are read out are input to the circuits subsequent to the portions where the data are generated. The data can be once stored, for example, at the output terminals of the adders 612, 65 and of the multipliers 66, 67 of FIG. 19.

Said "various calculations (1)", "all kinds of calculations (1)" and "a variety of operations (1) described later" mentioned above or will be described below, include addition or subtraction of the data through the adders, multiplication or division of the data through the multipliers, combination of the above operations through the adders and multipliers, other additional operations of the data, other multiplicational operations of the data, bit-shaft operation of the data by some data through the data shifters, synthesis operation in which some data become high-order data and other data become low-order data, operation of the data based upon an operation equation by an arithmetic circuit or the like circuit, and reading of operation data by storing the data that are operated in the memory and by using the data as read address data.

Said "various calculations (2)", "all kinds of calculations (2)" and "a variety of operations (2) described later" mentioned above or will be described below, include addition or subtraction of other data through the adders, multiplication or subtraction by other data through the multipliers, combination of the above operations through the adders and the multipliers, other additional operations with other data, other multiplicational operations with other data, bit-shift operation of the data by other data through the data shifters, synthesis operation for adding other data to the high-order data or to the low-order data, operation of the data based upon an operation equation by an arithmetic circuit or the like circuit, and reading of operation data by storing the operated data in the memory and using the data as read address data.

What is claimed is:

1. A musical tone generating apparatus comprising:

a formant waveform signal generating means for generating at least one formant waveform signal of a waveform obtained by synthesizing the frequency components of formants of a musical tone;

a formant center signal generating means for generating formant center signals from which are synthesized the formant waveform signal that are generated by said formant waveform signal generating means, in a plural number for each musical tone;

formant center frequency data generating means for generating frequency data of formant center signals generated from said formant center signal generating means;

a formant consonance data generating means for generating formant consonance data for determining ratios of frequencies of frequency components of formants of the formant waveform signal generated from said formant waveform signal generating means based upon formant center frequency data generated from said formant center frequency data generating means, the changes in the values of formant consonance data being different from the changes in the values of the formant center frequency data;

a formant density control means for generating formant consonance data generated from said formant consonance data generating means as formant density data that represent at least one density of frequency components of formants of the formant waveform signal generated from said formant waveform signal generating means, and for controlling the density of frequency components of formants of the formant waveform signal generated from said formant waveform signal generating means based upon the formant density data; and a synthesizing means which is controlled by said formant density control means and synthesizes the formant waveform signal generated from said formant waveform signal generating means with the formant center signals generated from said formant center signal generating means.

2. The musical tone generating apparatus according to claim 1, wherein the changes in the values of the formant consonance data i.e. the formant density data are smaller or larger, than the changes in the values of the formant center frequency data, and the values of the formant consonance data i.e. the formant density data have an exponential relationship to the values of the formant center frequency data.

3. The musical tone generating apparatus according to claim 1, wherein said musical tone generating apparatus further has a formant density data generating means that generates said formant density data based upon tone pitch data that represents tone pitch of the musical tone, and said formant density control means synthesizes the formant density data generated from said formant density data generating means with the formant consonance data generated from said formant consonance data generating means.

4. The musical tone generating apparatus according to claim 1, wherein said musical tone generating apparatus further has a formant density data generating means that generates said formant density data based upon the formant center frequency data generated from said formant center frequency data generating means, and said formant density control means synthesizes the formant density data generated from said formant density data generating means with the formant consonance data generated from said formant consonance data generating means.

5. A musical tone generating apparatus comprising:

a formant waveform signal generating means for generating at least one formant waveform signal of a waveform obtained by synthesizing the frequency components of formants of a musical tone;

a formant density data generating means for generating formant density data that represents at least one density of frequency components of formants of formant waveform signals generated from said formant waveform signal generating means;

a formant consonance data generating means for generating formant consonance data for determining ratios of frequencies of frequency components of formants of formant waveform signal generated from said formant waveform signal generating means;

a formant density data synthesizing means for synthesizing the formant consonance data generated from said formant consonance data generating means with the formant density data generated from said formant density data generating means;

a formant density control means for controlling the density of frequency components of formants of formant waveform signal generated from said formant waveform signal generating means based upon the formant density data synthesized by said formant density data synthesizing means;

a formant center signal generating means for generating at least one formant center signal which are synthesized with the formant waveform signal that are generated by said formant waveform signal generating means; and a synthesizing means for synthesizing the formant center signal generated by said formant center signal generating means with the formant waveform signal which are controlled by said formant density control means and are generated by said formant waveform signal generating means.

6. The musical tone generating apparatus according to claim 1 or 5, wherein said formant consonance data determine the values of frequency components of at least one formant of said formant waveform signal to be an integer number of times or a non-integer number of times.

7. The musical tone generating apparatus according to claim 1 or 5, wherein said formant waveform signal generating means is capable of generating a plurality of formant waveform signals, and generates formant waveform signals depending upon the instructed musical factor, lapses of time from the start of sounding, envelope level, envelope phase or instruction by the operator.

8. The musical tone generating apparatus according to claim 1 or 5, wherein said formant consonance data are determined or changed depending upon the musical factor, lapses of time from the start of sounding, envelope level, envelope phase or instruction by the operator.

9. The musical tone generating apparatus according to claim 8, wherein said musical factors change depending upon the lapses of time or envelope data.

10. The musical tone generating apparatus according to claim 1 or 5, wherein said formant waveform signal generating means generates a plurality of formant waveform signals, said formant center signal generating means generates a plurality of formant center signals, and said synthesizing means synthesizes the plurality of formant waveform signals with the formant center signals and outputs them as a musical tone.

11. The musical tone generating apparatus according to claim 10, wherein said formant density data generating means generates a plurality of formant density data, or said formant density control means generates a plurality of formant consonance data.

12. The musical tone generating apparatus according to claim 1, wherein the values of said formant consonance data vary depending upon the values of frequency data of said formant center signal.

13. The musical tone generating apparatus according to claim 1, 3, 4 or 5, wherein the values of said formant consonance data are weighted by weighting data from weighting means.

14. A musical tone generating apparatus comprising:

a formant waveform signal storage means for storing at least one formant waveform signal of a waveform obtained by synthesizing frequency components of formants of a musical tone;

a formant waveform signal reading means for reading the formant waveform signal stored in said formant waveform signal storage means;

a formant center signal generating means for generating at least one formant center signal which are synthesized with the formant waveform signal that are read out by said formant waveform signal reading means;

a synthesizing means for synthesizing the formant center signal generated by said formant center signal generating means with the formant waveform signal generated by said formant waveform signal generating means;

a formant density data generating means for generating formant density data which represent at least one density of frequency components of at least one formant of the formant waveform signal generated from said formant waveform signal generating means and determine the speed for reading the formant waveform signal;

a formant density control means for controlling the density of frequency components of the formant of formant waveform signal generated from said formant waveform signal generating means based upon the formant density data generated from said formant density data generating means;

a modification data storage means for storing modification data that represent ratio or difference between a practical sampling frequency of the formant waveform signal stored in said formant waveform signal storage means and a frequency that serves as a reference based upon the formant density data;

a modification data reading means for reading the modification data stored in said modification data storage means; and a modification and synthesis means which synthesizes the modification data read by said modification data reading means with the formant density data generated by said formant density data generating means, and feeds the synthesized data to said formant density control means.

15. The musical tone generating apparatus according to claim 14, wherein said formant density data are determined or are changed depending upon the musical factor, envelope level, envelope phase, lapses of time from the start of sounding, or instruction by the operator, and the musical factor are, timbre, touch, tone pitch, tone pitch range, musical tone part, volume of sound, sound image, filter characteristic and/or effect.

16. The musical tone generating apparatus according to claim 15, wherein said musical factor vary depending upon the lapses of time or envelope data.

17. The musical tone generating apparatus comprising:

a formant waveform signal storage means for storing at least one formant waveform signal of a waveform obtained by synthesizing frequency components of at least one formant of a musical tone;

a formant waveform signal reading means for reading the formant waveform signal stored in said formant waveform signal storage means;

a formant center signal generating means for generating at least one formant center signal which are synthesized with the formant waveform signal that are read out by said formant waveform signal reading means;

a synthesizing means for synthesizing the formant center signal generated by said formant center signal generating means with the formant waveform signal generated by said formant waveform signal generating means;

a tone pitch data generating means for generating tone pitch data that represent tone pitch of said musical tone;

a formant density data generating means for generating formant density data which represent at least one density of frequency components of at least one formant of the formant waveform signal generated from said formant waveform signal generating means and determine the speed for reading the formant waveform signal, based upon the tone pitch data generated from said tone pitch data generating means; and a formant density control means for controlling the density of frequency components of the formant of formant waveform signal generated from said formant waveform signal generating means based upon the formant density data generated from said formant density data generating means.

18. The musical tone generating apparatus according to claim 1 or 14, wherein said musical tone generating apparatus which further synthesizes the formant consonance data generated from the formant consonance data generating means of claim 1 with the modification data by using the modification and synthesis means of claim 14.

19. The musical tone generating apparatus according to claim 1 or 14, wherein said musical tone generating apparatus which further synthesizes the formant density data synthesized by the formant density data synthesizing means of claim 5 with the modification data by using the modification and synthesis means of claim 14.

20. A musical tone generating apparatus comprising:

a musical tone generation instruction means for instructing the generation of a musical tone;

a formant waveform signal generating means for generating at least one formant waveform signal of a waveform obtained by synthesizing the frequency components of at least one formant of the musical tone in response to the instruction for generating musical tone from said musical tone generation instruction means;

a formant center signal generating means for generating a plurality of formant center signals which are synthesized with the formant waveform signal that are generated from said formant waveform signal generating means in response to the instruction for generating musical tone from said musical tone generation instruction means;

a synthesizing means for synthesizing the plurality of formant center signals generated by said formant center signal generating means with the formant waveform signal generated by said formant waveform signal generating means;

a musical factor generating means for generating musical factor of musical tone generated by said musical tone generation instruction means, envelope level, envelope phase, lapses of time from the start of sounding, or data instructed by the operator; and a formant center signal control means for controlling the frequency, amplitude or number of the plurality of formant center signals of a musical tone generated by said formant center signal generating means depending upon the musical factor and/or various data generated by the musical factor generating means.

21. A musical tone generating apparatus comprising:

a musical tone generation instruction means for instructing the generation of a musical tone;

a formant waveform signal generating means for generating, in parallel, a plurality of formant waveform signals of a waveform obtained by synthesizing the frequency components of at least one formant of the musical tone in response to the instruction for generating musical tone from said musical tone generation instruction means;

a formant center signal generating means for generating at least one formant center signal which are synthesized with the formant waveform signal that are generated from said formant waveform signal generating means in response to the instruction for generating musical tone from said musical tone generation instruction means;

a synthesizing means for synthesizing the formant center signal generated by said formant center signal generating means with the plurality of formant waveform signals generated by said formant waveform signal generating means;

a musical factor generating means for generating musical factor of musical tone generated by said musical tone generation instruction means, envelope level, envelope phase, lapses of time from the start of sounding, or data instructed by the operator; and a formant waveform signal control means for controlling the amplitude of the plurality of formant waveform signals of a musical tone generated by said formant waveform signal generating means depending upon the musical factor and/or various data generated by the musical factor generating means.

22. The musical tone generating apparatus according to claim 20, wherein the formant center signal controlled by said formant center signal control means are those formant center signals other than the formant center signal which have the lowest frequency and are corresponding to a basic frequency of a musical tone instructed by said musical tone generation instruction means.

23. The musical tone generating apparatus according to claim 21, wherein the formant waveform signal controlled by said formant waveform signal control means are those formant waveform signal which are synthesized with the formant center signal other than those formant center signals which have the lowest frequency and are corresponding to a basic frequency of a musical tone instructed by said musical tone generation instruction means.

24. The musical tone generating apparatus according to claim 20 or 21, wherein said musical factor include, timbre, touch, tone pitch, tone pitch range, musical tone part, volume of sound, sound image, filter characteristic and effect.

25. The musical tone generating apparatus according to claim 24, wherein said musical factor vary depending upon the lapses of time or envelope data.

26. The musical tone generating apparatus according to claim 20 or 21, wherein said formant waveform signal generating means generates a plurality of formant waveform signals, said formant center signal generating means generates a plurality of formant center signals, and said synthesizing means synthesizes the plurality of formant waveform signals with the formant center signals and outputs them as a musical tone.

27. The musical tone generating apparatus according to claim 20 or 21, further comprising a formant density data generating means for generating formant density data that represent at least one density of frequency components of the formant of the formant waveform signal generated from said formant waveform signal generating means, and a formant density control means for controlling the density of frequency components of the formant of the formant waveform signal generated from said formant waveform signal translating means based upon the formant density data generated from said formant density data generating means.

28. The musical tone generating apparatus according to claim 27, wherein said formant density data generating means generates a plurality of formant density data, or said formant density control means generates a plurality of formant consonance data.

29. A musical tone generating apparatus comprising:

a musical tone generation instruction means for instructing the generation of a musical tone;

a formant waveform signal generating means for generating at least one formant waveform signal of a waveform obtained by synthesizing the frequency components of at least one formant of the musical tone in response to the instruction for generating musical tone from said musical tone generation instruction means;

a formant center signal generating means for generating a plurality of formant center signals which are synthesized with the formant waveform signal that are generated from said formant waveform signal generating means in response to the instruction for generating musical tone from said musical tone generation instruction means;

a formant synthesizing means for synthesizing the plurality of formant center signals generated by said formant center signal generating means with the formant waveform signal generated by said formant waveform signal generating means;

a musical factor generating means for generating musical factor of musical tone generated by said musical tone generation instruction means, envelope level, envelope phase, lapses of time from the start of sounding, or data instructed by the operator; and a formant synthesized signal control means for controlling the frequency, amplitude or number of the plurality of formant synthesized signals synthesized by said formant synthesizing means depending upon the musical factor and/or various data generated by the musical factor generating means.

30. A musical tone generating apparatus comprising:

a musical tone generation instruction means for instructing the generation of a musical tone;

a formant waveform signal generating means for generating at least one formant waveform signal of a waveform obtained by synthesizing the frequency components of at least one formant of the musical tone in response to the instruction for generating musical tone from said musical tone generation instruction means;

a formant center signal generating means for generating a plurality of formant center signals which are synthesized with the formant waveform signal that are generated from said formant waveform signal generating means in response to the instruction for generating musical tone from said musical tone generation instruction means;

a first formant synthesizing means for synthesizing the plurality of formant center signals generated by said formant center signal generating means with the formant waveform signal generated by said formant waveform signal generating means;

a second formant synthesizing means for further synthesizing a plurality of formant synthesized signals that are synthesized by said first synthesizing means;

a musical factor generating means for generating musical factor of musical tone generated by said musical tone generation instruction means, envelope level, envelope phase, lapses of time from the start of sounding, or data instructed by the operator; and a formant synthesized signal control means for controlling the frequency, amplitude or number of the formant synthesized signals that are synthesized by said second formant synthesizing means depending upon the musical factor and/or various data generated by the musical factor generating means.

31. The musical tone generating apparatus according to claim 29 or 30, wherein said musical factor include, timbre, touch, tone pitch, tone pitch range, musical tone part, volume of sound, sound image, filter characteristic and effect.

32. The musical tone generating apparatus according to claim 29 or 30, wherein said formant waveform signal generating means generates a plurality of formant waveform signals, said formant center signal generating means generates a plurality of formant center signals, and said formant synthesizing means synthesizes the plurality of formant waveform signals with the formant center signals and outputs them as a musical tone.

33. The musical tone generating apparatus according to claim 29 or 30, further comprising a formant density data generating means for generating formant density data that represents at least one density of frequency components of the formant of the formant waveform signal generated from said formant waveform signal generating means, and a formant density control means for controlling the density of frequency components of the formant of the formant waveform signal generated from said formant waveform signal generating means based upon the formant density data generated from said formant density data generating means.

34. The musical tone generating apparatus according to claim 33, wherein said formant density data generating means generates a plurality of formant density data, or said formant density control means generates a plurality of formant consonance data.

35. The musical tone generating apparatus according to claim 29, wherein said formant synthesized signal control means effects the control operation for each of the formants.

36. The musical tone generating apparatus according to claim 30, wherein said formant synthesized signal control means effects the control operation for each of the musical tones, for each group of the musical tones or for the whole musical tones.

37. The musical tone generating apparatus according to claim 1, 5, 14, 17, 20, 21, 29 or 30, wherein said formant waveform signal have a waveform obtained by synthesizing frequency components of a particular partial frequency band or of the whole frequency band of at least one formant of the musical tone.

* * * * *